US008421715B2

(12) United States Patent
Hayakawa et al.

(10) Patent No.: US 8,421,715 B2
(45) Date of Patent: Apr. 16, 2013

(54) DISPLAY DEVICE, DRIVING METHOD THEREOF AND ELECTRONIC APPLIANCE

(75) Inventors: Masahiko Hayakawa, Kanagawa (JP); Yu Yamazaki, Tokyo (JP); Yukari Ando, Gifu (JP); Keisuke Miyagawa, Kanagawa (JP); Jun Koyama, Kanagawa (JP); Tomoyuki Iwabuchi, Kanagawa (JP); Mitsuaki Osame, Kanagawa (JP); Aya Anzai, Kanagawa (JP); Shunpei Yamazaki, Tokyo (JP)

(73) Assignee: Semiconductor Energy Laboratory Co., Ltd., Kanagawa-ken (JP)

( * ) Notice: Subject to any disclaimer, the term of this patent is extended or adjusted under 35 U.S.C. 154(b) by 1317 days.

(21) Appl. No.: 11/131,462

(22) Filed: May 18, 2005

(65) Prior Publication Data

US 2006/0022206 A1 Feb. 2, 2006

(30) Foreign Application Priority Data

May 21, 2004 (JP) ..... 2004-152626

(51) Int. Cl.
*G09G 3/30* (2006.01)

(52) U.S. Cl.
USPC ..... 345/76; 345/82; 345/84; 345/207; 345/211; 345/690; 315/169.3

(58) Field of Classification Search ..... 345/60–73, 345/76, 82, 84, 204, 207, 211, 212, 690; 315/169.3
See application file for complete search history.

(56) References Cited

U.S. PATENT DOCUMENTS 5,483,263 A * 1/1996 Bird et al. ..... 345/207
6,069,676 A * 5/2000 Yuyama ..... 349/62
6,528,951 B2 3/2003 Yamazaki et al.
6,828,950 B2 12/2004 Koyama
7,215,307 B2 5/2007 Ochi et al.
(Continued)

FOREIGN PATENT DOCUMENTS

CN 1329368 A 1/2002
EP 1 117 085 A2 7/2001
(Continued)

OTHER PUBLICATIONS

Office Action (Chinese Application No. 200510081787.X) mailed Feb. 1, 2008 with full English language translation, 12 pages.
(Continued)

*Primary Examiner* — Lun-Yi Lao
*Assistant Examiner* — Insa Sadio
(74) *Attorney, Agent, or Firm* — Fish & Richardson P.C.

(57) ABSTRACT

A light emitting element has a property that a resistance value (internal resistance value) thereof changes according to the ambient temperature. Specifically, assuming that the room temperature is a normal temperature, when the ambient temperature becomes higher than the normal temperature, a resistance value is decreased, and when the ambient temperature becomes lower than the normal temperature, a resistance value is increased. Therefore, when the ambient temperature changes or degradation is caused with time due to the aforementioned property of the light emitting element, luminance varies. The invention provides a display device where an effect of current fluctuation of a light emitting element, which is caused by the change in ambient temperature and degradation with time, is suppressed. The display device comprises a monitoring element, to which a current is supplied from a current source. A voltage applied to the monitoring element is applied to a light emitting element.

38 Claims, 37 Drawing Sheets

U.S. PATENT DOCUMENTS

| | | | | |
|---|---|---|---|---|
| 7,298,347 | B2 | 11/2007 | Yamazaki et al. | |
| 7,609,236 | B2 | 10/2009 | Koyama | |
| 7,773,082 | B2 * | 8/2010 | Miyagawa et al. | 345/212 |
| 7,830,370 | B2 * | 11/2010 | Yamazaki et al. | 345/207 |
| 7,893,892 | B2 | 2/2011 | Tamura et al. | |
| 2001/0020922 | A1 * | 9/2001 | Yamazaki et al. | 345/45 |
| 2001/0030511 | A1 | 10/2001 | Yamazaki et al. | |
| 2001/0033252 | A1 * | 10/2001 | Yamazaki et al. | 345/7 |
| 2002/0011972 | A1 * | 1/2002 | Yamazaki et al. | 345/74.1 |
| 2002/0017643 | A1 * | 2/2002 | Koyama | 257/59 |
| 2002/0033783 | A1 | 3/2002 | Koyama | |
| 2003/0071804 | A1 | 4/2003 | Yamazaki et al. | |
| 2003/0128201 | A1 * | 7/2003 | Ishizuka | 345/212 |
| 2003/0132716 | A1 | 7/2003 | Yamazaki et al. | |
| 2003/0201727 | A1 * | 10/2003 | Yamazaki et al. | 315/169.1 |
| 2003/0209989 | A1 | 11/2003 | Anzai et al. | |
| 2004/0027320 | A1 * | 2/2004 | Ochi et al. | 345/84 |
| 2005/0012731 | A1 | 1/2005 | Yamazaki et al. | |
| 2005/0017933 | A1 * | 1/2005 | Koyama | 345/76 |
| 2005/0017963 | A1 | 1/2005 | Yamazaki et al. | |
| 2005/0017964 | A1 | 1/2005 | Yamazaki et al. | |
| 2005/0285823 | A1 * | 12/2005 | Kimura et al. | 345/76 |
| 2010/0001930 | A1 | 1/2010 | Koyama | |

FOREIGN PATENT DOCUMENTS

| | | | |
|---|---|---|---|
| EP | 1 148 466 | A2 | 10/2001 |
| EP | 1 168 291 | A2 | 1/2002 |
| EP | 1 355 289 | A2 | 10/2003 |
| EP | 1469449 | A1 | 10/2004 |
| JP | 11-305722 | | 11/1999 |
| JP | 2000347622 | | 12/2000 |
| JP | 2001-035655 | | 2/2001 |
| JP | 2001-272968 | | 10/2001 |
| JP | 2001-331144 | | 11/2001 |
| JP | 2002-123219 | A | 4/2002 |
| JP | 2002-175041 | | 6/2002 |
| JP | 2002-175046 | | 6/2002 |
| JP | 2002-278514 | | 9/2002 |
| JP | 2002-333861 | | 11/2002 |
| JP | 2002351403 | | 12/2002 |
| JP | 2003-323159 | | 11/2003 |
| JP | 2004-004759 | A | 1/2004 |
| JP | 2004151501 | A | 5/2004 |

OTHER PUBLICATIONS

T. Shimoda et al.; "Current Status and Future of Light-Emitting Polymer Display Driven by Poly-Si TFT"; *SID 99 Digest*; pp. 372-375; 1999.

Tatsuya Shimoda et al.; "High Resolution Light Emitting Polymer Display Driven by Low_Temperature Polysilicon Thin Film Transistor with Integrated Driver"; *Asia Display 98*; pp. 217-220; 1998.

Chang Wook Han et al.; "Green OLED with low temperature poly Si TFT"; *EuroDisplay '99*; pp. 27-30; 1999.

* cited by examiner

DISPLAY DEVICE, DRIVING METHOD THEREOF AND ELECTRONIC APPLIANCE

BACKGROUND OF THE INVENTION

1. Field of the Invention

The present invention relates to a display device comprising light emitting elements, a driving method thereof and an electronic appliance.

2. Description of the Related Art

In recent years, display devices comprising light emitting elements typified by EL (Electro Luminescence) elements have been developed, and wide applications thereof are expected by utilizing the advantages such as high image quality, wide viewing angle, thin shape and light weight. A light emitting element has a property that luminance thereof is proportional to a current value supplied thereto. Therefore, in order to display gray scales accurately, there has been proposed a display device using a constant current drive where a constant current is supplied to the light emitting element.

[Patent Document 1] Japanese Patent Laid-Open No. 2003-323159

A light emitting element has a property that a resistance value (internal resistance value) thereof changes according to the ambient temperature. Specifically, assuming that the room temperature is a normal temperature, when the ambient temperature becomes higher than the normal temperature, a resistance value decreases, and when the ambient temperature becomes lower than the normal temperature, on the other hand, a resistance value increases. Therefore, when the ambient temperature becomes higher, a current value increases, leading to a higher luminance than the desired luminance, and when the ambient temperature becomes lower, on the other hand, a current value decreases, leading to a lower luminance than the desired luminance. Such a property of a light emitting element is shown in a graph (FIG. 33A) illustrating a relationship between V-I characteristics of a light emitting element and temperatures. Also, the light emitting element has a property that a current value thereof decreases with time. Such a property of a light emitting element is shown in a graph (FIG. 33B) illustrating a relationship between V-I characteristics of a light emitting element and time.

When the ambient temperature changes or degradation is caused with time due to the properties of the light emitting element as set forth above, luminance thereof varies.

SUMMARY OF THE INVENTION

In view of the foregoing circumstances, the invention provides a display device where an effect of fluctuation of current values of a light emitting element, which is caused by the change in ambient temperature and degradation with time, is suppressed.

A display device of the invention comprises a source driver, a gate driver, and a pixel region including a plurality of pixels. Each of the pixels includes a first transistor for controlling a video signal input to the pixel, a second transistor for controlling emission/non-emission of a light emitting element, and a capacitor for storing a video signal.

A display device of the invention comprises a monitoring element including a first electrode and a second electrode, a current source for supplying a current to the monitoring element, a buffer amplifier, a light emitting element including a first electrode and a second electrode, and a driving transistor for driving the light emitting element, wherein the first electrode of the monitoring element and the first electrode of the light emitting element are connected to a power source at a fixed potential, the second electrode of the monitoring element is connected to an input terminal of the buffer amplifier, and the second electrode of the light emitting element is connected to an output terminal of the buffer amplifier via the driving transistor.

A display device of the invention comprises a monitoring element including a first electrode and a second electrode, a current source for supplying a current to the monitoring element, a capacitor for storing a potential of the second electrode of the monitoring element, a first switch for connecting/disconnecting the capacitor and the current source, a second switch for connecting/disconnecting the current source and the monitoring element, a buffer amplifier, a light emitting element including a first electrode and a second electrode, and a driving transistor for driving the light emitting element, wherein the first electrode of the monitoring element and the first electrode of the light emitting element are connected to a power source at a fixed potential, the second electrode of the monitoring element is connected to an input terminal of the buffer amplifier, and the second electrode of the light emitting element is connected to an output terminal of the buffer amplifier via the driving transistor.

A display device of the invention comprises a first monitoring element including a first electrode and a second electrode, a second monitoring element including a first electrode and a second electrode, a current source for supplying a current to the first monitoring element and the second monitoring element, a first switch for connecting/disconnecting the current source and the first monitoring element, a second switch for connecting/disconnecting the current source and the second monitoring element, a buffer amplifier, a light emitting element including a first electrode and a second electrode, and a driving transistor for driving the light emitting element, wherein the first electrode of the monitoring element and the first electrode of the light emitting element are connected to a power source at a fixed potential, the second electrode of the first monitoring element is connected to an input terminal of the buffer amplifier via the first switch, the second electrode of the second monitoring element is connected to the input terminal of the buffer amplifier via the second switch, and the second electrode of the light emitting element is connected to an output terminal of the buffer amplifier via the driving transistor.

A display device of the invention comprises a plurality of monitoring elements each including a first electrode and a second electrode, a current source for supplying a current to the monitoring elements, a plurality of switches provided between the current source and the second electrodes of the respective monitoring elements, a buffer amplifier, a light emitting element including a first electrode and a second electrode, and a driving transistor for driving the light emitting element, wherein the first electrodes of the respective monitoring elements and the first electrode of the light emitting element are connected to a power source at a fixed potential, the second electrode of the respective monitoring elements are connected to an input terminal of the buffer amplifier via one of the switches, and the second electrode of the light emitting element is connected to an output terminal of the buffer amplifier via the driving transistor.

A method for driving a display device of the invention comprising a monitoring element including a first electrode and a second electrode, a current source for supplying a current to the monitoring element, a buffer amplifier, a light emitting element including a first electrode and a second electrode, and a driving transistor for driving the light emitting element wherein the first electrode of the monitoring element and the first electrode of the light emitting element are connected to a power source at a fixed potential, comprising the step of setting a source terminal of the driving transistor at a potential of the second electrode of the monitoring element via the buffer amplifier.

A method for driving a display device of the invention comprising a monitoring element including a first electrode and a second electrode, a current source for supplying a current to the monitoring element, a capacitor for storing a potential of the first electrode of the monitoring element, a first switch for connecting/disconnecting the capacitor and the current source, a second switch for connecting/disconnecting the current source and the monitoring element, a buffer amplifier, a light emitting element including a first electrode and a second electrode, and a driving transistor for driving the light emitting element wherein the first electrode of the monitoring element and the first electrode of the light emitting element are connected to a power source at a fixed potential, comprising the step of detecting a potential of the second electrode of the monitoring element by the buffer amplifier when the first switch and the second switch are ON, setting the second electrode of the light emitting element at the detected potential, storing in the capacitor a potential of the second electrode of the monitoring element at the point when the first switch and the second switch are turned OFF when the first switch and the second switch are OFF, detecting the potential of the second electrode of the monitoring element that is stored in the capacitor by the buffer amplifier, and setting the second electrode of the light emitting element at the detected potential.

In addition, in the method for driving the display device having the aforementioned configuration, a period in which a current is supplied to the monitoring element is set to occupy 30% of one frame period.

In addition, in the method for driving the display device having the aforementioned configuration, a display device comprising transistors having different conductivity types, which are used as the first switch and the second transistor respectively, is employed.

Furthermore, in the method for driving the display device having the aforementioned configuration, a display device comprising transistors having the identical conductivity type, which are used as the first switch and the second switch respectively, is employed.

A transistor used in the invention is not limited to a certain type, and it may be a thin film transistor (TFT) using a non-single crystalline semiconductor film represented by amorphous silicon or polycrystalline silicon, a MOS transistor formed by using a semiconductor substrate or an SOI substrate, a junction transistor, a bipolar transistor, a transistor using an organic semiconductor or a carbon nanotube, or the like. Furthermore, a substrate over which a transistor is mounted is not exclusively limited to a certain type. It may be a single crystalline substrate, an SOI substrate, a glass substrate and the like.

Note that in this specification, connection means electrical connection. Therefore, in the structure disclosed by the invention, elements (other elements or switches, for example) enabling electrical connection may be provided additionally in the shown configuration.

In addition, gate capacitance of a transistor or the like may substitute a capacitor in the pixel. In such a case, the capacitor may be omitted.

A switch used in the invention may be any switch such as an electrical switch and a mechanical switch. It may be anything as far as it can control a current. It may be a transistor, a diode, or a logic circuit configured with them. Therefore, in the case of using a transistor as a switch, polarity thereof (conductivity type) is not particularly limited because it operates just as a switch. However, when OFF current is preferred to be small, a transistor of the polarity with small OFF current is favorably used. For example, a transistor provided with an LDD region has small OFF current. Further, it is desirable that an N-channel transistor be employed when a potential of a source terminal of the transistor as a switch is closer to the low-potential-side power source potential (Vss, Vgnd, 0V and the like), and a P-channel transistor be employed when the potential of the source terminal is closer to the high-potential-side power source potential (Vdd and the like). This helps the switch operate efficiently as the absolute value of the gate-source voltage can be increased. Also, a CMOS switch can be applied by using both N-channel and P-channel transistors.

According to the invention using a constant voltage drive, a driving voltage of a light emitting element can be decreased as compared to the case of using a constant current drive. Therefore, power consumption can be reduced.

DETAILED DESCRIPTION OF THE PREFERRED EMBODIMENTS

Although the invention will be fully described by way of Embodiment Modes and Embodiments with reference to the accompanying drawings, it is to be understood that various changes and modifications will be apparent to those skilled in the art. Therefore, unless otherwise such changes and modifications depart from the scope of the invention, they should be construed as being included therein.

Figure 1:
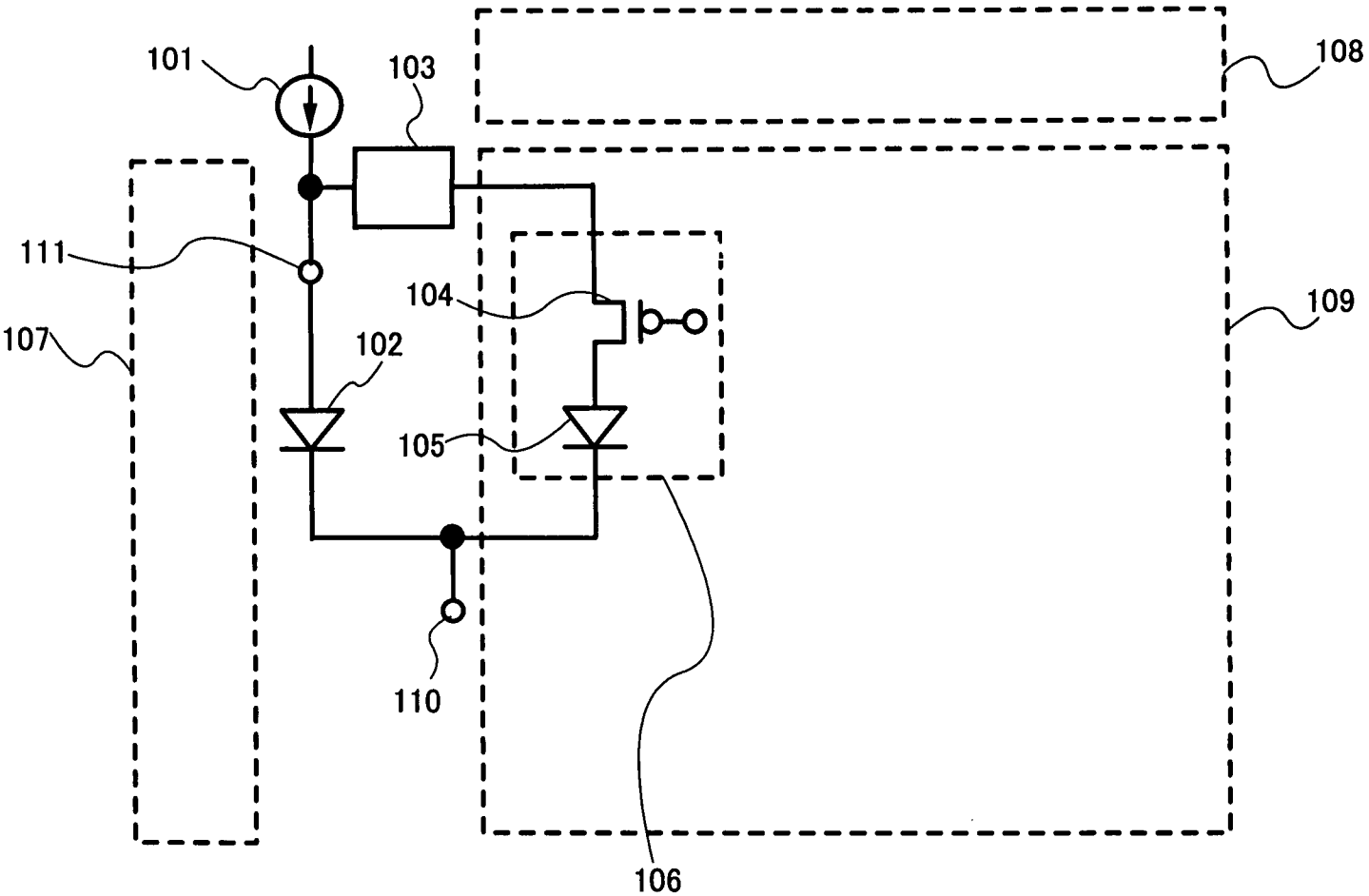
FIG. 1 is a diagram illustrating the display device of the invention.

Description is made below with reference to FIG. 1 on the basic principle of correction for temperature and degradation according to the invention. FIG. 1 illustrates a schematic diagram of a display device comprising a circuit for correcting temperature and degradation.

The display device of the invention comprises a gate driver 107, a source driver 108 and a pixel portion 109. The pixel portion 109 includes a plurality of pixels 106. In addition, the display device of the invention comprises a circuit for correcting temperature and degradation (hereinafter referred to as a correction circuit).

Basic configuration of the correction circuit is described now. It comprises a current source 101, a monitoring element 102, a buffer amplifier 103, a driving TFT 104, and a light emitting element 105. Note that the monitoring element 102 is formed of a light emitting element having the identical current characteristics to the light emitting element 105. When adopting EL elements as these light emitting elements, for example, the EL element as the monitoring element 102 and the EL element as the light emitting element 105 are formed by using the same materials and conditions.

The current source 101 supplies a constant current to the monitoring element 102. That is, the current value of the monitoring element 102 is constant at all times. When an ambient temperature changes under such conditions, the resistance value of the monitoring element 102 per se changes. When the resistance value of the monitoring element 102 changes, potential difference between both electrodes of the monitoring element 102 changes since the current value thereof is constant. By detecting the potential difference between the both electrodes of the monitoring element 102, a change in ambient temperature is detected. Specifically, a potential of an electrode of the monitoring element 102, which is fixed at a constant potential, namely a potential of a cathode 110 in FIG. 1 does not change, therefore, a potential change of the other electrode of the monitoring element 102 that is connected to the current source 101, namely a potential of an anode 111 is detected.

Figure 2:
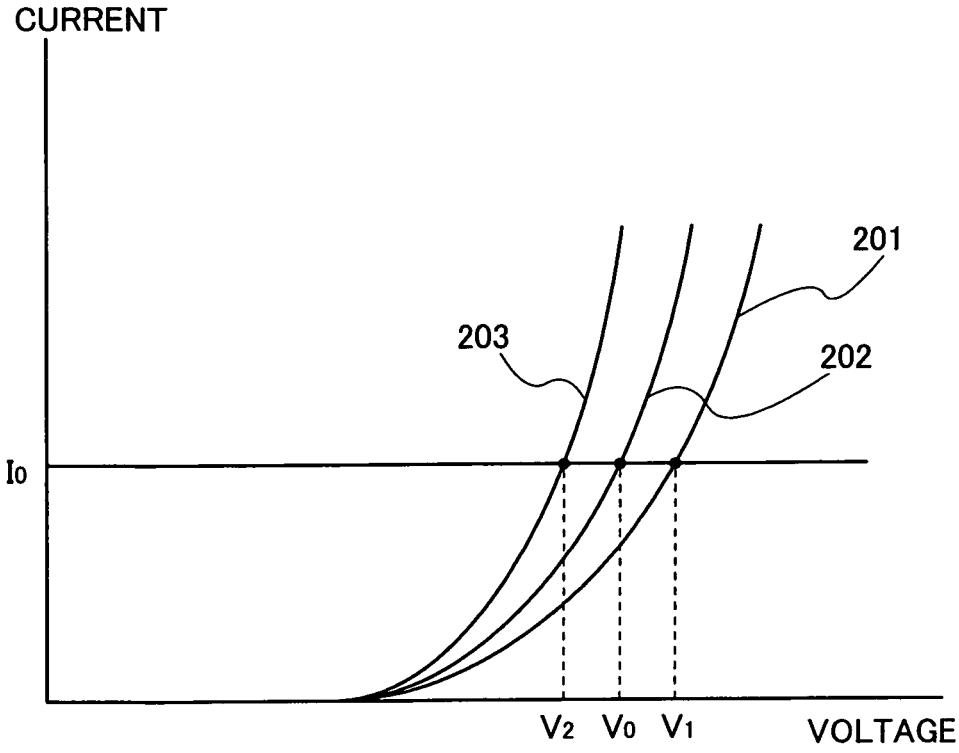
FIG. 2 is a diagram illustrating temperature dependence of the V-I characteristics of a monitoring element.

FIG. 2 is a diagram illustrating temperature dependence of the V-I characteristics of the monitoring element. The V-I characteristics of the monitoring element 102 at a low temperature (e.g., −20° C.), a room temperature (e.g., −25° C.) and a high temperature (e.g., −70° C.) are shown by lines 201, 202 and 203 respectively. When a current value supplied from the current source 101 to the monitoring element 102 is $I_0$, a voltage of $V_0$ is applied to the monitoring element at the room temperature. Meanwhile, a voltage of $V_1$ is applied at the low temperature and a voltage of $V_2$ is applied at the high temperature.

Data containing such change in voltage of the monitoring element 102 is supplied to the buffer amplifier 103, which in turn sets a potential to be supplied to the light emitting element 105 based on the potential of the anode 111. That is, when an ambient temperature becomes low as shown in FIG. 2, a potential is set such that a voltage of $V_1$ is applied to the light emitting element 105 while a potential is set such that a voltage of $V_2$ is applied to the light emitting element 105 when an ambient temperature becomes high. Accordingly, a power source potential to be inputted to the light emitting element 105 can be corrected in accordance with the change in temperature. That is, fluctuation of current values caused by the change in temperature can be suppressed.

Figure 3:
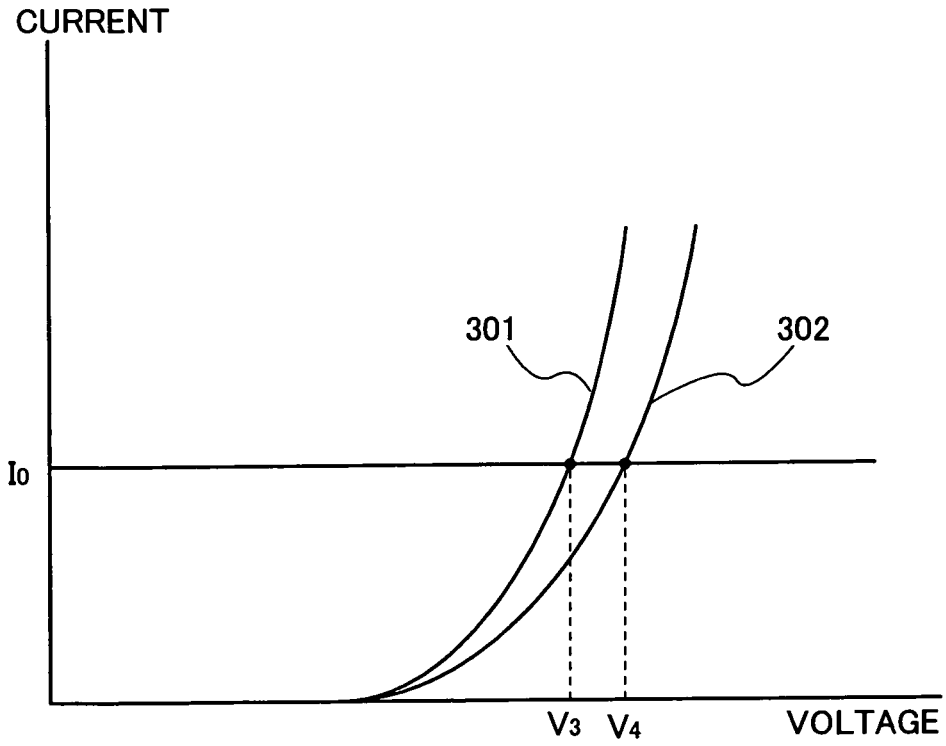
FIG. 3 is a diagram illustrating changes with time of the V-I characteristics of a monitoring element.

FIG. 3 is a diagram illustrating changes with time of the V-I characteristics of the monitoring element 102. Initial characteristics of the monitoring element 102 are shown by a line 301 while characteristics of the degraded monitoring element 102 are shown by a line 302. Note that the initial characteristics and the characteristics after having degraded are measured under the same temperature condition. When a current $I_0$ flows into the monitoring element 102 under the condition of the initial characteristics, a voltage of $V_3$ is applied to the monitoring element 102 while a voltage of $V_4$ is applied to the degraded monitoring element 102. Accordingly, an apparent degradation of the light emitting element 105 can be decreased if the voltage of $V_4$ is applied to the light emitting element 105 that has degraded similarly. In this manner, the monitoring element 102 degrades along with the light emitting element 105, therefore, degradation of the light emitting element 105 can be corrected.

As the buffer amplifier 103 for setting the anode of the light emitting element 105 at the same potential as the changed potential of the anode 111 of the monitoring element 102, a voltage follower circuit using an operational amplifier may be used. This is because, a non-inverting input terminal of a voltage follower circuit has a high input impedance while an output terminal thereof has a low output impedance, which allows the input terminal and the output terminal to be at the same potentials, and a current can be outputted from the output terminal without a current from the current source 101 flowing to the voltage follower circuit.

Figure 11:
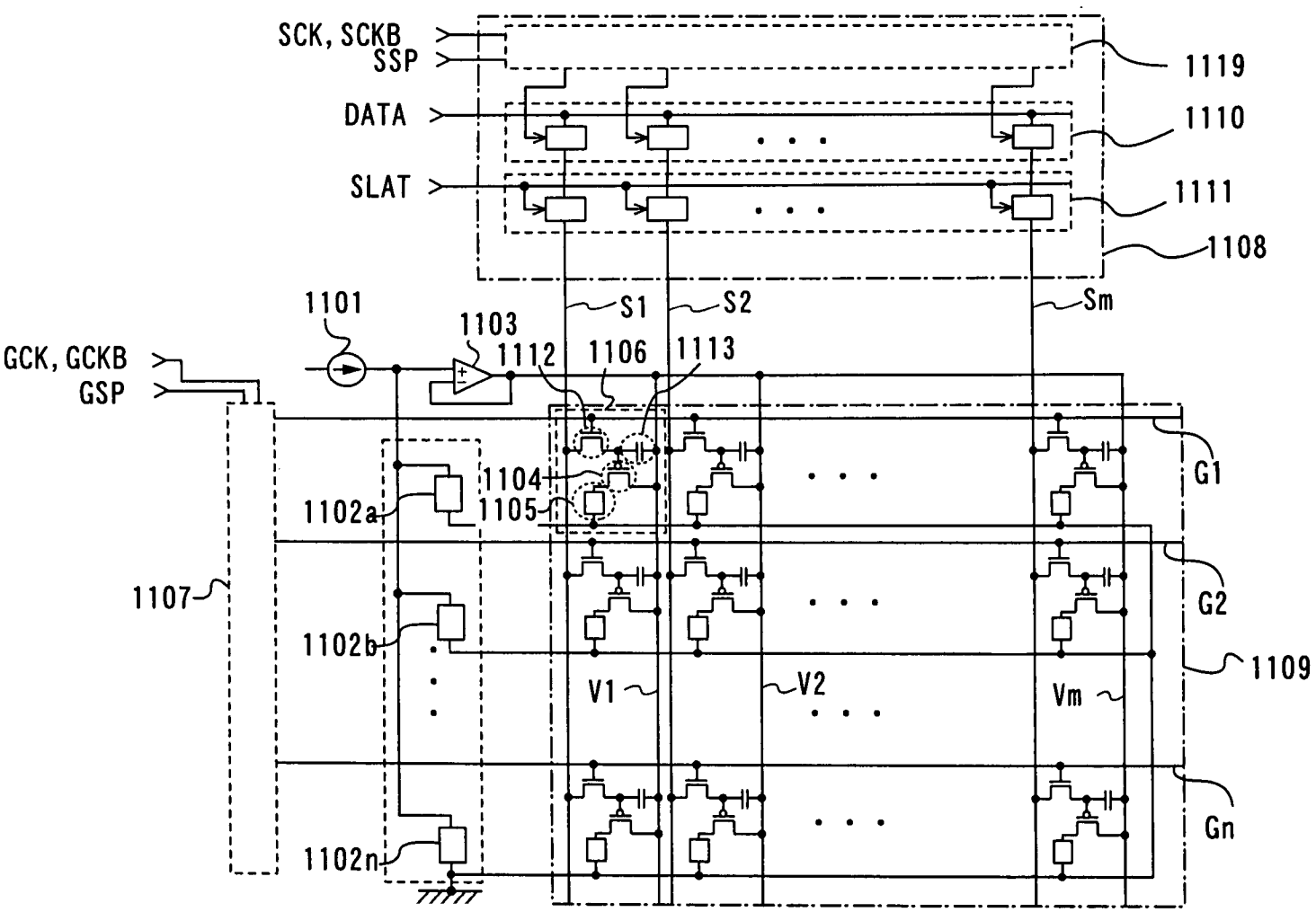
FIG. 11 is a diagram illustrating the display device of the invention.

Description is made now with reference to FIG. 11 on a specific configuration of a display device having a correction circuit in this embodiment mode. The display device comprises a gate driver 1107, a source driver 1108 and a pixel portion 1109. The source driver includes a pulse output circuit 1119, a first latch circuit 1110 and a second latch circuit 1111. While the first latch circuit is inputted with signals, the second latch circuit can output signals. A switching transistor 1112 in a pixel 1106 selected by a gate signal line, to which a signal is inputted from the gate driver 1107, is turned ON. Then, a signal outputted from the second latch circuit 1111 is written to a storage capacitor 1113 through source signal lines S1 to Sm. According to the signal written to the storage capacitor 1113, a driving transistor 1104 is turned ON/OFF to determine emission or non-emission of the light emitting element. That is, an anode of a light emitting element 1105 is set at the potential of power source lines V1 to Vm via the driving transistor 1104 that is ON, thereby a current is supplied to the light emitting element 1105 to emit light.

In the invention, a current is supplied from a basic current source 1101 to monitoring elements 1102*a* to 1102*n* connected in parallel. Potentials of respective anodes of these monitoring elements 1102*a* to 1102*n* are detected, and potentials of the power source lines V1 to Vm are set by the voltage follower circuit 1103. In this manner, a display device having a temperature correction function and a degradation correction function can be provided.

Such a driving method having a temperature correction function and a degradation correction function is also called constant brightness.

Note that the number of the monitoring elements can be selected appropriately. Needless to say, either a single monitoring element or a plurality of monitoring elements may be provided as shown in FIG. 11. When using a single monitoring element, the basic current source 1101 is only required to be supplied with a current value that is to be supplied to the light emitting element 1105 in each pixel, therefore, power consumption can be reduced. Alternatively, when disposing a plurality of monitoring elements, variations of the monitoring elements can be averaged.

Note also that in the configuration of FIG. 11, a cathode of the light emitting element 1105 in each pixel is set at GND, however, the invention is not limited to this.

Figure 12:
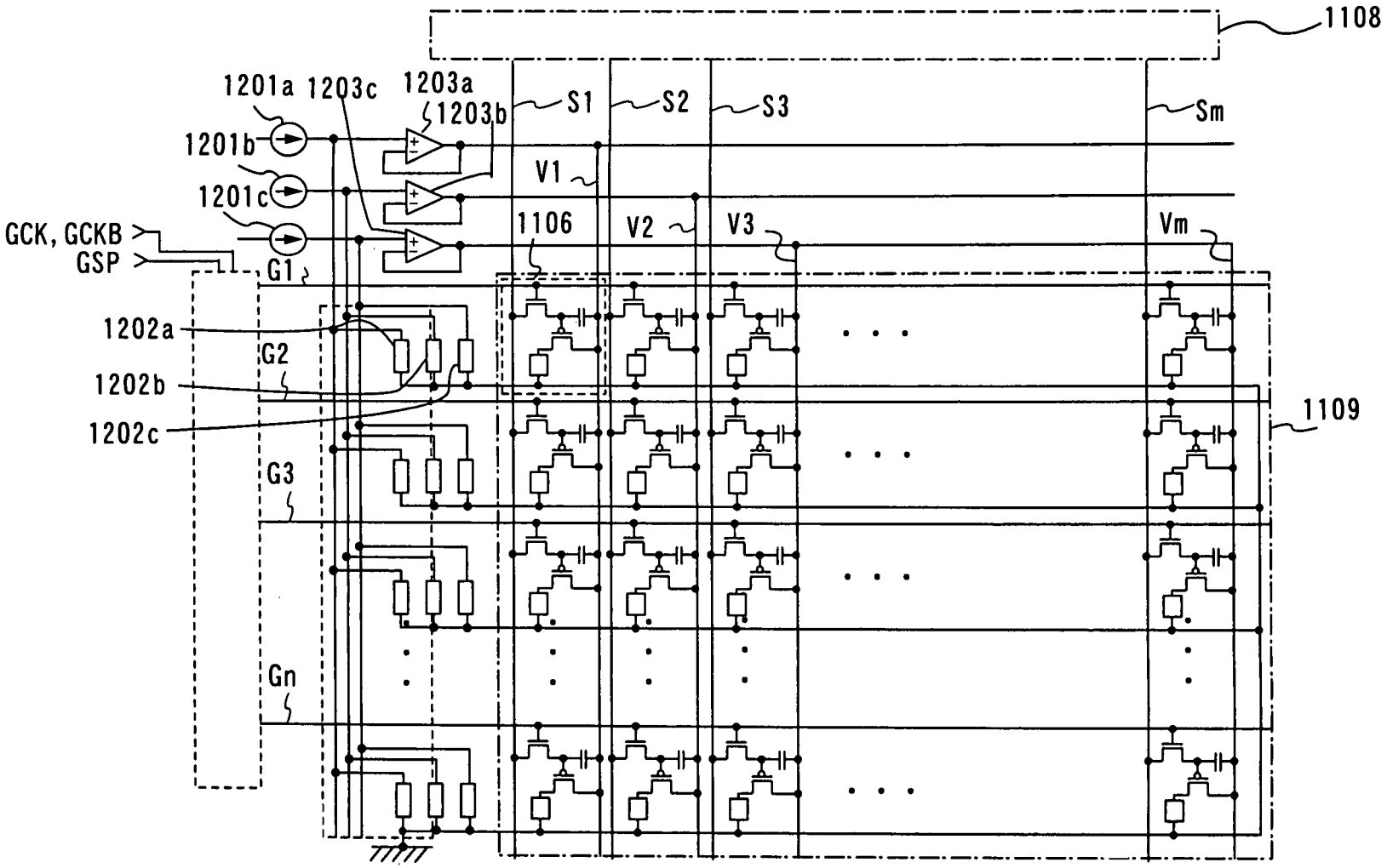
FIG. 12 is a diagram illustrating the display device of the invention.

Also, potentials of power source lines may be set per pixel of RGB. FIG. 12 illustrates an example of that case. Common portions to those of the display device in FIG. 11 are denoted by common reference numerals. In addition, description of the detailed operation thereof is omitted since it is the same as in FIG. 11.

Figure 29:
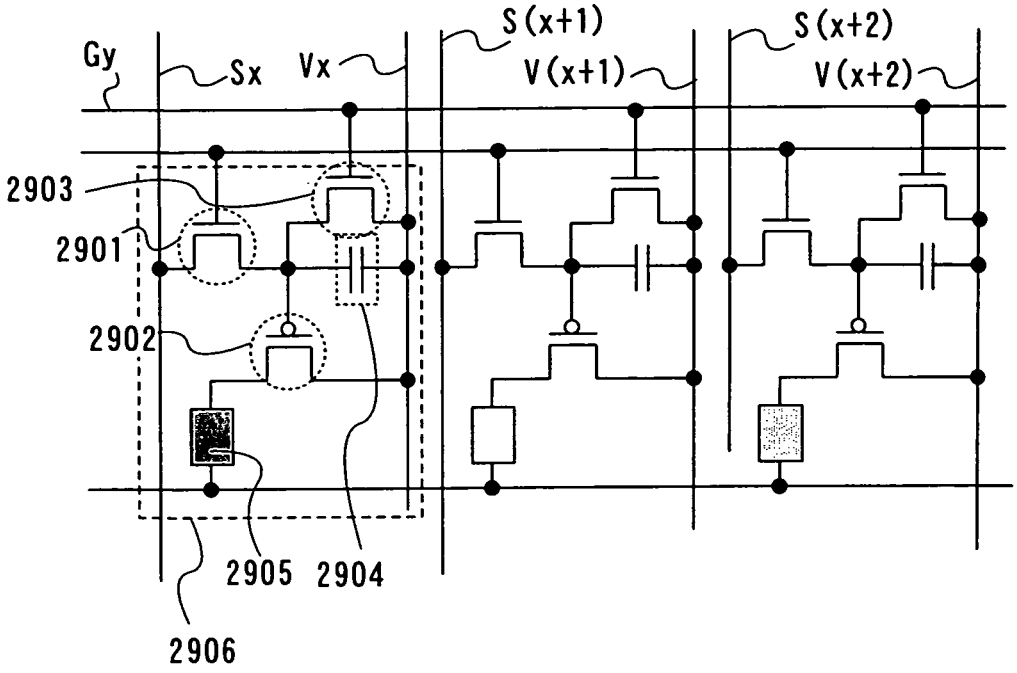
FIG. 29 is a diagram illustrating a pixel configuration of the invention.
Figure 30:
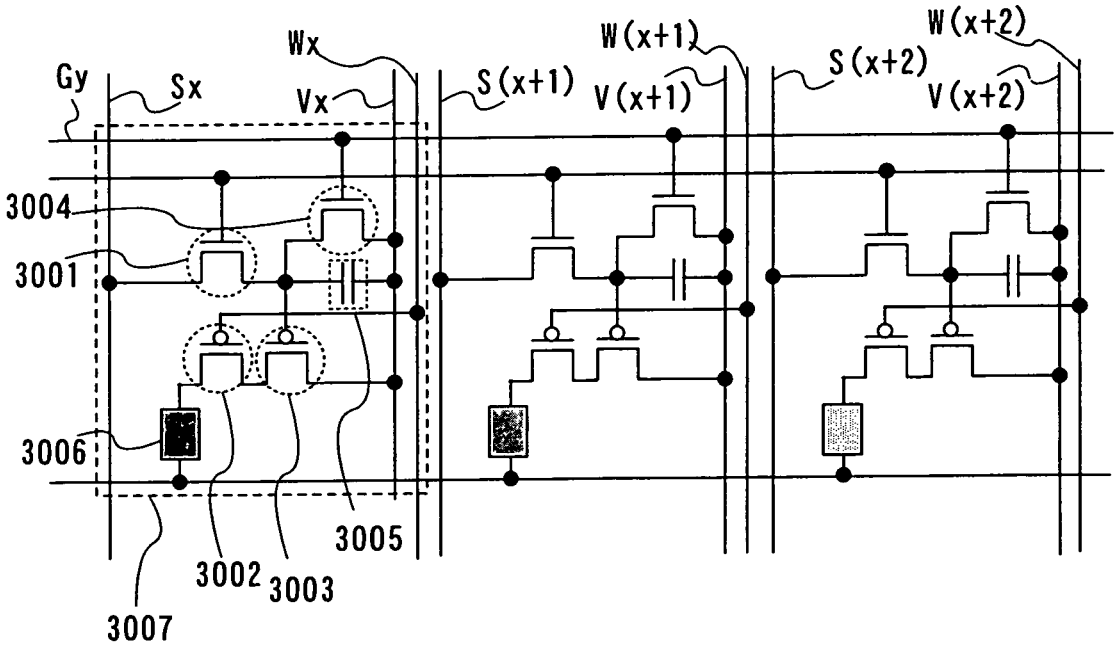
FIG. 30 is a diagram illustrating a pixel configuration a of the invention.

In addition, the pixel 1106 is not limited to such a configuration, and a configuration shown in FIG. 29 or 30 may be adopted. A pixel 2906 shown in FIG. 29 comprises a switching transistor 2901, a driving transistor 2902, an erasing transistor 2903, a capacitor 2904 and a light emitting element 2905. A pixel 3007 shown in FIG. 30 comprises a switching transistor 3001, a controlling transistor 3002, a driving transistor 3003, an erasing transistor 3004, a capacitor 3005 and a light emitting element 3006.

In the display device in FIG. 12, a pixel to which a signal line S1 is connected is a pixel for R (red) emission, a pixel to which a signal line S2 is connected is a pixel for G (green) emission, and a pixel to which a signal line S3 is connected is a pixel for B (blue) emission. A basic current source 1201*a* supplies a current to the monitoring element 1202*a*. A voltage follower circuit 1203*a* detects a potential of an anode of the monitoring element 1202*a*, and a power source line $V_1$ is set at the detected potential. A basic current source 1201*b* supplies a current to the monitoring element 1202*b*. A voltage follower circuit 1203*b* detects a potential of an anode of a monitoring element 1202*b*, and a power source line $V_2$ is set at the detected potential. A basic current source 1201*c* supplies a current to the monitoring element 1202*c*. A voltage follower circuit 1203*c* detects a potential of an anode of a monitoring element 1202*c*, and a power source line $V_3$ is set at the detected potential. In this manner, potentials can be set for each of RGB, therefore, light emitting elements can be set at desired potentials when the temperature characteristics or the degradation characteristics differ depending on the EL materials of each RGB. That is, power source potentials can be corrected for each of RGB.

Embodiment Mode 1

In this embodiment mode, description is made on a configuration where accuracy of degradation correction is further improved.

When a display device is used for a long period, degradation speed varies between a monitoring element and a light emitting element. The longer the period used is, the larger the variation becomes, which leads to a lower function of degradation correction.

Figure 4:
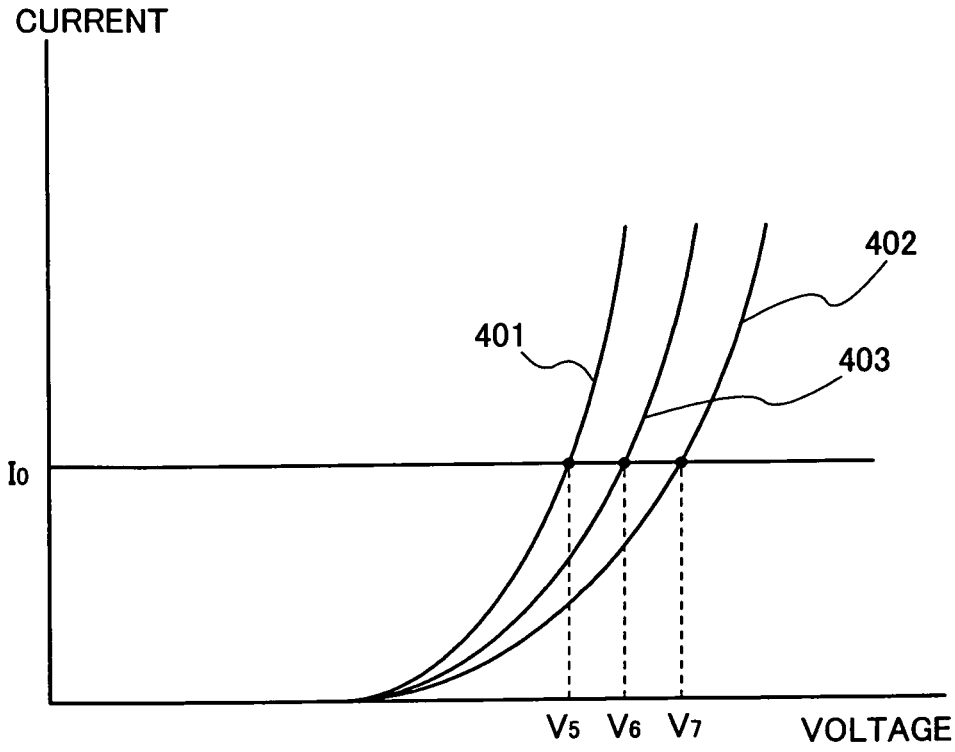
FIG. 4 is a diagram illustrating degradation of a monitoring element and a light emitting element.

Description is made now with reference to FIG. 4 on the case where the degradation speed varies. Initial V-I characteristics of the monitoring element 102 and the light emitting element 105 are shown by a line 401 while V-I characteristics of the monitoring element 102 that has degraded through use of the display device for a certain period of time are shown by a line 402. Also, the V-I characteristics of the light emitting element 105 that has degraded through use of the display device for a certain period of time are shown by a line 403. In this manner, degradation speed varies between the monitoring element 102 and the light emitting element 105. This is because a current is constantly supplied to the monitoring element 102 when the display device displays images. However, since the light emitting element 105 in each pixel does not always emit light, degradation with time varies between the monitoring element 102 and the light emitting element 105. That is, degradation speed of the light emitting element is slower than that of the monitoring element.

Here, in the initial characteristics of the monitoring element 102, when a current $I_0$ flows into the monitoring element 102, a voltage of $V_5$ is applied to the monitoring element. After the light emitting element 105 degrades, a voltage of $V_6$ is applied while a voltage of $V_7$ is applied after the monitoring element 102 degrades. In other words, in order to supply a current $I_0$ to the light emitting element 105 that has degraded, a voltage of $V_6$ is required to be applied while a voltage of $V_7$ is required to be applied in order to supply a current $I_0$ to the monitoring element 102 that has degraded.

When the potential $V_7$ of the anode 111 of the monitoring element 102 is detected under such conditions and the light emitting element is set at the detected potential $V_7$ by the buffer amplifier 103, a voltage higher than $V_6$ that is necessary to flow the current $I_0$ to the light emitting element is applied, which leads to large power consumption. Further, since the degradation speed of the light emitting element in each pixel varies from each other, screen burn becomes distinctive when an excessive voltage is applied.

In this embodiment mode, degradation speed of each light emitting element is made closer to that of the monitoring element in order to improve the accuracy of the degradation correction.

Therefore, in this embodiment mode, a current is supplied to the monitoring element during an average length of the emission periods of the light emitting element in each pixel of the display device. Preferably, a current is supplied to the monitoring element during 10% to 70% of the image display period of the display device.

It has been experientially known that the average ratio of emission/non-emission periods of a light emitting element in each pixel of a display device is 3:7. Accordingly, a current is supplied to the monitoring element during 30% of the image display period of the display device.

Figure 5:
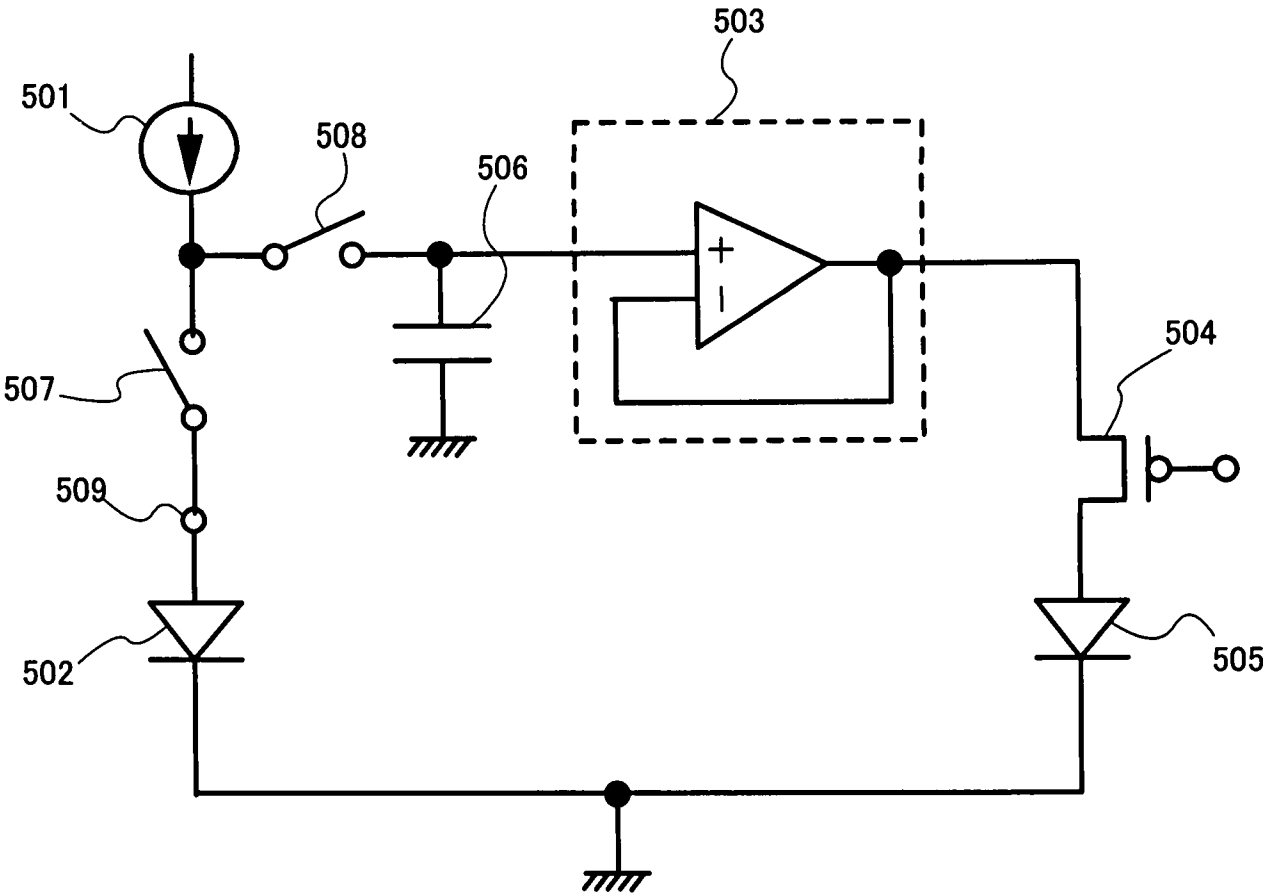
FIG. 5 is a diagram illustrating the correction function of the invention.

FIG. 5 illustrates a configuration of a correction circuit capable of setting an emission period of a monitoring element. It comprises a current source 501, a monitoring element 502, a voltage follower circuit 503, a driving transistor 504, a light emitting element 505, a capacitor 506, a first switch 507 and a second switch 508.

When a constant current is supplied to the monitoring element 502, the first switch 507 and the second switch 508 are turned ON. Then, a current flows into the monitoring element 502, and a potential of an anode 509 of the monitoring element 502 is accumulated in the capacitor 506. At the same time, this potential is inputted to a non-inverting input terminal of the voltage follower circuit 503, and the same potential is outputted from the output terminal thereof. In this manner, the light emitting element 105, of which V-I characteristics have changed due to the change in ambient temperature, can be set at a desired potential.

When the monitoring element 502 is to emit no light, the first switch 507 and the second switch 508 are turned OFF, and a potential of the anode 509 of the monitoring element 502 is held in the capacitor 506. At this time, the second switch 508 is turned OFF simultaneously with the first switch 507, or at least before the first switch 507 is turned OFF. This is because, if the first switch 507 is turned OFF before the second switch 508 is turned OFF, a potential of the capacitor that has accumulated the potential of the anode of the monitoring element 502 fluctuates.

In this manner, in the non-emission period also, the potential of the anode 509 of the monitoring element 502 at the moment when the second switch 508 is turned OFF is inputted to the non-inverting input terminal of the voltage follower circuit 503. Then, the same voltage is outputted from the output terminal of the voltage follower circuit 503, thereby a current supplied to the monitoring element 502 at the moment when the second switch 508 is turned OFF can be supplied to the light emitting element.

In such a configuration, a temperature correction function can be achieved during the period in which a current is supplied to the monitoring element, therefore, both the degradation correction and the temperature correction can be achieved. In this embodiment mode, the function of the degradation correction is superior in particular.

It has been experientially known that, in the time gray scale display of the display device, the average ratio of emission/non-emission periods of each pixel within one frame period is 30:70. Accordingly, during the image display period of the display device, an average ratio of a current amount supplied to a monitoring element to which a current is constantly supplied, and a current amount supplied to each light emitting element is 100:30. Thus, by setting the period in which a current is supplied to the monitoring element to occupy 30% of one frame period, degradation speed of the monitoring element can be made closer to that of the light emitting element in the pixel. That is, accuracy of the degradation correction can be improved.

Further, in the aforementioned configuration, when a monitoring element for degradation correction is provided per RGB, a degradation correction function and a temperature correction function can be provided with even more improved accuracy. The temperature correction and the degradation correction are preferably performed by providing a monitoring element correspondingly to each light emitting element for RGB in the case where the degradation speed or life of EL varies between RGB or the case where the temperature characteristics of the EL element varies between RGB. Further, when an emission period of each monitoring element for RGB is set in accordance with an average value of the emission/non-emission periods (duty ratio) of each light emitting element for RGB, accuracy of the degradation correction is further improved. That is, the average value of the degradation speeds of the monitoring element and each light emitting element can be approximately equal, which leads to higher accuracy of the degradation correction. Further, since the monitoring element can be formed by using the EL material of the same color, accuracy of the temperature correction of the light emitting element can also be improved. Such a configuration can be achieved when it is applied to the display device shown in FIG. 12.

Embodiment Mode 2

Figure 6:
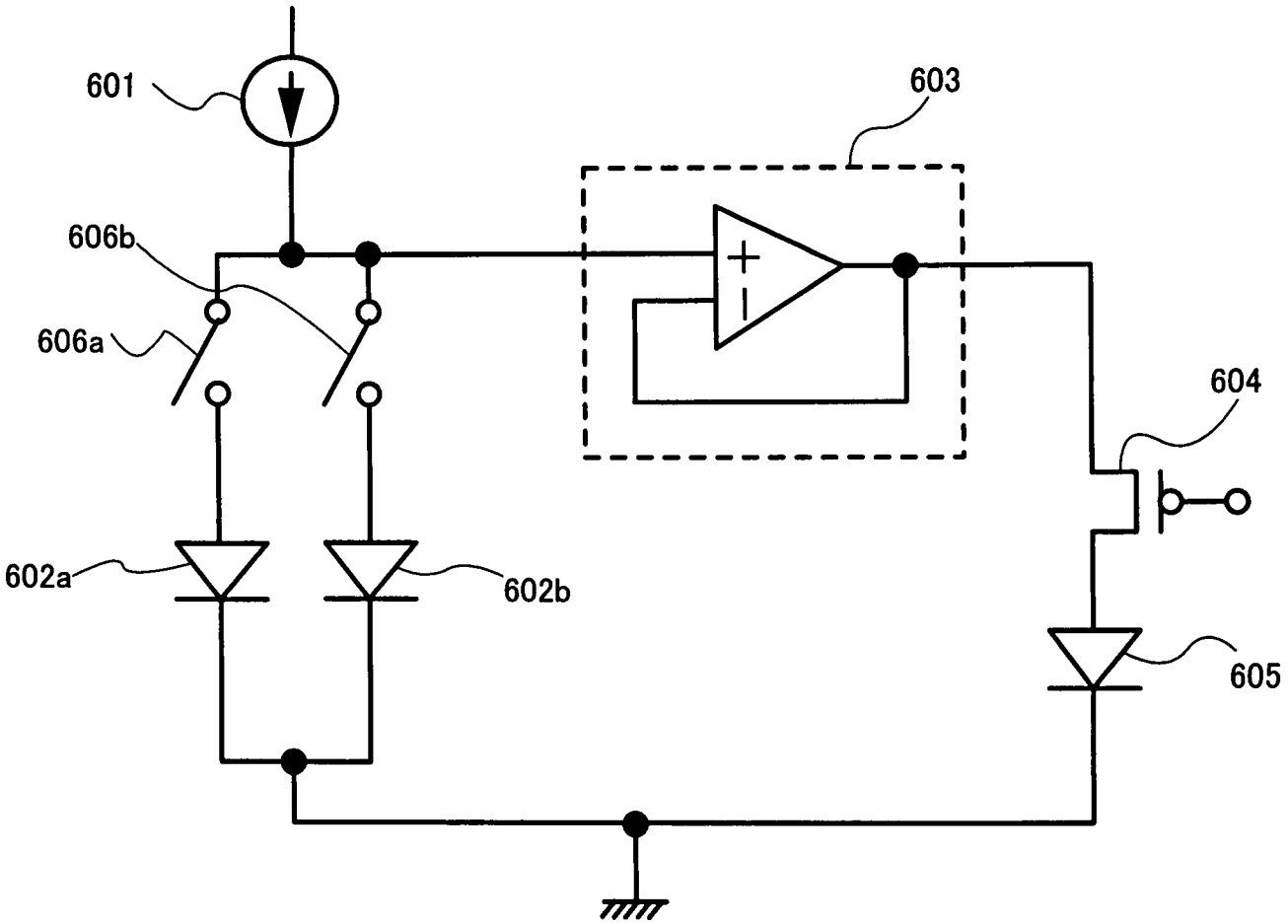
FIG. 6 is a diagram illustrating the correction function of the invention.

In this embodiment mode, description is made with reference to FIG. 6 on a configuration of a display device where accuracy of the degradation correction is improved while maintaining the accuracy of the temperature correction.

The display device comprises a current source 601, a monitoring element 602*a*, a monitoring element 602*b*, a voltage follower circuit 603, a driving transistor 604, a light emitting element 605, a switch 606*a* and a switch 606*b*.

Description is made briefly on the operation of a correction circuit having the present configuration. The switch 606*a* and 606*b* are alternately turned ON. Then, a current necessarily flows into the monitoring element 602*a* or 602*b*. Then, a potential of an anode of the monitoring element 602*a* or 602*b* is detected by the voltage follower circuit 603, and the light emitting element 605 can be set at the detected potential. Alternatively, by setting the ON periods of the switches 606*a* and 606*b* to have equal length, degradation speed with time of the monitoring elements 602*a* and 602*b* can be delayed.

In addition, since a current is constantly supplied to the monitoring element 602*a* or 602*b*, and a potential of the anode of the monitoring element is detected so as to set the anode of the light emitting element at the detected potential, a temperature correction can be constantly performed as well.

Figure 7:
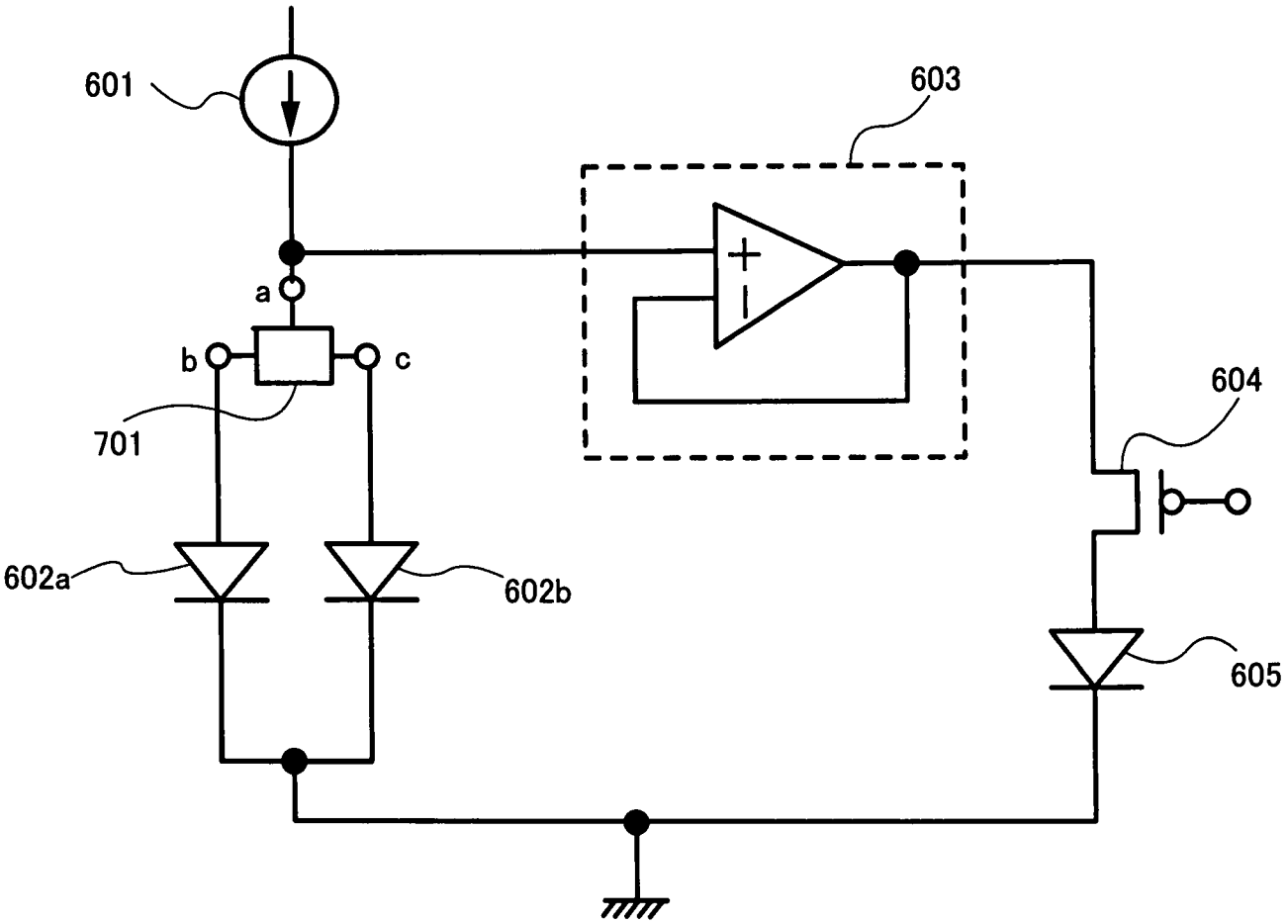
FIG. 7 is a diagram illustrating the correction function of the invention.

FIG. 7 illustrates an exemplary switch capable of functioning in such a manner. A switch 701 functions as the switches 606*a* and 606*b* in FIG. 6. A terminal a of the switch 701 is connected to the current source 601, a terminal b of the switch 701 is connected to the anode of the monitoring element 602*a*, and a terminal c of the switch 701 is connected to the anode of the monitoring element 602*b*. When a current is supplied from the current source 601 to the monitoring element 602*a*, the terminal a and the terminal b of the switch 701 are connected to each other. On the other hand, when a current is supplied to the monitoring element 602*b*, the terminal a and the terminal c are connected to each other.

Figure 8:
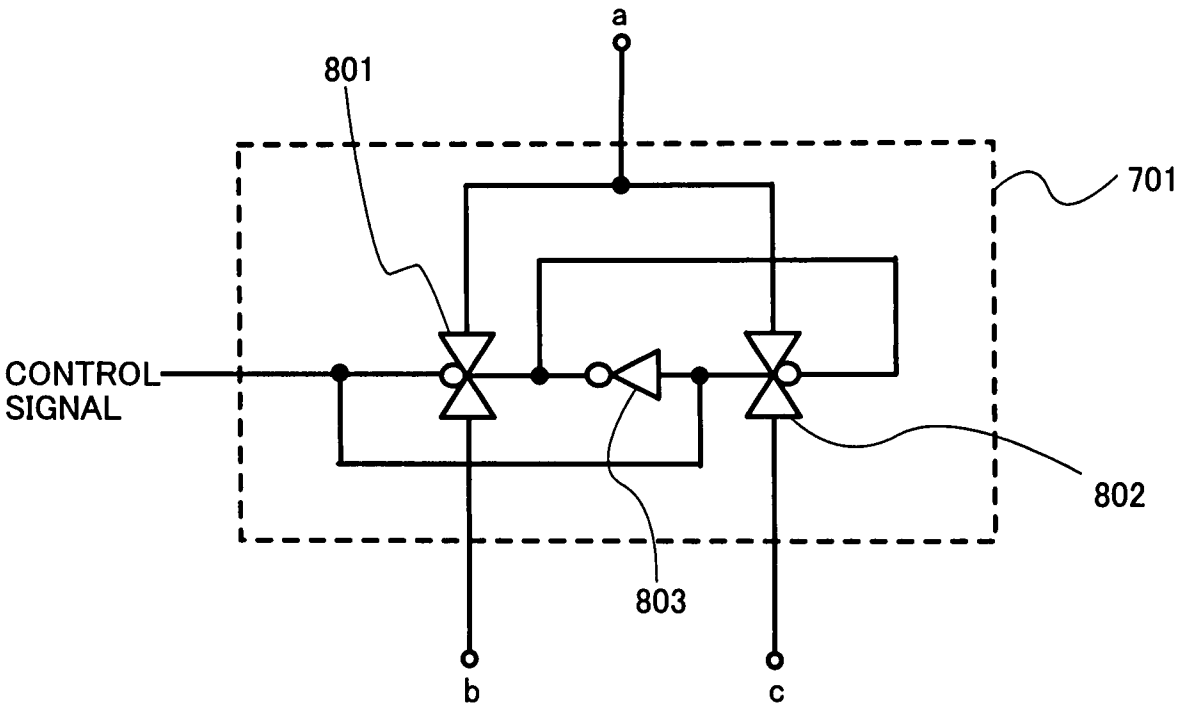
FIG. 8 is a diagram illustrating a configuration of a switch applicable to the invention.

FIG. 8 illustrates a specific configuration example of the switch 701. The switch 701 comprises analog switches 801 and 802, and an inverter 803. A control signal is inputted to control input terminals of the analog switches 801 and 802, thereby either the analog switch 801 or the analog switch 802 is turned ON. In this manner, it can be determined to which of the monitoring elements 602*a* and 602*b*, a current is to be supplied.

Figure 9:
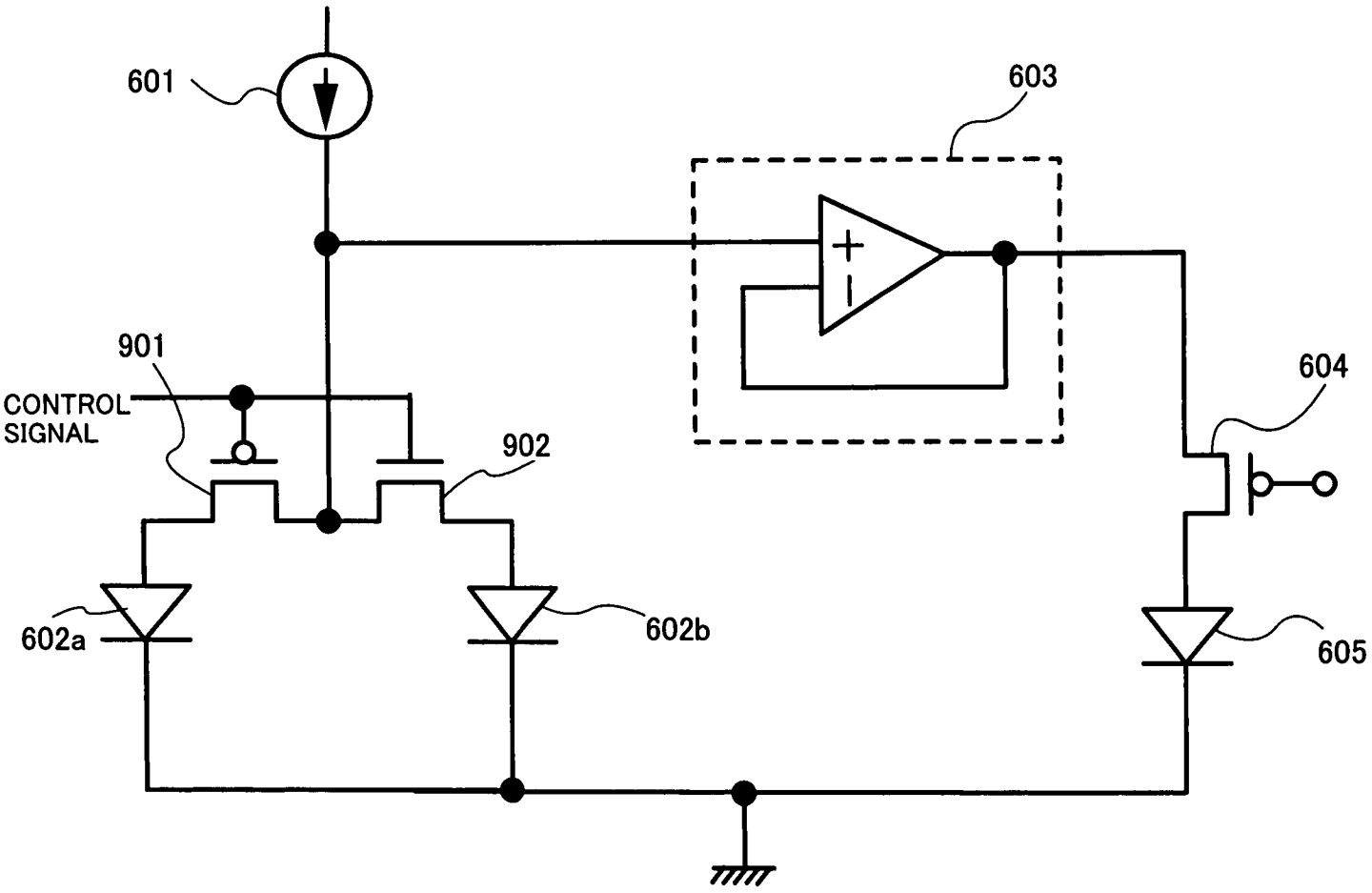
FIG. 9 is a diagram illustrating the correction function of the invention.
Figure 13:
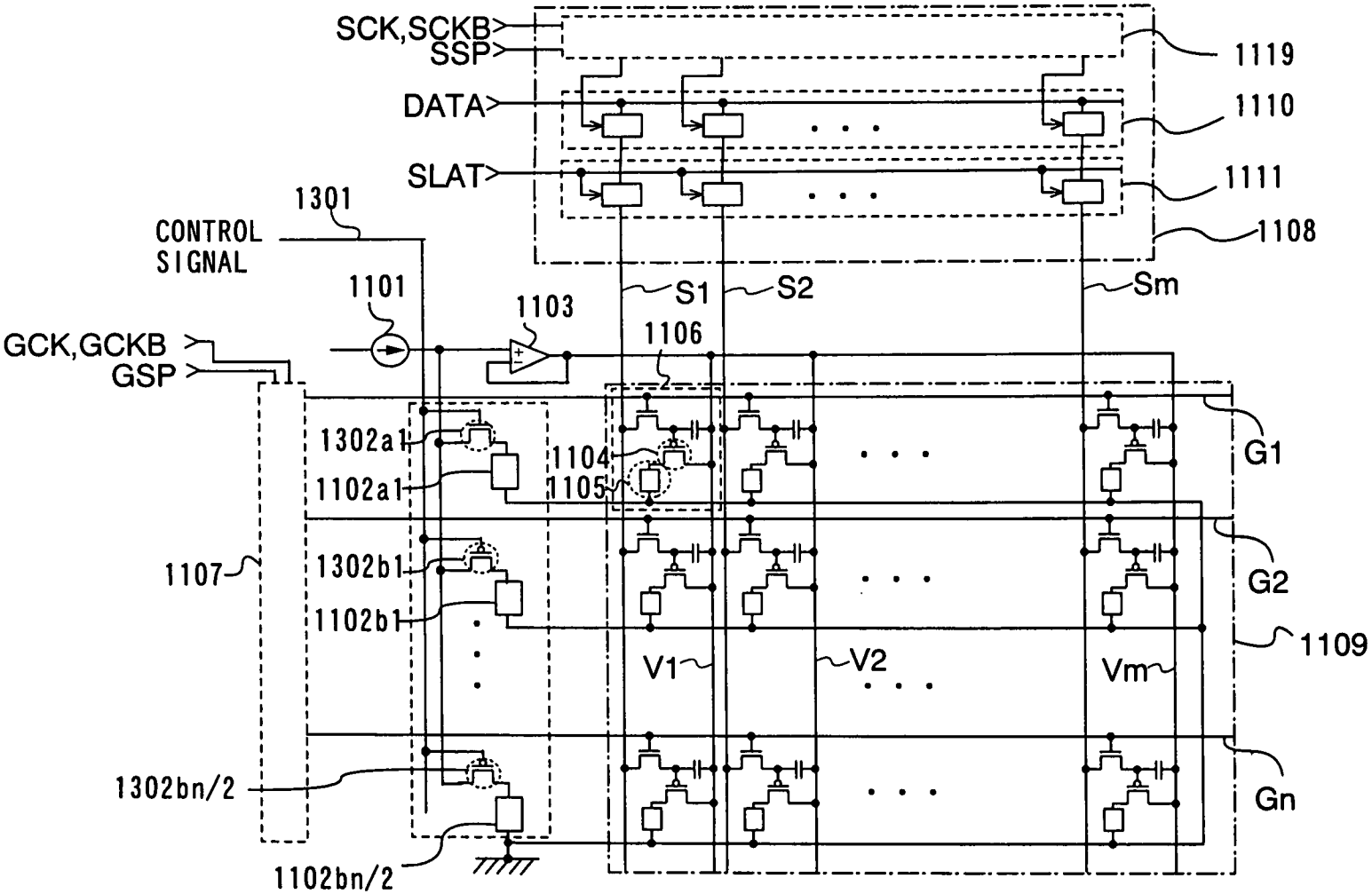
FIG. 13 is a diagram illustrating the display device of the invention.

Further, the function of the switches 606*a* and 606*b* can be realized by use of a transistor as shown in FIG. 9. A P-channel switching transistor 901 and an N-channel switching transistor 902 are used. A source terminal of the switching transistor 901 and a drain terminal of the switching transistor 902 are connected to the current source 601. A drain terminal of the switching transistor 901 is connected to the anode of the monitoring element 602*a*. A source terminal of the switching transistor 902 is connected to the anode of the monitoring element 602*b*. A control signal is inputted to gate terminals of the transistors. Then, one of the switching transistors 901 and 902 is turned ON since they have the different conductivity types. In this manner, the monitoring element 602*a* or 602*b* can be selected. FIG. 13 illustrates a specific configuration example where this configuration is applied to a display device. The transistor 901 in FIG. 9 corresponds to a transistor 1302*b* in FIG. 13 while the transistor 902 in FIG. 9 corresponds to a transistor 1302*a* in FIG. 13. A control signals is inputted from a control line 1301 to gate terminals of the transistors, thereby the P-channel transistor 1302*b* and the N-channel transistor 1302*a* are alternately turned ON.

Figure 10:
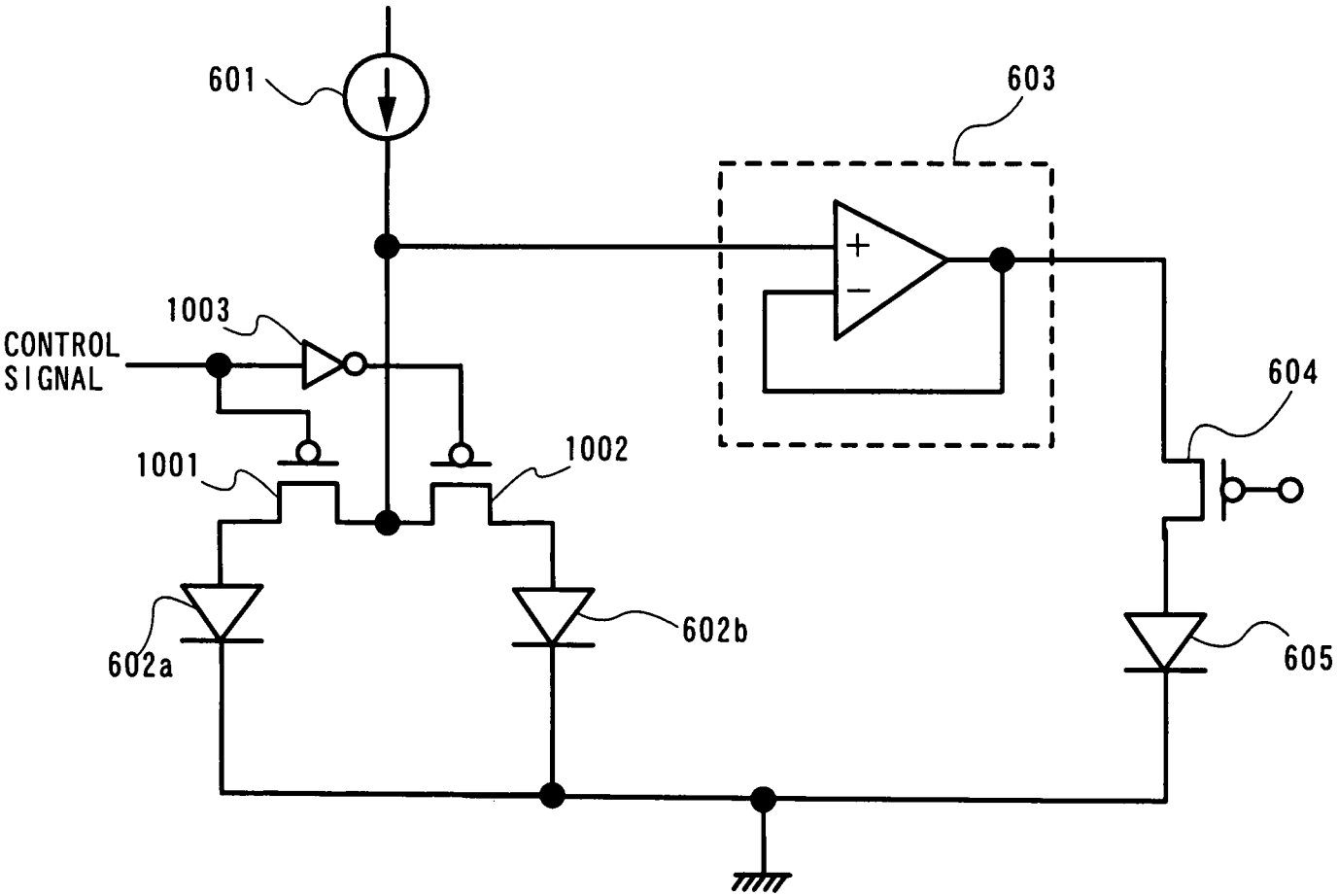
FIG. 10 is a diagram illustrating the correction function of the invention.
Figure 14:
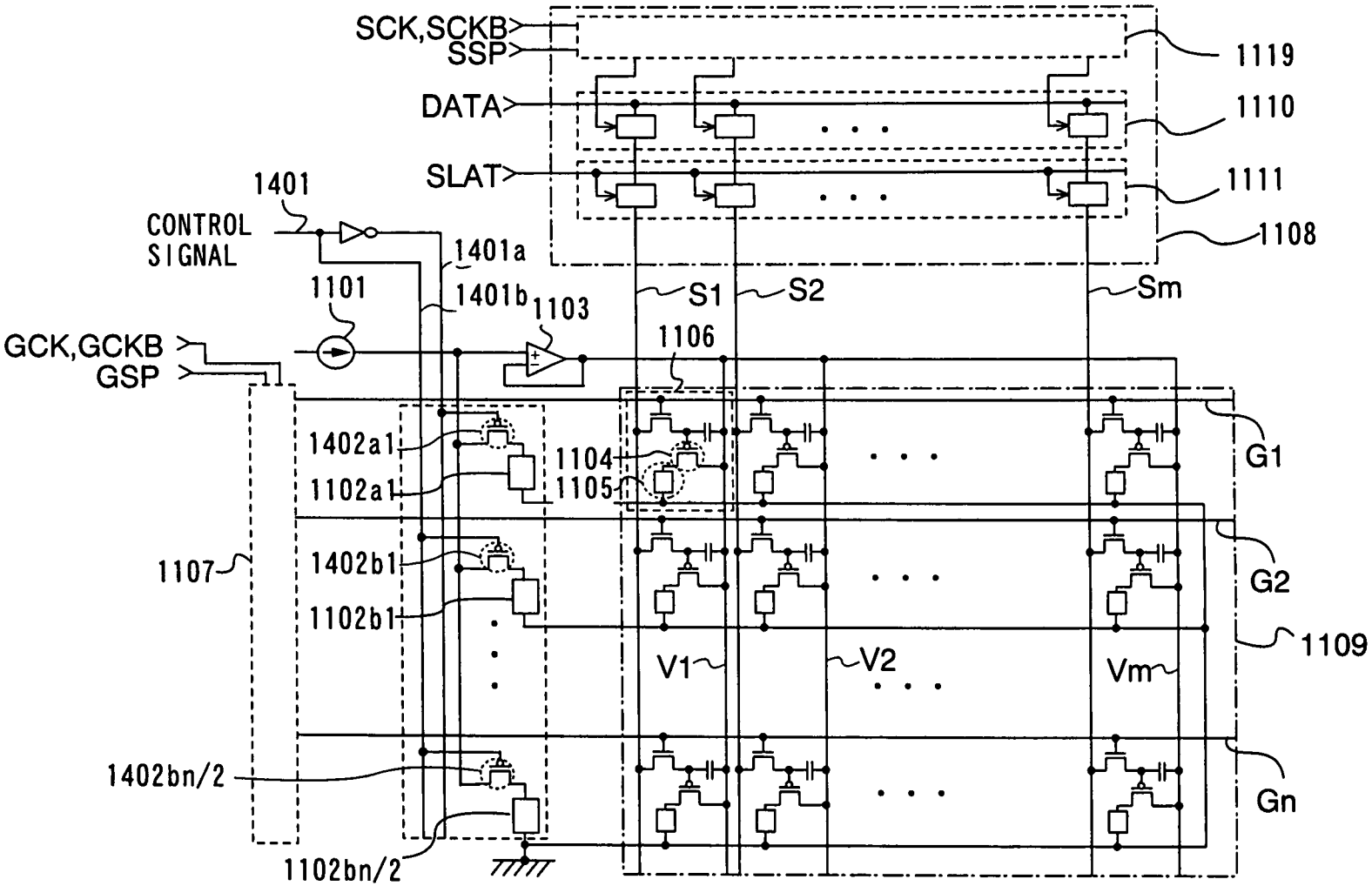
FIG. 14 is a diagram illustrating the display device of the invention.

Note that a similar function can be achieved when using transistors having the same conductivity type as well as shown in FIG. 10. A control signal is directly inputted to a control input terminal of the switching transistor 1001 while the control signal is inputted to the switching transistor 1002 via an inverter. Then, the control signal is inverted to be inputted to the switching transistor 1002, thus one of the switching transistors can be selected. Note that FIG. 10 illustrates an example where the P-channel transistors 1001 and 1002 are used, however, a similar function can be achieved when using only N-channel transistors as well. FIG. 14 illustrates a specific configuration example where the aforementioned configuration is applied to a display device. The transistor 1001 in FIG. 10 corresponds to a transistor 1402*b* in FIG. 14 while the transistor 1002 in FIG. 10 corresponds to a transistor 1402*a* in FIG. 14. A control signal is inputted from a control line 1401 to a gate terminal of the transistor 1402*b*. On the other hand, the control signal is inverted to alternately turn ON the transistors 1402*b* and 1402*a*.

Note that the number of the monitoring elements selected is not limited to two, and if a plurality of monitoring elements are disposed, degradation speed can be further delayed. Thus, by disposing three monitoring elements and sequentially selecting the monitoring elements to flow current, degradation speed of light emitting elements can be made closer to that of the monitoring elements.

Figure 15:
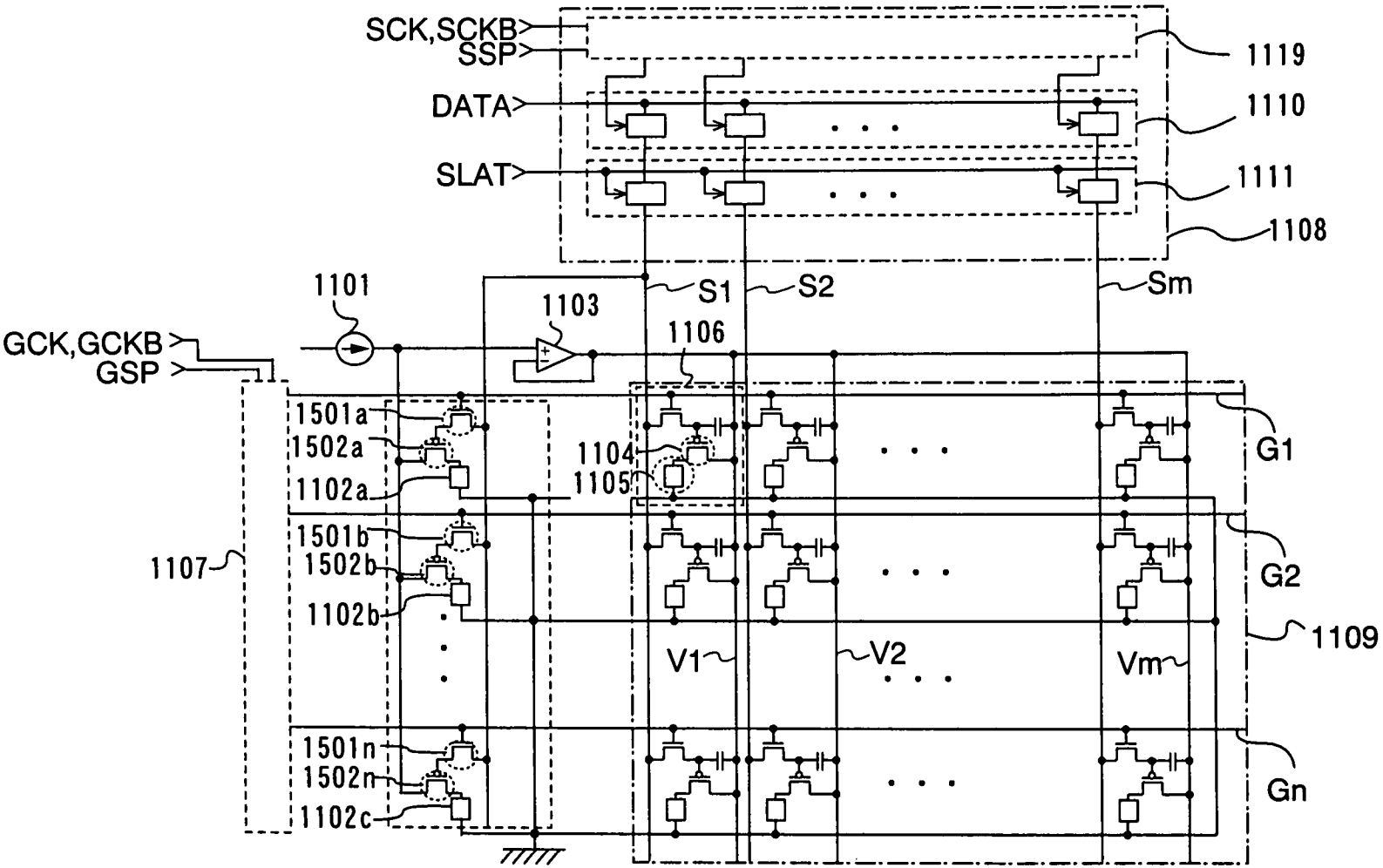
FIG. 15 is a diagram illustrating the display device of the invention.

FIG. 15 illustrates a configuration where degradation correction is further improved. In order to make the degradation speed of the light emitting element in the pixel 1106 closer to the degradation speed of the monitoring elements, a source signal line for supplying signals to one column of the pixel portion 1109 is connected to source terminals of transistors 1501*a* to 1501*n*, thereby ON/OFF of the transistors 1502*a* to 1502*n* is set. Accordingly, ratio of the emission/non-emission periods of each light emitting element and each monitoring element in a certain column can be made equal. Note that in the configuration in FIG. 15, a signal line S1 is connected to the switching transistors 1501*a* to 1501*n* for transmitting signals to the transistors for setting ON/OFF of the monitoring elements.

Embodiment Mode 3

Figure 16:
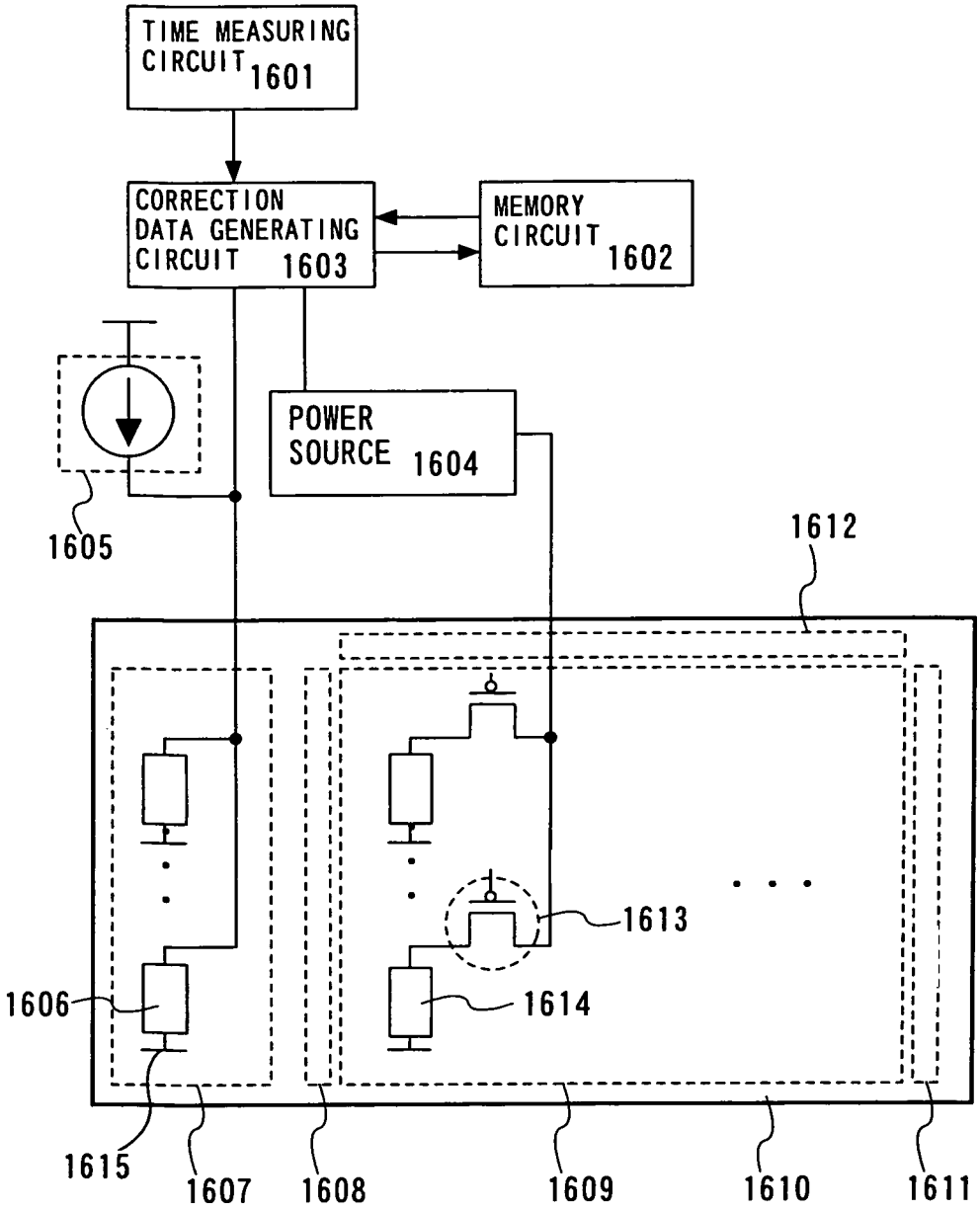
FIG. 16 is a diagram illustrating the display device of the invention.

A display device of this embodiment shown in FIG. 16 comprises a light emitting element 1614 and a monitoring element 1606. The light emitting element 1614 and the monitoring element 1606 are provided over the same substrate 1610. That is, they are manufactured through the identical manufacturing steps under the identical manufacturing conditions, and have the identical characteristics with respect to the change in ambient temperature and the degradation with time. The display device of the invention comprises a time-measuring circuit 1601, a memory circuit 1602, a correction data generating circuit 1603, a power source circuit 1604 and a constant current source 1605. These circuits may be provided over the same substrate 1610 with the light emitting element 1614 and the monitoring element 1606, or provided over another substrate.

A pixel region 1609 provided over the substrate 1610 comprises a plurality of pixels arranged in matrix, each of which includes the light emitting element 1614 and at least two transistors (only a driving transistor 1613 is shown in FIG. 16). Emission/non-emission and luminance of the light emitting element 1614 are controlled by drivers provided over the substrate 1610 (a first gate driver 1608, a second gate driver 1611 and a source driver 1612 are shown as examples here).

The monitoring element 1606 is provided in a single or a plurality of numbers over the substrate 1610. A monitoring circuit 1607 including one or more monitoring elements 1606 may be provided either inside or outside the pixel region 1609. However, the monitoring circuit 1607 is desirably provided outside the pixel region 1609 so that an image display would not be adversely affected.

The monitoring element 1606 is supplied with a constant current from the constant current source 1605. When an ambient temperature changes or degradation is caused with time under such a condition, the resistance value of the monitoring element 1606 per se changes. Then, potential difference between two electrodes of the monitoring element 1606 changes since the current value of the monitoring element 1606 is constant at all times.

In the case of the aforementioned configuration, a potential of a counter electrode 1615 as one of the two electrodes of the monitoring element 1606 changes while a potential of the other electrode of the monitoring element 1606 that is connected to the constant current source 1605 (called a first electrode here) changes. The changed potential of the first electrode of the monitoring element 1606 is outputted to a buffer amplifier.

The time-measuring circuit 1601 has a function to measure time during which power is supplied from the power source circuit 1604 to the panel including the light emitting element 1614, or a function to measure an emission period of the light emitting element 1614 by sampling a video signal supplied to each pixel in the pixel region 1609. In the case of the latter function, the pixel region 1609 has a plurality of the light emitting elements 1614, each of which has a different emission period. Thus, it is desirable that the emission period of each light emitting element 1614 be calculated, and an average value thereof be adopted. Alternatively, it is also desirable that the emission period of several light emitting elements 1614 selected from the plurality of the light emitting element 1614 be calculated, and an average value thereof be adopted. The time-measuring circuit 1601 outputs to the correction data generating circuit 1603, a signal containing data on the time obtained through one of the aforementioned functions.

The memory circuit 1602 is a circuit for storing changes with time of the V-I characteristics of the light emitting element 1614. That is, the memory circuit 1602 stores the V-I characteristics of the light emitting element 1614 at each point along the passage of time, preferably for 10,000 to 100,000 hours. The memory circuit 1602 outputs, based on the signal supplied from the correction data generating circuit 1603, data on the V-I characteristics of the light emitting element 1614 corresponding to the passage of time at that point, to the correction data generating circuit 1603.

The correction data generating circuit 1603 calculates an optimal voltage condition for operating the light emitting element 1614 based on the output of the monitoring element 1606 and the output of the memory circuit 1602. That is, an optimal voltage condition for obtaining a desired luminance is calculated. Then, a signal containing the data is outputted to the power source circuit 1604.

The power source circuit 1604 supplies to the light emitting element 1614 a power source potential corrected based on the signal supplied from the correction data generating circuit 1603.

Note that in the case of displaying a color image using a panel including the light emitting element 1614, EL layers each having a different emission spectrum are desirably provided in each pixel. Typically, EL layers corresponding to each color of red (R), green (G) and blue (B) are provided. In this case, the monitoring elements 1606 are desirably provided correspondingly to each color of red, green and blue in order to individually correct a power source potential for each color.

An acceleration test of EL degradation is carried out to calculate an acceleration factor. Then, data obtained by estimating degradation characteristics for a long period is desirably stored in the memory circuit 1602.

According to the invention having the aforementioned configuration, an effect of current fluctuation of a light emitting element, which is caused by the change in ambient temperature and degradation with time, can be suppressed by setting the optimal voltage condition of the light emitting element by using the monitoring element. In addition, since the invention does not require user's control, longer life of a product can be ensured by continuously performing correction even after the product is distributed to an end user.

Embodiment Mode 4

In this embodiment mode, description is made on a method for correcting degradation with time of a light emitting element in a pixel in the period when no image is displayed by using the display device shown in Embodiment Modes 1 to 3.

The degradation speed with time of a light emitting element is fast at the initial stage, and it becomes slower with time. Thus, in a display device using light emitting elements, an initial aging process, which causes initial degradation with time of the whole light emitting elements, is desirably carried out before adjusting luminance of the light emitting elements (before shipment, for example). By carrying out such an initial aging process to cause a drastic initial degradation with time of the light emitting elements in advance, it can be prevented afterwards that degradation of the light emitting elements progresses rapidly. Therefore, a phenomenon such as a screen burn caused by the degradation with time of the light emitting elements can be reduced.

Note that the initial aging process is carried out by controlling light emitting elements to emit light only for a certain period. This is preferably carried out by applying a voltage higher than usual. Accordingly, an initial degradation with time can be generated in a short period.

When the display device of the invention is operated by using a charging type battery, it is desirable to carry out, when the display device is not being used but being charged, a lighting/flashing process of the whole pixels, an image display process by which contrast of a normal image (standby image, for example) is inverted, a lighting/flashing process of the pixels that are lighted with less frequency, which are detected by sampling a video signal, and the like. The aforementioned processes that are carried out when the display device is not being used in order to decrease screen burns is called a flashout process. When such a flashout process is carried out, a difference between the brightest portion of a burned image and the darkest portion can be set to have less than 5 gray scales, and more preferably 1 or less gray scale even if a screen burn is caused after the process. Further, in order to reduce screen burns, a process by which an image is prevented from being fixed for a long period is preferably carried out in addition to the aforementioned processes.

Embodiment 1

Figure 17A:
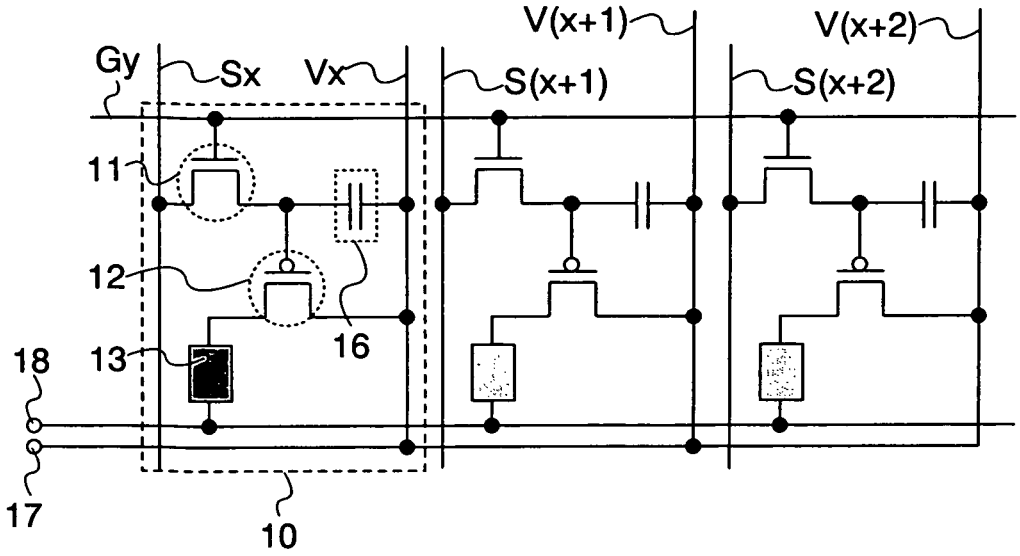
FIGS. 17A and 17B are diagrams illustrating pixels included in the display device of the invention.
Figure 17B:
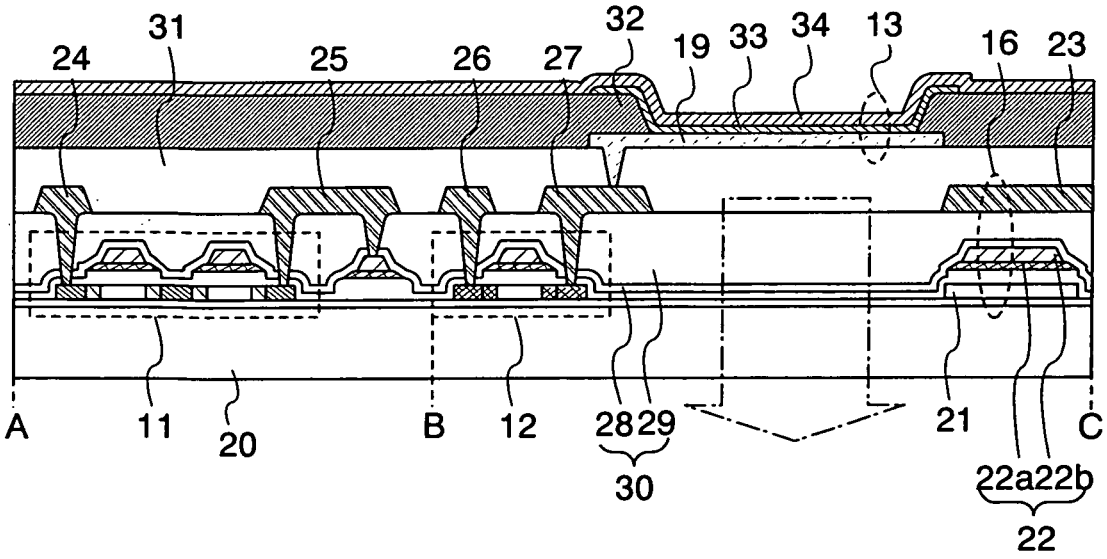
Figure 18:
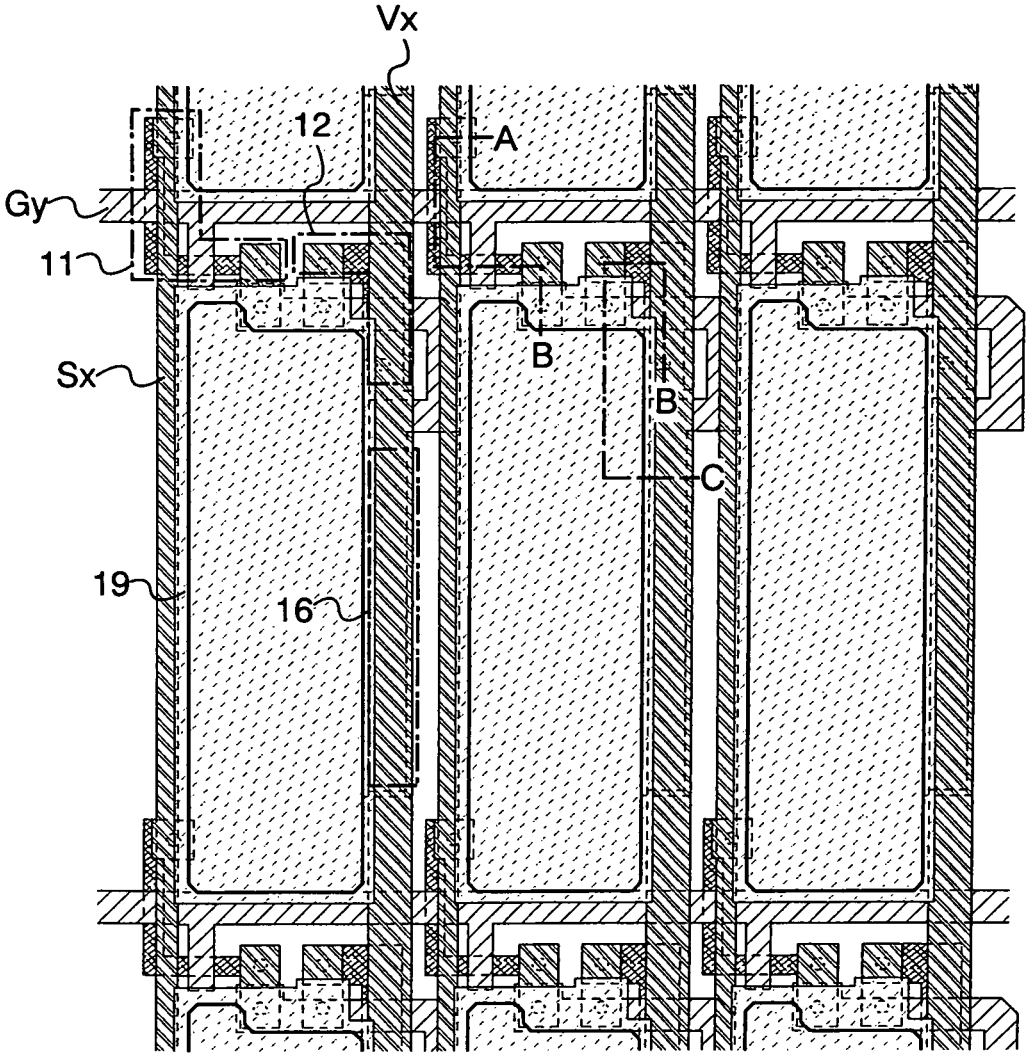
FIG. 18 is a diagram illustrating a mask layout of pixels included in the display device of the invention.
Figure 19:
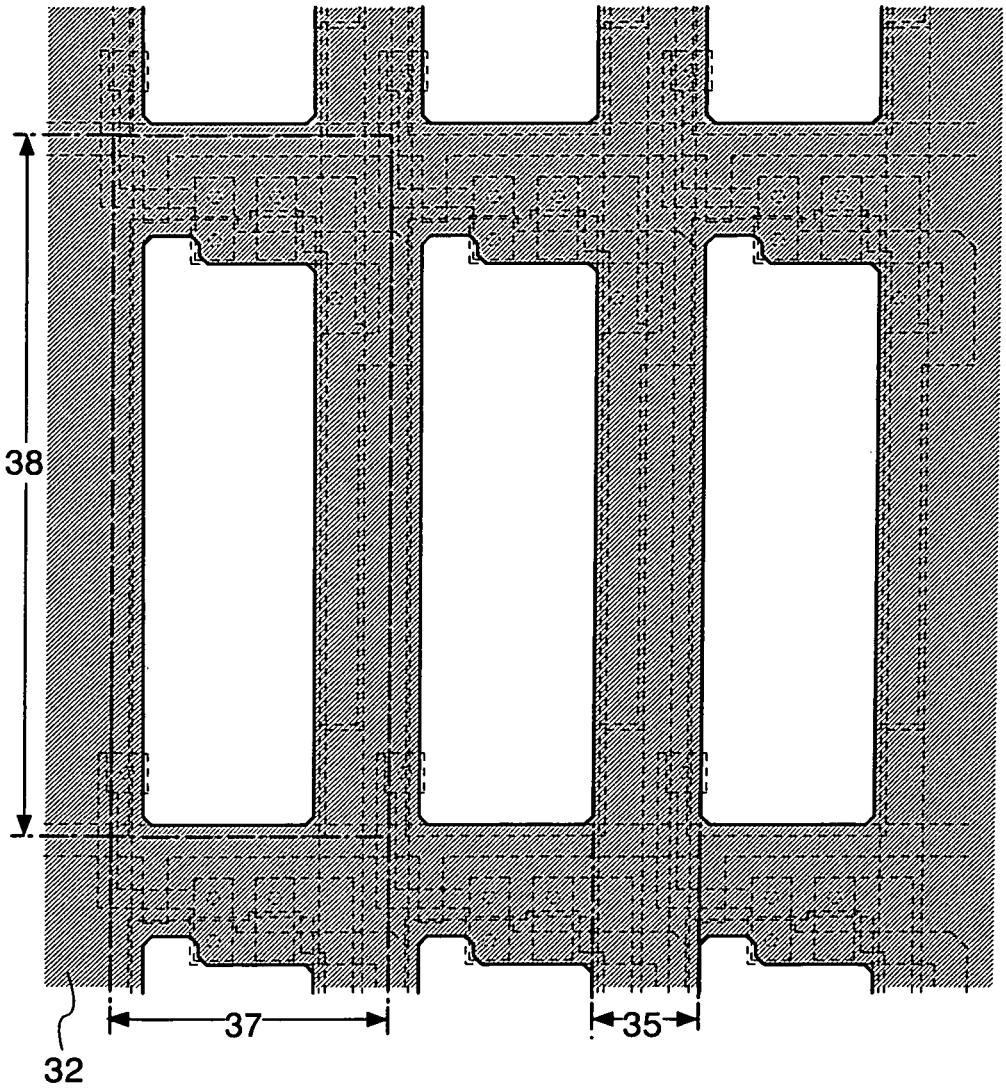
FIG. 19 is a diagram illustrating a mask layout of pixels included in the display device of the invention.

Description is made now with reference to FIGS. 17 to 19 on the structure of a display device that involves low power consumption. The display device of the invention comprises a plurality of pixels 10 each including a plurality of elements in the region where a source line Sx (x is a natural number, 1=x=m) overlaps a gate line Gy (y is a natural number, 1=y=n) with an insulator sandwiched therebetween (see FIG. 17A). The pixel 10 includes a light emitting element 13, a capacitor 16, and two transistors. One of the two transistors is a switching transistor 11 (hereinafter referred to as a TFT 11) for controlling a video signal input to the pixel 10, and the other is a driving transistor 12 (hereinafter referred to as a TFT 12) for controlling emission/non-emission of the light emitting element 13. Each of the TFTs 11 and 12 is a field effect transistor, which includes three terminals of a gate electrode, a source electrode and a drain electrode.

A gate electrode of the TFT 11 is connected to the gate line Gy, one of a source electrode and a drain electrode thereof is connected to the source line Sx, and the other is connected to a gate electrode of the TFT 12. One of a source electrode and a drain electrode of the TFT 12 is connected to a first power source 17 via a power source line Vx (x is a natural number, 1=x=m) and the other is connected to a pixel electrode of the light emitting element 13. A counter electrode of the light emitting element 13 is connected to a second power source 18. The capacitor 16 is connected between the gate electrode and the source electrode of the TFT 12. The conductivity type of the TFTs 11 and 12 is not specifically limited, and either an N-channel or P-channel transistor may be employed. In the shown configuration, the TFT 11 is an N-channel transistor while the TFT 12 is a P-channel transistor. Potentials of the first power source 17 and the second power source 18 are not specifically limited either, and they are set to have different levels from each other so that a forward bias voltage or a reverse bias voltage is applied to the light emitting element 13.

The display device of the invention having the aforementioned configuration comprises two transistors in each pixel 10. According to such a configuration, the number of the transistors disposed in each pixel 10 can be decreased, thereby the number of the wirings disposed can be inevitably decreased. Thus, a high aperture ratio, high resolution and high yield can be achieved. When the high aperture ratio is achieved, luminance of the light emitting elements can be decreased in accordance with an increase in light emitting areas. That is, current density can be decreased. Thus, a driving voltage can be decreased, which leads to lower power consumption. In addition, decrease in driving voltage leads to higher reliability.

A semiconductor for forming the TFTs 11 and 12 may be any of an amorphous semiconductor (amorphous silicon), a microcrystalline semiconductor, a polycrystalline semiconductor (polysilicon), and an organic semiconductor. The microcrystalline semiconductor may be formed by using a silane gas ($SiH_4$) and a fluorine gas ($F_2$) or using a silane gas and a hydrogen gas. Alternatively, it may be obtained by forming a thin film using the aforementioned gas and subsequently irradiating it with laser light. Each gate electrode of the TFTs 11 and 12 is formed in single or multiple layers utilizing a conductive material. For example, a stacked-layer structure of tungsten nitride (WN) and tungsten (W) in this order, a stacked-layer structure of molybdenum (Mo), aluminum (Al) and Mo in this order, or a stacked-layer structure of molybdenum nitride (MoN) and Mo in this order may be employed.

A conductive layer (source/drain wiring) connected to impurity regions (source electrode and drain electrode) included in the TFTs 11 and 12 is formed in single or multiple layers utilizing a conductive material. For example, a stacked-layer structure of titanium (Ti), aluminum-silicon (Al—Si) and titanium (Ti) in this order, a stacked-layer structure of molybdenum (Mo), aluminum-silicon (Al—Si) and molybdenum (Mo) in this order, or a stacked-layer structure of molybdenum nitride (MoN), aluminum-silicon (Al—Si) and molybdenum nitride (MoN) in this order may be employed.

FIG. 18 illustrates a layout of the pixels 10 having the aforementioned configuration. Shown in this layout are the TFTs 11 and 12, the capacitor 16 and a conductive layer 19 that corresponds to the pixel electrode of the light emitting element 13. FIG. 17B illustrates a cross-sectional structure of the layout in FIG. 18 along a line A-B-C. The TFTs 11 and 12, the light emitting element 13 and the capacitor 16 are formed over a substrate 20 having an insulating surface such as glass and quartz.

The light emitting element 13 corresponds to stacked layers of the conductive layer 19 (pixel electrode), an electroluminescent layer 33 and a conductive layer 34 (counter electrode). When both of the conductive layers 19 and 34 transmit light, the light emitting element 13 emits light in both directions of the conductive layer 19 and the conductive layer 34. That is, the light emitting element 13 emits light to both sides. On the other hand, when one of the conductive layers 19 and 34 transmits light while the other shields light, the light emitting element 13 emits light only in the direction of the conductive layer 19 or the conductive layer 34. That is, the light emitting element 13 emits light to the top side or the bottom side. FIG. 17B illustrates a cross-sectional structure in the case where the light emitting element 13 emits light to the bottom side.

The capacitor 16 is disposed between the gate electrode and the source electrode of the TFT 12 and stores a gate-source voltage of the TFT 12. The capacitor 16 forms a capacitance with a semiconductor layer 21 provided in the same layer as the semiconductor layers included in the TFTs 11 and 12, conductive layers 22*a* and 22*b* (hereinafter collectively referred to as a conductive layer 22) provided in the same layer as the gate electrodes of the TFTs 11 and 12, and an insulating layer provided between the semiconductor layer 21 and the conductive layer 22.

Also, the capacitor 16 forms a capacitance with the conductive layer 22 provided in the same layer as the gate electrodes of the TFTs 11 and 12, a conductive layer 23 provided in the same layer as conductive layers 24 to 27 that are connected to the source electrode or the drain electrode of the TFTs 11 and 12, and an insulating layer provided between the conductive layer 22 and the conductive layer 23.

According to such a structure, the capacitor 16 can have a capacitance value large enough to store the gate-source voltage of the TFT 12. In addition, the capacitor 16 is provided below the conductive layer constituting a power source line, therefore, the layout of the capacitor 16 does not cause a decrease in the aperture ratio.

The conductive layers 23 to 27 each corresponding to the source/drain wiring of the TFTs 11 and 12 are 500 to 2000 nm thick, or more preferably 500 to 1300 nm thick. The conductive layers 23 to 27 constitute the source line Sx and the power source line Vx. Therefore, by forming the conductive layers 23 to 27 thick as set forth above, an effect of a voltage drop can be suppressed. Note that when the conductive layers 23 to 27 are formed thick, wiring resistance can be made small. However, when the conductive layers 23 to 27 are formed extremely thick, it becomes difficult to perform a patterning process accurately or the surface will have more irregularity. That is, the thickness of the conductive layers 23 to 27 is desirably controlled within the aforementioned range in consideration of the patterning process to be performed easily and irregularity of the surface.

In addition, insulating layers 28 and 29 (hereinafter collectively referred to as a first insulating layer 30) covering the TFTs 11 and 12, a second insulating layer 31 provided over the first insulating layer 30, and the conductive layer 19 corresponding to the pixel electrode that is formed on the second insulating layer 31 are provided. Provided that the second insulating layer 31 is not formed, the conductive layers 23 to 29 each corresponding to the source/drain wiring are formed in the same layer as the conductive layer 19. Then, the region where the conductive layer 19 is formed is limited to the region where the conductive layers 23 to 29 are not formed. However, the provision of the second insulating layer 31 increases a margin of the region where the conductive layer 19 is formed, which achieves a high aperture ratio. Such a structure is quite effective when adopting a top emission structure. When the high aperture ratio is achieved, a driving voltage can be decreased in accordance with the increase in light emitting areas, which contributes to reduction in power consumption.

Note that each of the first insulating layer 30 and the second insulating layer 31 are formed by using an inorganic material such as silicon oxide and silicon nitride, an organic material such as polyimide and acrylic and the like. The first insulating layer 30 and the second insulating layer 31 may be formed by using either the same materials or different materials. As for the insulating layer, a siloxane material or a material including siloxane may be employed. Siloxane comprises a skeleton formed by the bond of silicon (Si) and oxygen (O), which includes as a substituent an organic group containing at least hydrogen (such as an alkyl group and aromatic hydrocarbon). Alternatively, a fluoro group may be used as the substituent. Further alternatively, a fluoro group and an organic group containing at least hydrogen may be used as the substitutent.

Between the adjacent pixels 10, a partition layer 32 (also referred to as a bank) is provided (see FIG. 19). A width 35 of the partition layer 32 on the capacitor 16 may be wide enough to cover the wirings provided on the bottom portion. Specifically, the width 35 is 7.5 to 27.5 μm, or more preferably 10 to 25 μm. In this manner, by forming the partition layer 32 narrow, a high aperture ratio can be achieved. When the high aperture ratio is achieved, a driving voltage can be decreased in accordance with the increase in light emitting areas, which contributes to reduction in power consumption.

Note that in the shown layout, an aperture ratio of the pixel is approximately 50%. In FIG. 19, the length of the pixel 10 in the column direction (longitudinal direction) is shown by a width 38 while the length of the pixel 10 in the row direction (lateral direction) is shown by a width 37. The partition layer 32 may be formed by using either an inorganic material or an organic material. However, as the electroluminescent layer is provided so as to be in contact with the partition layer 32, the partition layer 32 is desirably formed to have a continuously variable curvature radius so as not to produce pin holes in the electroluminescent layer.

In addition, the partition layer 32 shields light. According to such a structure, borders of the adjacent pixels 10 become clearer, thereby a high resolution image can be displayed. Since the partition layer 32 is colored, it shields light.

Figure 20:
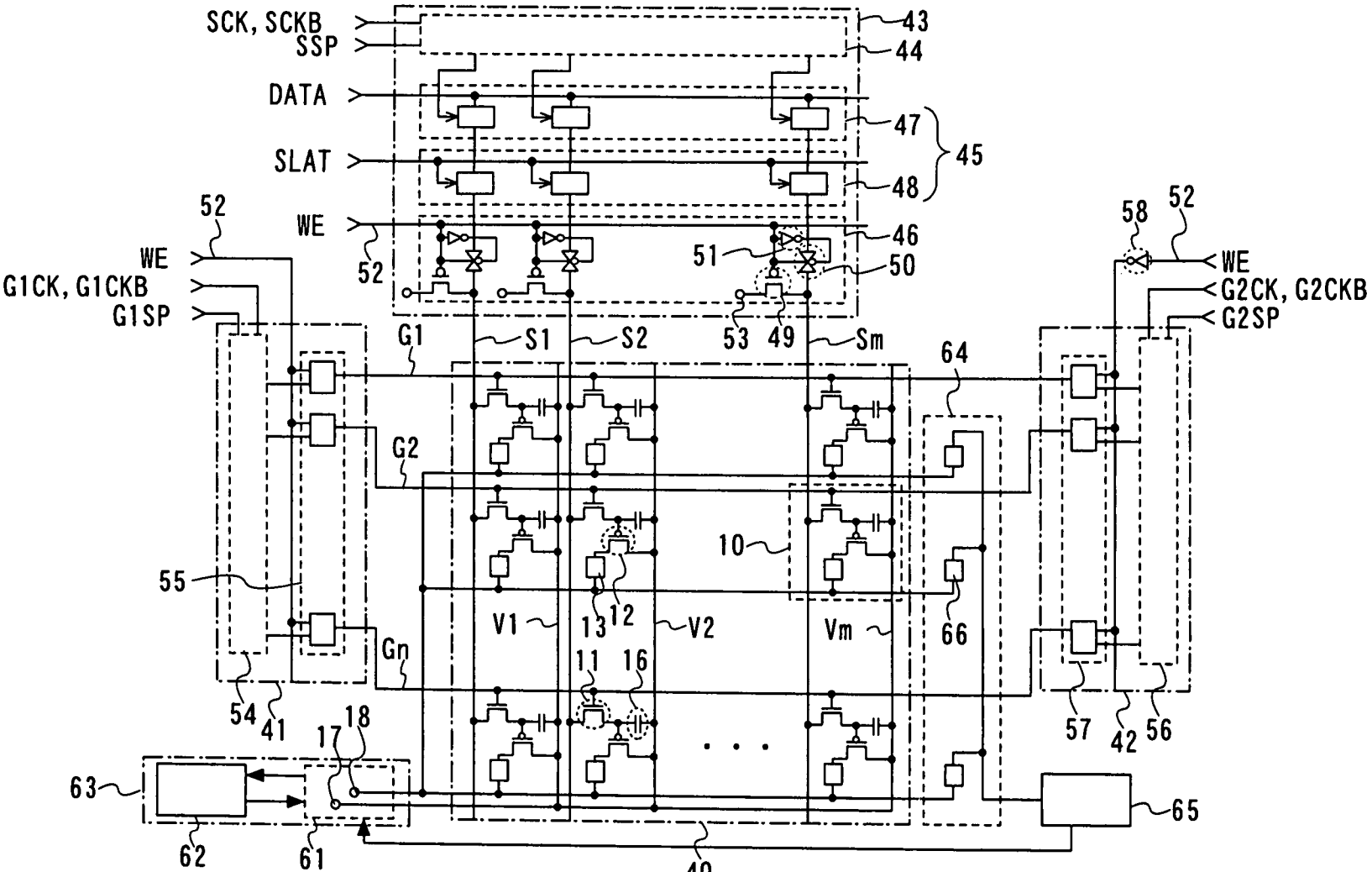
FIG. 20 is a diagram illustrating a configuration of the display device of the invention.

The display device of the invention comprises a pixel region 40 where a plurality of the aforementioned pixels 10 are arranged in matrix, a first gate driver 41, a second gate driver 42 and a source driver 43 (see FIG. 20). The first gate driver 41 and the second gate driver 42 are disposed on opposite sides of the pixel region 40 or one side of the pixel region 40.

The source driver 43 includes a pulse output circuit 44, a latch 45 and a selection circuit 46. The latch 45 includes a first latch 47 and a second latch 48. The selection circuit 46 includes a transistor 49 (hereinafter referred to as a TFT 49) and an analog switch 50. The TFT 49 and the analog switch 50 are disposed in each column correspondingly to the source line Sx. The inverter 51 generates a signal obtained by inverting a WE (Write/Erase) signal, and it is not necessarily provided when the WE signal is supplied externally.

A gate electrode of the TFT 49 is connected to a selection signal line 52, and one of a source electrode and a drain electrode thereof is connected to the source line Sx while the other is connected to a power source 53. The analog switch 50 is provided between the second latch 48 and the source line Sx. That is, an input node of the analog switch 50 is connected to the second latch 48 and an output node thereof is connected to the source line Sx. One of the two control nodes of the analog switch 50 is connected to the selection signal line 52 while the other is connected to the selection signal line 52 via the inverter 51. A potential of the power source 53 has a level to turn OFF the TFT 12 included in the pixel 10, and it is an L level when the TFT 12 is an N-channel TFT while it is an H level when the TFT 12 s a P-channel TFT.

The first gate driver 41 includes a pulse output circuit 54 and a selection circuit 55. The second gate driver 42 includes a pulse output circuit 56 and a selection circuit 57. The selection circuits 55 and 57 are connected to the selection signal line 52. Note that the selection circuit 57 included in the second gate driver 42 is connected to the selection signal line 52 via the inverter 58. That is, WE signals inputted to the selection circuits 55 and 57 via the selection signal line 52 are inverted from each other.

Each of the selection circuits 55 and 57 includes a tristate buffer. An input node of the tristate buffer is connected to the pulse output circuit 54 or the pulse output circuit 56 while a control node thereof is connected to the selection signal line 52. An output node of the tristate buffer is connected to the gate line Gy. The tristate buffer operates when a signal transmitted from the selection signal line 52 has an H level while it is in the floating state when a signal transmitted from the selection signal line 52 has an L level.

The pulse output circuit 44 included in the source driver 43, the pulse output circuit 54 included in the first gate driver 41 and the pulse output circuit 56 included in the second gate driver 42 correspond to a shift register having a plurality of flip-flop circuits, or a decoder circuit. When adopting a decoder circuit for each of the pulse output circuits 44, 54 and 56, the source line Sx or the gate line Gy can be selected at random. When the source line Sx or the gate line Gy can be selected at random, pseudo contours that occur when adopting a time gray scale method can be suppressed.

Note that the configuration of the source driver 43 is not limited to the aforementioned, and a level shifter and a buffer may be provided additionally. Note also that the configurations of the first gate driver 41 and the second gate driver 42 are not limited to the aforementioned, and a level shifter and a buffer may be provided additionally. Further, though not shown, each of the source driver 43, the first gate driver 41 and the second gate driver 42 includes a protection circuit. The configuration of the driver including a protection circuit is described in Embodiment Mode 2 below.

In addition, the display device of the invention includes a power source control circuit 63. The power source control circuit 63 includes a power source circuit 61 for supplying power to the light emitting element 13, and a controller 62. The power source circuit 61 is connected to the pixel electrode of the light emitting element 13 via the TFT 12 and the power source line Vx. Also, the power source circuit 61 is connected to the counter electrode of the light emitting element 13 via the power source line.

When a forward bias voltage is applied to the light emitting element so as to supply a current to the light emitting element 13 to emit light, the first power source 17 and the second power source 18 are set to have a potential difference so that the potential of the first power source 17 is higher than the potential of the second power source 18. On the other hand, when a reverse bias voltage is applied to the light emitting element 13, the first power source 17 and the second power source 18 are set to have a potential difference so that the potential of the first power source 17 is lower than the potential of the second power source 18. Such potential setting is performed by supplying a predetermined signal from the controller 62 to the power source circuit 61.

According to the invention, a reverse bias voltage is applied to the light emitting element 13 using the power source control circuit 63, thereby degradation of the light emitting element 13 with the time can be suppressed to improve the reliability. The light emitting element 13 may have an initial defect that the anode and the cathode thereof are short-circuited due to adhesion of foreign substances, pinholes that are produced by minute projections of the anode or the cathode, or irregularity of the electroluminescent layer. Such an initial defect will disturb emission/non-emission in accordance with signals, and a problem will arise where a favorable image display cannot be performed because the whole elements do not emit light with almost all currents flown to the short-circuit portion, or only specific pixels emit light or no light. However, according to the structure of the invention, a reverse bias can be applied to the light emitting element, thereby a current can locally flow only to the short-circuit portion of the anode and the cathode so as to generate heat in the short-circuit portion. As a result, the short-circuit portion can be insulated by oxidizing or carbonizing. Thus, favorable image display can be performed even when an initial defect occurs by eliminating the defect. Note that insulation of such an initial defect is preferably carried out before shipment. Further, not only an initial defect, but another defect might occur where the anode and the cathode are short-circuited with time. Such a defect is called a progressive defect. However, according to the invention, a reverse bias can be applied to the light emitting element at regular intervals, therefore, such possible progressive defect can be eliminated and favorable image display can be performed. Note that the timing at which a reverse bias voltage is applied to the light emitting element 13 is not specifically limited.

The display device of the invention also includes a monitoring circuit 64 and a control circuit 65. The monitoring circuit 64 operates in accordance with the ambient temperature. The control circuit 65 includes a constant current source and a buffer. In the shown configuration, the monitoring circuit 64 includes a monitoring light emitting element 66 (hereinafter referred to as a light emitting element 66).

The control circuit 65 supplies a signal for changing a power source potential to the power source control circuit 63 based on the output of the monitoring circuit 64. The power source control circuit 63 changes a power source potential to be supplied to the pixel region 40 based on the signal supplied from the control circuit 65. According to the invention having the aforementioned configuration, fluctuation of current values caused by a change in ambient temperature can be suppressed to improve the reliability.

According to the display device of the invention using a constant voltage drive, luminance of the light emitting elements is 500 cd/m$^2$, and power consumption is 1 W or less (950 mW) with the pixel aperture ratio of 50%. On the other hand, according to a display device with a constant current drive, luminance of the light emitting elements is 500 cd/m$^2$, and power consumption is 2 W (2040 mW) with the pixel aperture ratio of 25%. That is, by adopting a constant voltage drive, power consumption can be reduced. Specifically, by adopting a constant voltage drive, power consumption can be suppressed to 1 W or less, or more preferably to 0.7 W or less.

Note that the aforementioned values of the power consumption are only of the pixel region, and do not include the power consumption of the driver circuit portions. In addition, both exhibit a display duty ratio of 70% with the time gray scale method adopted.

Note that as set forth above, transistors of the invention may be of any types, and may be formed over any substrate. Therefore, the whole circuit as shown in FIG. 20 may be formed over any kind of substrate such as a glass substrate, a plastic substrate, a single crystalline substrate and an SOI substrate. Alternatively, a part of the circuit in FIG. 20 may be formed over a certain substrate while another part thereof may be formed over another substrate. That is, not the whole circuit in FIG. 20 is required to be formed over the same substrate. For example, such structure may be employed in FIG. 20 that the pixel region 40 and the first gate driver 41 are formed over a glass substrate by using TFTs while the source driver 43 (or a part of it) is formed over a single crystalline substrate, thereby the IC chip is connected onto the glass substrate by COG (Chip On Glass) bonding. Alternatively, the IC chip may be connected to the glass substrate by TAB (Tape Auto Bonding) or by using a printed board.

Figure 21:
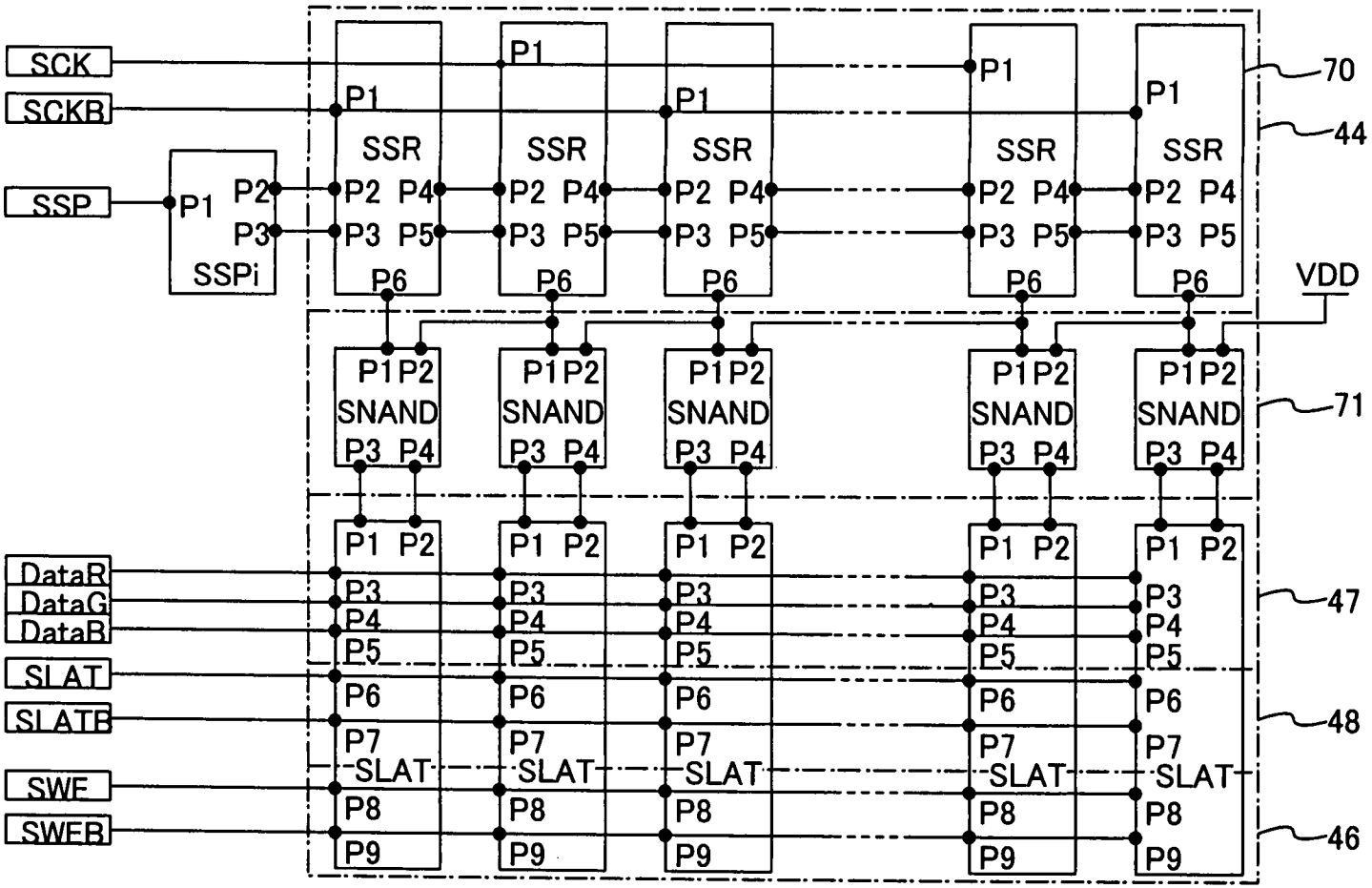
FIG. 21 is a diagram illustrating a configuration of a source driver included in the display device of the invention.
Figure 22:
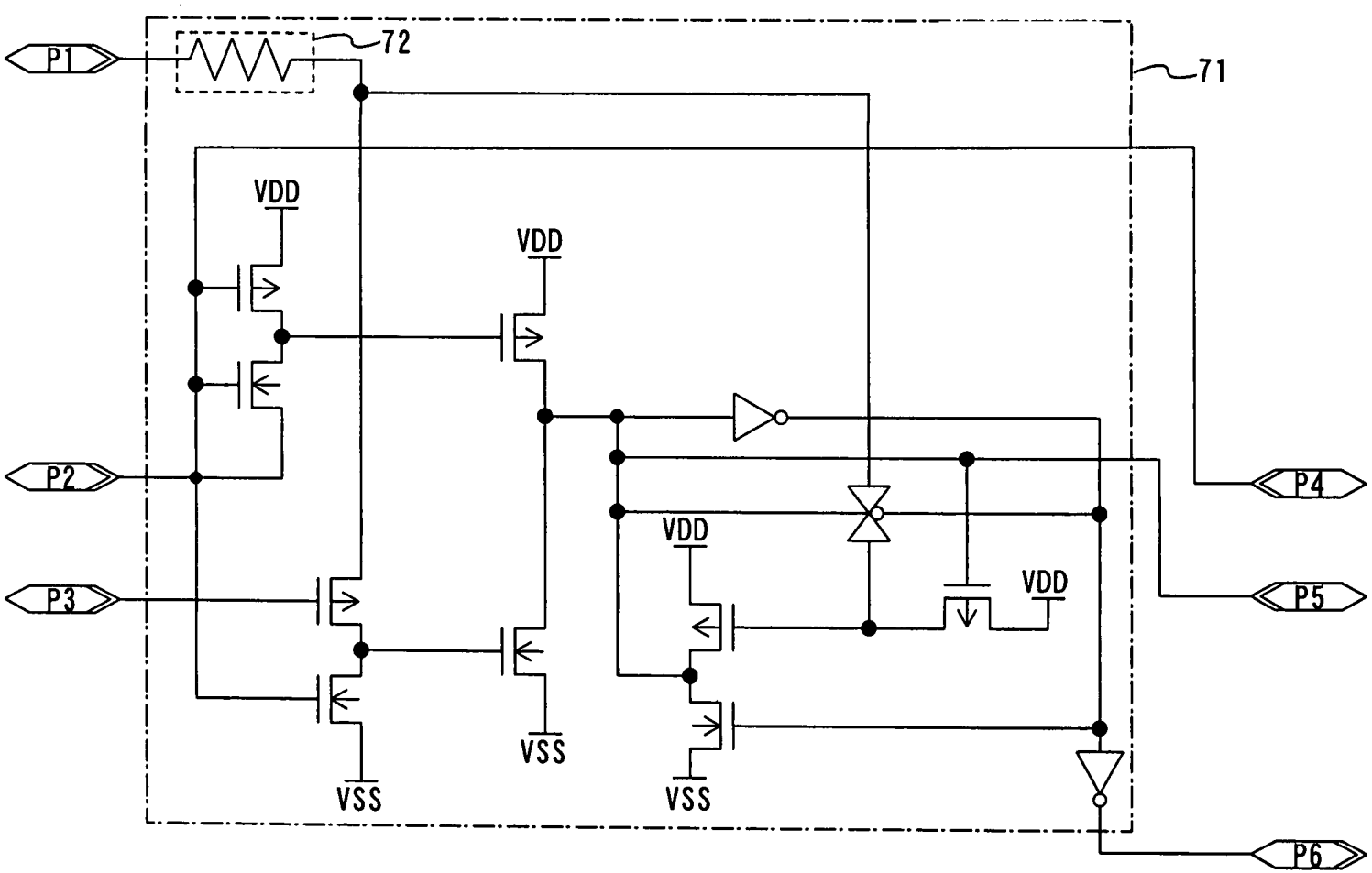
FIG. 22 is a diagram illustrating a configuration of a source driver included in the display device of the invention.
Figure 23:
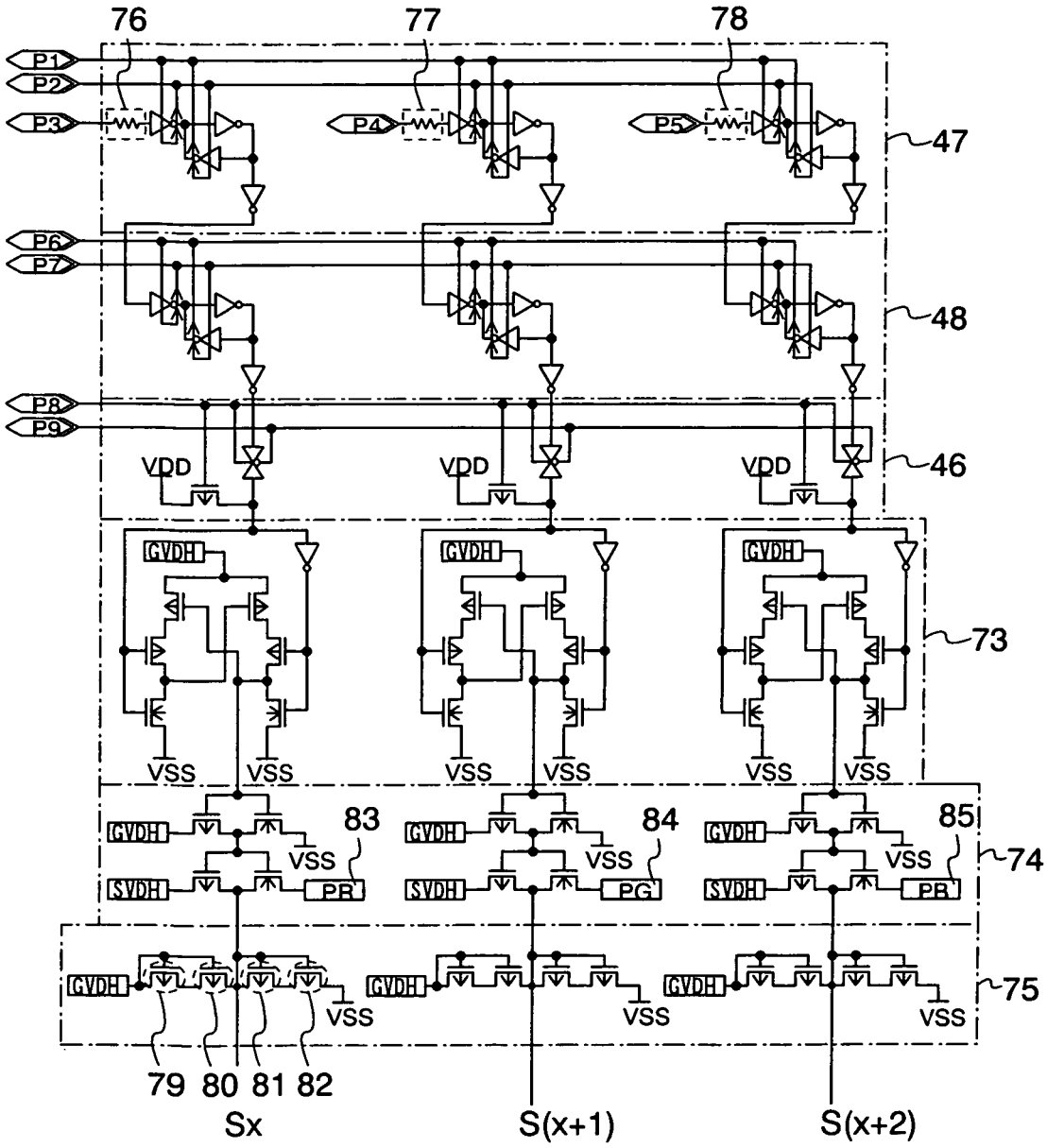
FIG. 23 is a diagram illustrating a configuration of a source driver included in the display device of the invention.

Description is made now with reference to FIGS. 21 to 23 on the configuration of the source driver 43 included in the display device of the invention. The source driver 43 includes the pulse output circuit 44, a NAND 71, the first latch 47, the second latch 48 and the selection circuit 46 (the first latch 47, the second latch 48 and the selection circuit 46 are collectively referred to as an SLAT in the drawing) (see FIG. 21). The pulse output circuit 44 has a configuration in which a plurality of unit circuits (SSR) 70 are connected in cascade. The pulse output circuit 44 is supplied with a clock signal (SCK), a clock back signal (SCKB) and a start pulse (SSP). The first latch 47 is supplied with data signals (DataR, DataG and DataB). The second latch 48 is supplied with a latch pulse (SLAT), and a pulse obtained by inverting the latch pulse (SLATB). The selection circuit 46 is supplied with a writing/erasing signal (SWE or Write/Erase signal, hereinafter also referred to as a WE signal), and a signal obtained by inverting the WE signal (SWEB).

The unit circuit 70 included in the pulse output circuit 44 includes a plurality of transistors and logic circuits (see FIG. 22). An input node of the unit circuit 70, to which a clock signal or a clock back signal are supplied, is provided with a resistor 72 as a protection circuit. Also, input nodes of the first latch 47, to which data signals are inputted, are provided with resistors 76 to 78 as protection circuits respectively (see FIG. 23). Further, though not shown in FIG. 21, the lower stage of the selection circuit 46 is provided with a level shifter 73 and a buffer 74, and the lower stage of the buffer 74 is provided with a protection circuit 75. The protection circuit 75 includes four transistors 79 to 82 per source line. Note that power source potentials 83 to 85 supplied to the buffer 74 are set according to the color to be emitted in a pixel that is connected to the source line Sx.

The source driver 43 includes a first protection circuit (corresponds to the resistor 72 in the drawing) connected to the input node of the pulse output circuit 44, a second protection circuit (corresponds to the resistors 76 to 78 in the drawing) connected to the input nodes of the first latch 47, and a third protection circuit (corresponds to the transistors 79 to 82 in the drawing) provided on the lower stage of the selection circuit 46. According to such a configuration, degradation or breakdown of elements caused by static electricity can be suppressed.

Figure 24:
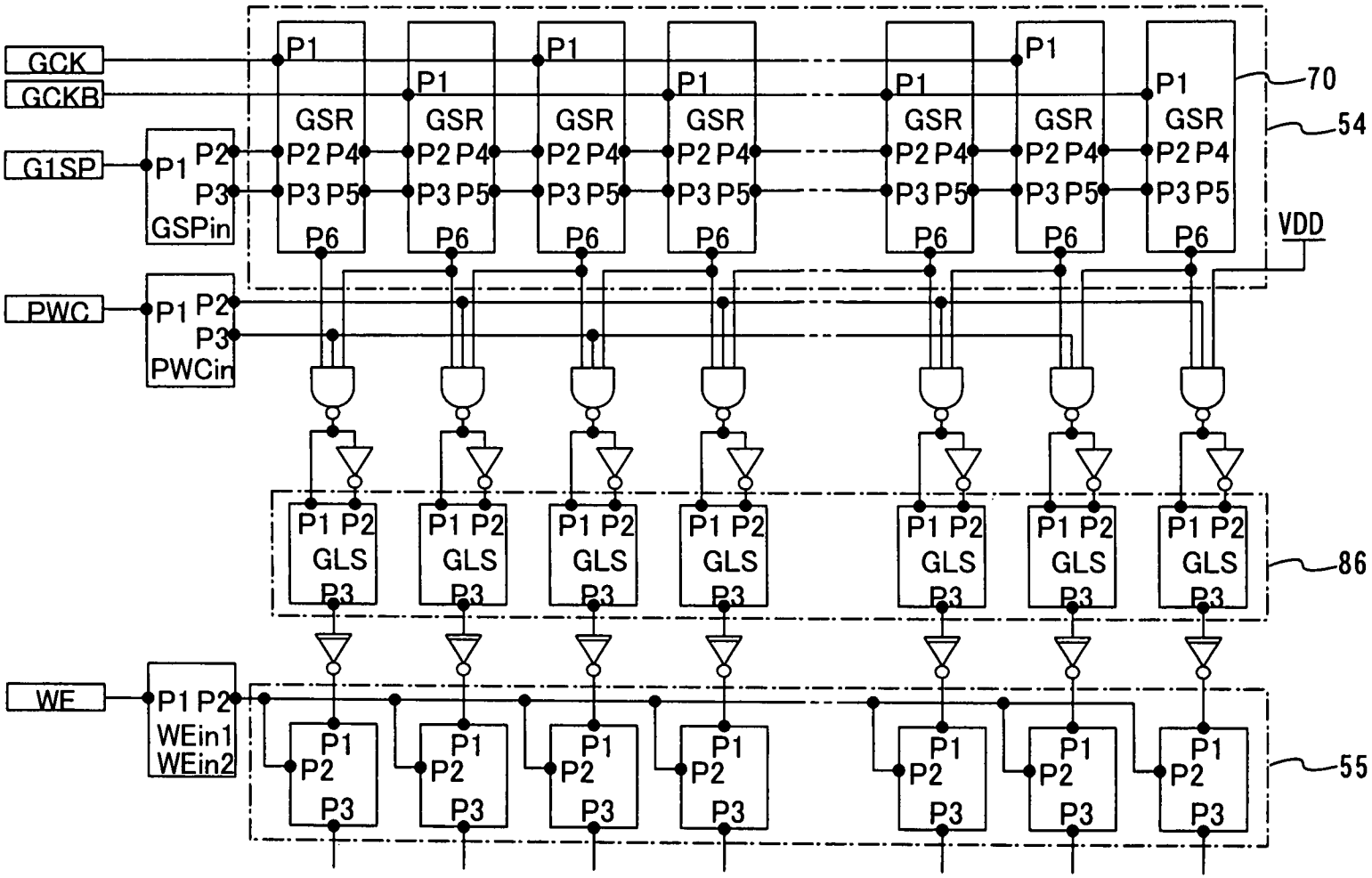
FIG. 24 is a diagram illustrating a configuration of a gate driver included in the display device of the invention.
Figure 25:
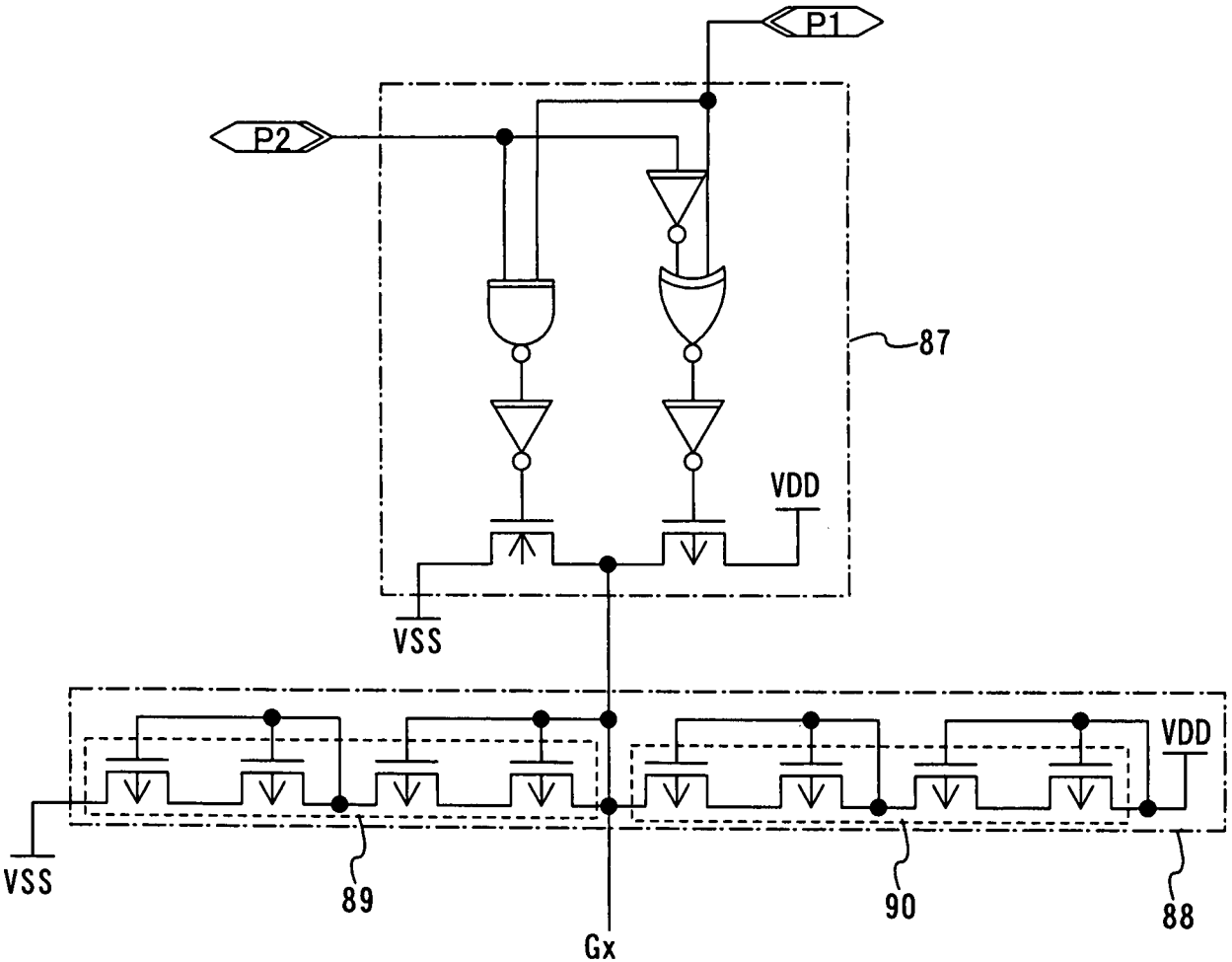
FIG. 25 is a diagram illustrating a configuration of a gate driver included in the display device of the invention.

Description is made now with reference to FIGS. 24 and 25 on the configuration of the first gate driver 41. The second gate driver 42 has a similar configuration to the first gate driver 41, therefore, the description thereof is omitted herein. The first gate driver 41 includes the pulse output circuit 54, a level shifter (GLS) 86 and the selection circuit 55 (see FIG. 24). The configuration of the pulse output circuit 54 is similar to that of the pulse output circuit 44 included in the source driver 43, and it has a configuration where a plurality of the unit circuits (GSR) 70 are connected in cascade, and the input node thereof is provided with a protection circuit.

The selection circuit 55 includes a tristate buffer 87 and a protection circuit 88 (see FIG. 25). The tristate buffer 87 functions to prevent that when one of the first gate driver 41 and the second gate driver 42 charges or discharges the gate line Gy, the operation is disturbed by the output of the other driver. Accordingly, the selection circuit 55 may be an analog switch, a clocked inverter and the like in addition to the tristate buffer as long as the aforementioned function is provided. The protection circuit 88 includes element groups 89 and 90.

The first gate driver 41 includes the first protection circuit connected to the input node of the pulse output circuit 54 and the second protection circuit 88 provided on the lower stage of the selection circuit 55. According to such a configuration, degradation or breakdown of elements caused by static electricity can be suppressed. More specifically, there is a possibility that a clock signal or a data signal inputted to the input node has noise, which instantaneously applies a high voltage or a low voltage to elements. However, according to the invention having a protection circuit, malfunction, degradation or breakdown of elements can be suppressed.

Note that the protection circuit is constructed by using not only a resistor and a transistor, but one or more elements selected from a resistor, a capacitor and a rectifier. The rectifier is a transistor whose gate electrode and drain electrode are connected to each other, or a diode.

Description is made briefly on the operation of the protection circuit. Here, description is made on the operation of the protection circuit 88 included in the first gate driver 41.

First, a signal having a higher voltage than VDD is supplied from the output node of the tristate buffer 87 due to an effect of noise and the like. Then, the element group 89 is turned OFF while the element group 90 is turned ON because of the relationship of their gate-source voltages. Then, a charge stored in the tristate buffer 87 is released to the power source line for transmitting VDD, thereby a potential of the gate line Gx becomes VDD or VDD+a.

On the other hand, if a signal having a voltage lower than VSS is supplied from the output node of the tristate buffer 87, the element group 89 is turned ON while the element group 90 is turned OFF because of the relationship of their gate-source voltages. Then, the potential of the gate line Gx becomes VSS or VSS−a.

In this manner, even when a voltage supplied from the output node of the tristate buffer 87 becomes higher than VDD or lower than VSS instantaneously due to noise and the like, the voltage supplied to the gate line Gx does not become higher than the VDD nor lower than VSS. Accordingly, malfunction, degradation or breakdown of elements caused by noise, static electricity and the like can be suppressed.

The display device of the invention includes a protection circuit 101 provided between a connecting film such as an FPC (Flexible Printed Circuit) and the first gate driver 41, the second gate driver 42 or the source driver 43. As for the source driver 43, signals such as SCK, SSP, DataR, DataG, DataB, SLAT and SWE are supplied externally via the connecting film, and the protection circuit is provided between a wiring for transmitting such signals and the connecting film. As for the first gate driver 41, signals such as GCK, G1SP, PWC and WE are supplied externally via the connecting film, and the protection circuit is provided between a wiring for transmitting such signals and the connecting film. This embodiment mode can be freely implemented in combination with the aforementioned embodiment modes.

Figure 26:
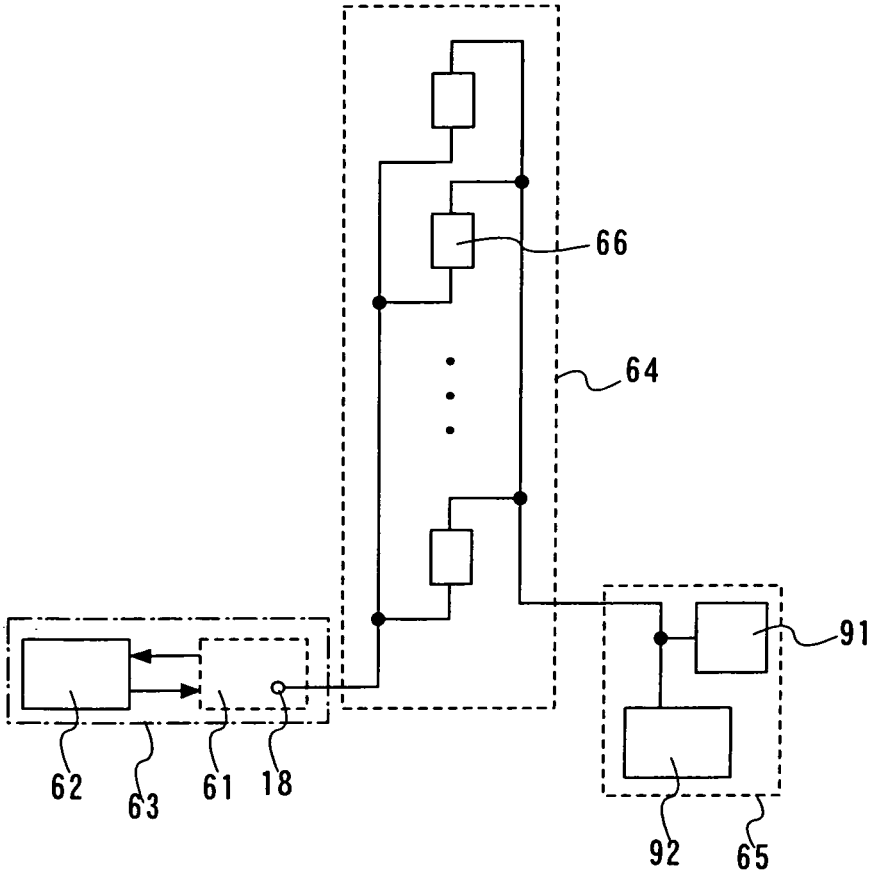
FIG. 26 is a diagram illustrating the temperature correction function of the invention.

A temperature correction function of the invention is implemented by using the monitoring circuit 64 that is operable in accordance with the ambient temperature, the control circuit 65 and the power source control circuit 63 (see FIG. 26). The monitoring circuit 64 includes the light emitting element 66 in the shown configuration. One of the electrodes of the light emitting element 66 is connected to a power source at a fixed potential (grounded in the shown configuration) while the other is connected to the control circuit 65. The control circuit 65 includes a constant current source 91 and an amplifier 92. The power source control circuit 63 includes the power source circuit 61 and the controller 62. Note that the power source circuit 61 is desirably a variable power source with which power source potentials to be supplied can be changed.

Description is made now on a mechanism for detecting a change in ambient temperature using the light emitting element 66. A constant current is supplied between the both electrodes of the light emitting element 66 from the constant current source 91. That is, the current value of the light emitting element 66 is constant at all times. When the ambient temperature changes under such conditions, a resistance value of the light emitting element 66 per se changes. When the resistance value of the light emitting element 66 changes, a potential difference is generated between the both electrodes of the light emitting element 66 since the current value of the light emitting element 66 is constant at all times. By detecting the potential difference between the both electrodes of the light emitting element 66, a change in the ambient temperature is detected. More specifically, the potential of an electrode of the light emitting element 66 at a fixed potential remains unchanged, therefore, a potential change of the opposite electrode that is connected to the constant current source 91 is detected. A signal containing data on such potential change of the light emitting element is supplied to the amplifier 92, thereby amplified by the amplifier 92 and outputted to the power source control circuit 63. The power source control circuit 63 changes a power source potential to be supplied to the pixel region 40 via the amplifier 92 based on the output of the monitoring circuit 64. Accordingly, the power source potential can be corrected in accordance with the change in temperature. That is, fluctuation of current values caused by a change in temperature can be suppressed.

Note that a plurality of the light emitting elements 66 are provided in the shown configuration, however, the invention is not limited to this. The number of the light emitting elements 66 provided in the monitoring circuit 64 is not specifically limited. In addition, even when the light emitting element 66 is employed, a transistor may be connected in series to the light emitting element 66. In such a case, the transistor connected in series to the light emitting element 66 is turned ON as required. Further, although the light emitting element 66 is employed as the monitoring circuit 64, the invention is not limited to this and other known temperature sensors may be used. In the case of using a known temperature sensor, it may be provided over the same substrate as the pixel region 40, or connected externally by use of an IC. The temperature correction function of the invention does not require user's control, therefore, it can perform correction continuously even after the display device is distributed to an end user. Thus, long life of a product can be ensured. This embodiment mode can be freely implemented in combination with the aforementioned embodiment modes.

Figure 27A:
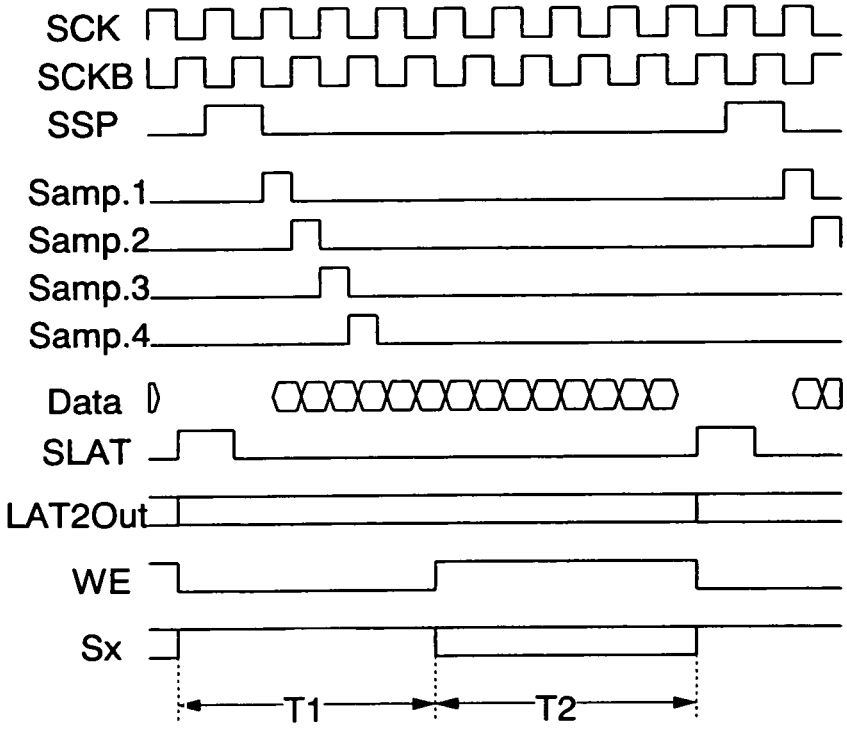
FIGS. 27A and 27B are diagrams illustrating operation of the display device of the invention.
Figure 27B:
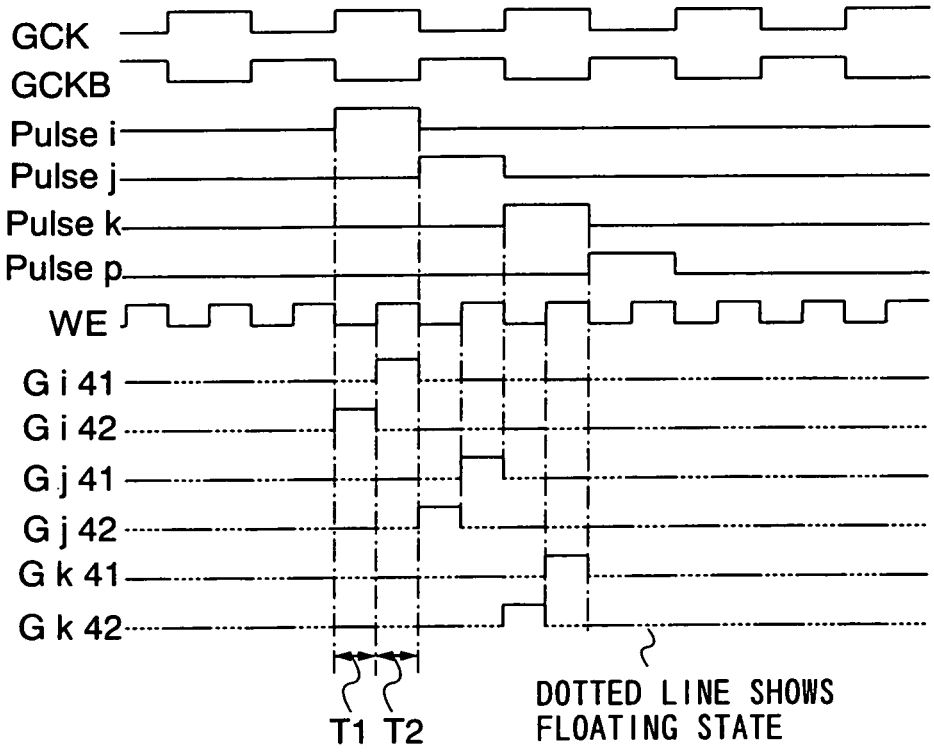

The operation of the display device of the invention is described with reference to FIGS. 20, 27A and 27B. First, the operation of the source driver is described (see FIGS. 20 and 27A). The pulse output circuit 44 is inputted with a clock signal (SCK), a clock inverted signal (SCKB) and a start pulse (SSP). In accordance with the timing of these signals, a sampling pulse is outputted to the first latch 47. The first latch 47 of the first to last columns, to which data are inputted, stores video signals in accordance with the timing at which the sampling pulse is inputted. Upon input of a latch pulse, the video signals stored in the first latch 47 are transferred to the second latch 48 all at once.

Now, description is made on the operation of the selection circuit 46 in each period, assuming that the period in which a WE signal at L level is transmitted from the selection signal line 52 is T1 while the period in which a WE signal at H level is transmitted from the selection signal line 52 is T2. The periods T1 and T2 each corresponds to a half period of the horizontal scan period, and the period T1 is referred to as a first sub-gate selection period while the period T2 is referred to as a second sub-gate selection period.

In the period T1 (first sub-gate selection period), a WE signal transmitted from the selection signal line 52 is at L level, and the TFT 49 is ON whereas the analog switch 50 is OFF. Then, the plurality of signal lines S1 to Sn are electrically connected to the power source 53 via the TFT 49 provided in each column. That is, the plurality of signal lines S1 to Sn have the same potentials as the power source 53. At this time, the TFT 11 included in the pixel 10 is ON, and a potential of the power source 53 is transmitted to the gate electrode of the TFT 12 via the TFT 11. Then, the TFT 12 is turned OFF, and the two electrodes of the light emitting element 13 have the same potentials. That is, no current flows between the two electrodes of the light emitting element 13, thus it does not emit light. In this manner, the operation where a potential of the power source 53 is transmitted to the gate electrode of the TFT 12 regardless of the video signal inputted to the signal line, which turns OFF the TFT 11 to bring the two electrodes of the light emitting element 13 to have the same potentials is called an erasing operation.

In the period T2 (second sub-gate selection period), the WE signal transmitted from the selection signal line 52 is at H level, and the TFT 49 is OFF whereas the analog switch 50 is ON. Then, the video signals of one row stored in the second latch 48 are transmitted to the plurality of signal lines S1 to Sn all at once. At this time, the TFT 11 included in the pixel 10 is ON, and the video signal is transmitted to the gate electrode of the TFT 12 via the TFT 11. Then, according to the video signal inputted, the TFT 12 is turned ON or OFF, thereby the two electrodes of the light emitting element 13 have different potentials or the same potentials. More specifically, when the TFT 12 is turned ON, the two electrodes of the light emitting element 13 have different potentials, thereby a current flows into the light emitting element 13. That is, the light emitting element 13 emits light. Note that a current flowing into the light emitting element 13 has the same value as the source-drain current of the TFT 12. On the other hand, when the TFT 12 is turned OFF, the two electrodes of the light emitting element 13 have the same potentials, thereby no current flows into the light emitting element 13. That is, the light emitting element 13 does not emit light. In this manner, the operation where the TFT 12 is turned ON or OFF according to a video signal, which causes the two electrodes of the light emitting elements 13 to have different potentials or the same potentials is called a writing operation.

Now, the operation of the first gate driver 41 and the second gate driver 42 is described. The pulse output circuit 54 is inputted with G1CK, G1CKB and G1SP. In accordance with the timing of these signals, pulses are sequentially outputted to the selection circuit 55. The pulse output circuit 56 is inputted with G2CK, G2CKB and G2SP. In accordance with the timing of these signals, pulses are sequentially outputted to the selection circuit 57. FIG. 27B illustrates a potential of a pulse that is supplied to each of the i, j, k and p-th rows (i, j, k and p are natural numbers, and 1=i, j, k, p=n is satisfied) of the selection circuits 55 and 57.

Now, similarly to the description on the operation of the source driver 43, description is made on the operation of the selection circuit 55 included in the first gate driver 41 and the selection circuit 57 included in the second gate driver 42 in each period, assuming that the period in which a WE signal at L level is transmitted from the selection signal line 52 is T1 while the period in which a WE signal at H level is transmitted from the selection signal line 52 is T2. Note that in the timing chart of FIG. 27B, a potential of the gate line Gy (y is a natural number, and 1=y=n is satisfied) that has received a signal from the first gate driver 41 is denoted by Gy41 while a potential of the gate line that has received a signal from the second gate driver 42 is denoted by Gy42. Needless to say, the Gy41 and Gy42 denote the same wiring.

In the period T1 (first sub-gate selection period), a WE signal transmitted from the selection signal line 52 is at L level. Then, the selection circuit 55 included in the first gate driver 41 is inputted with a WE signal at L level, thereby the selection circuit 55 is brought into a floating state. On the other hand, the selection circuit 57 included in the second driver 42 is inputted with an H-level signal that is obtained by inverting the WE signal, thereby the selection circuit 57 is brought into an operating state. That is, the selection circuit 57 transmits an H-level signal (row selection signal) to the gate line Gi in the i-th row, thereby the gate line Gi has the same potential as the H-level signal. That is, the gate line Gi in the i-th row is selected by the second gate driver 42. As a result, the TFT 11 included in the pixel 10 is turned ON. Then, the potential of the power source 53 included in the source driver 43 is transmitted to the gate electrode of the TFT 12, thereby the TFT 12 is turned OFF and the both electrodes of the light emitting element 13 have the same potentials. That is, an erasing operation is performed in this period where the light emitting element 13 does not emit light.

In the period T2 (second sub-gate selection period), a WE signal transmitted from the selection signal line 52 is at H level. Then, the selection circuit 55 included in the first gate driver 41 is inputted with a WE signal at H level, thereby the selection circuit 55 is brought into the operating state. That is, the selection circuit 55 transmits an H-level signal to the gate line Gi in the i-th row, thereby the gate line Gi has the same potential as the H-level signal. That is, the gate line Gi in the i-th row is selected by the first gate driver 41. As a result, the TFT 11 included in the pixel 10 is turned ON. Then, a video signal is transmitted from the second latch 48 included in the source driver 43 to the gate electrode of the TFT 12, thereby the TFT 12 is turned ON or OFF, and the two electrodes of the light emitting element 13 have different potentials or the same potentials. That is, in this period, writing operation is performed where the light emitting element 13 emits light or no light. On the other hand, the selection circuit 57 included in the second gate driver 42 is inputted with an L-level signal, thereby it is brought into the floating state.

In this manner, the gate line Gy is selected by the second gate driver 42 in the period T1 (first sub-gate selection period) while it is selected by the first gate driver 41 in the period T2 (second sub-gate selection period). That is, the gate line is controlled by the first gate driver 41 and the second gate driver 42 in a complementary manner. In addition, the erasing operation is performed in one of the first sub-gate selection period and the second sub-gate selection period while the writing operation is performed in the other period.

Note that in the period in which the gate line Gi in the i-th row is selected by the first gate driver 41, the second gate driver 42 is not in the operating state (the selection circuit 57 is in the floating state), or transmits a row selection signal to the gate line of the rows other than the i-th row. Similarly, in the period in which the gate line Gi in the i-th row receives a row selection signal from the second gate driver 42, the first gate driver 41 is in the floating state, or transmits a row selection signal to the gate line of the rows other than the i-th row.

According to the invention that performs the aforementioned operation, the light emitting element 13 can be forcibly turned OFF, therefore, the duty ratio can be improved even when the number of gray scales is increased. Further, there is no need to provide a TFT for releasing a charge of the capacitor 16 although the light emitting element 13 can be forcibly turned OFF. Thus, a high aperture ratio can be achieved. When a high aperture ratio is achieved, luminance of the light emitting elements can be decreased in accordance with the increase in light emitting areas, which contributes to reduction in power consumption. That is, a driving voltage can be decreased to reduce power consumption.

Note that the invention is not limited to the aforementioned mode where the gate selection period is divided in half. The gate selection period may be divided into three or more periods. This embodiment mode can be freely implemented in combination with the aforementioned embodiment mode.

Note also that an erasing signal is inputted to a pixel in the former half of the gate selection period (first sub-gate selection period) while a video signal is inputted to a pixel in the latter half of the gate selection period (second sub-gate selection period), however, the invention is not limited to this. It is also possible that a video signal is inputted to a pixel in the former half of the gate selection period (first sub-gate selection period) while an erasing signal is inputted to a pixel in the latter half of the gate selection period (second sub-gate selection period).

Alternatively, it is also possible that a video signal is inputted to a pixel in the former half of the gate selection period (first sub-gate selection period), and another video signal is inputted to a pixel in the latter half of the gate selection period (second sub-gate selection period). A signal corresponding to a different sub-frame may be inputted in each period. As a result, sub-frame periods can be provided without the need of an erasing period so that emission periods are arranged in succession. As there is no need to provide an erasing period in such a case, the duty ratio can be increased.

Description is made now on the operation of the display device of the invention with reference to timing charts (FIGS. 28A and 28C) whose ordinate denotes a scan line while abscissa denotes time, and timing charts (FIGS. 28B and 28D) of the gate line Gi (1=i=m) in the i-th row. In the time gray scale method, one frame period includes a plurality of sub-frame periods SF1, SF2, . . . , SFn (n is a natural number).

Each of the plurality of sub-frame periods includes one of a plurality of writing periods Ta1, Ta2, . . . , Tan in which the writing operation or the erasing operation is performed, and one of a plurality of light emitting elements Ts1, Ts2, . . . , Tsn. Each of the plurality of writing periods includes a plurality of gate selection periods. Each of the plurality of gate selection periods includes a plurality of sub-gate selection periods. The number into which each gate selection period is divided is not specifically limited, however, it is preferably 2 to 8, or more preferably 2 to 4. The length of the emission periods Ts1: Ts2: . . . :Tsn is set to satisfy, for example, $2^{(n-1)}$: $2^{(n-2)}$: . . . :$2^1$:$2^0$. That is, the emission periods Ts1, Ts2, . . . , Tsn are set to have different length for each bit.

Figure 28A:
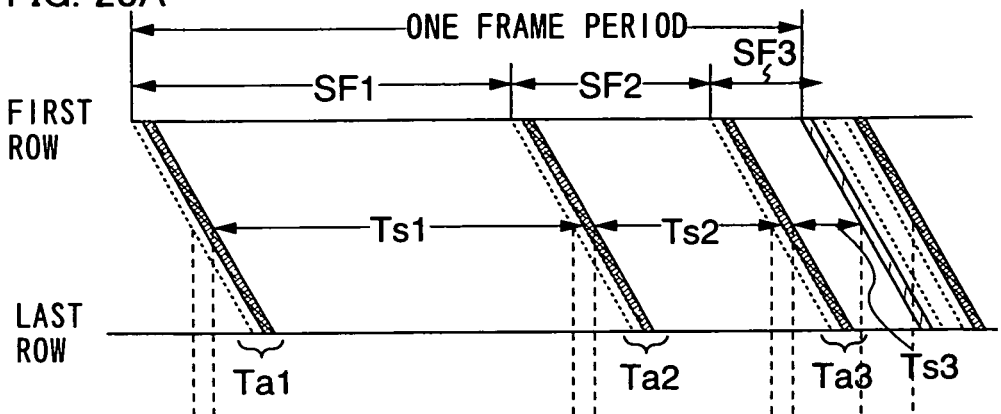
FIGS. 28A to 28D are diagrams illustrating a time gray scale method.
Figure 28B:
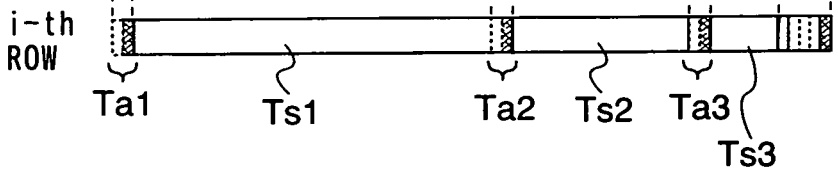

Description is made below on the timing chart for displaying 3-bit gray scales (8 gray scales) in the case of providing no AC drive period FRB (see FIGS. 28A and 28B). In this case, one frame period is divided into three sub-frame periods SF1 to SF3. Each of the sub-frame periods SF1 to SF3 includes one of the writing periods Ta1 to Ta3, and one of the emission periods Ts1 to Ts3. Each writing period includes a plurality of gate selection periods. Each of the plurality of gate selection periods includes a plurality of sub-gate selection periods. Here, each of the gate selection periods includes two sub-gate selection periods: the first sub-gate selection period for performing the erasing operation, and the second sub-gate selection period for performing the writing operation.

Note that the erasing operation is the operation for bringing the light emitting element to emit no light, and it is performed only when necessary in a sub-frame period.

Figure 28C:
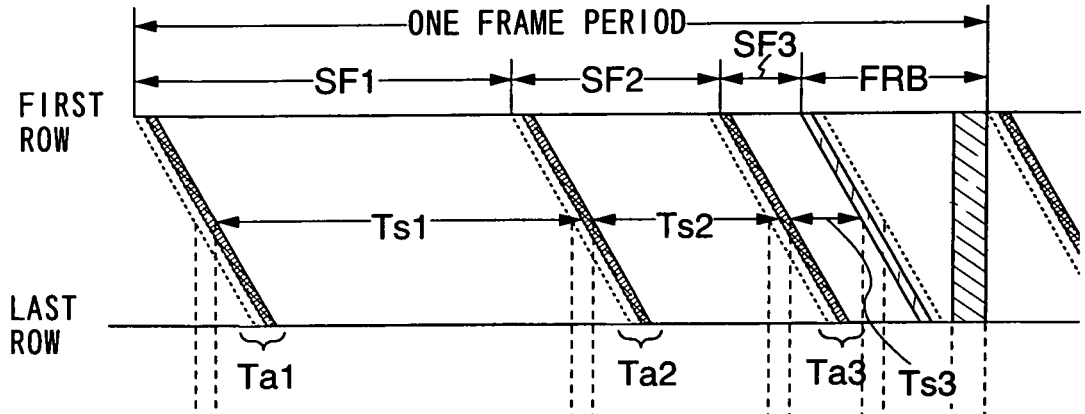
Figure 28D:
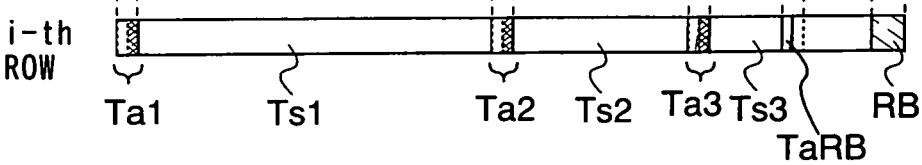

Description is made below on the timing chart in the case of providing an AC drive period RFB (see FIGS. 28C and 28D). The AC drive period FRB includes a writing period TaRB in which only an erasing operation is performed, and a reverse bias application period RB in which a reverse bias is applied to the whole light emitting elements simultaneously by reversing the potential levels supplied to the light emitting element.

Note that the AC drive period FRB is not necessarily provided per frame period, and it may be provided per several frame periods. In addition, the AC drive period FRB is not required to be provided separately from the sub-frame periods SF1 to SF3, and it may be provided in the emission periods Ts1 to Ts3 within a certain sub-frame period.

In addition, the order of the sub-frame periods is not limited to the aforementioned in which the sub-frame periods are arranged in order from the higher-order bit to the lower-order bit, and they may be arranged at random. Further, the order of the sub-frame periods may be random per frame period.

In addition, one or more periods selected from the sub-frame periods may be divided into a plurality of periods. In that case, each of the one or more divided sub-frame periods, and each of the one or more undivided sub-frame periods includes one of the plurality of writing periods Ta1, Ta2, . . . , Tam (m is a natural number), and one of the plurality of emission periods Ts1, Ts2, . . . , Tsm.

Embodiment 2

Figure 34:
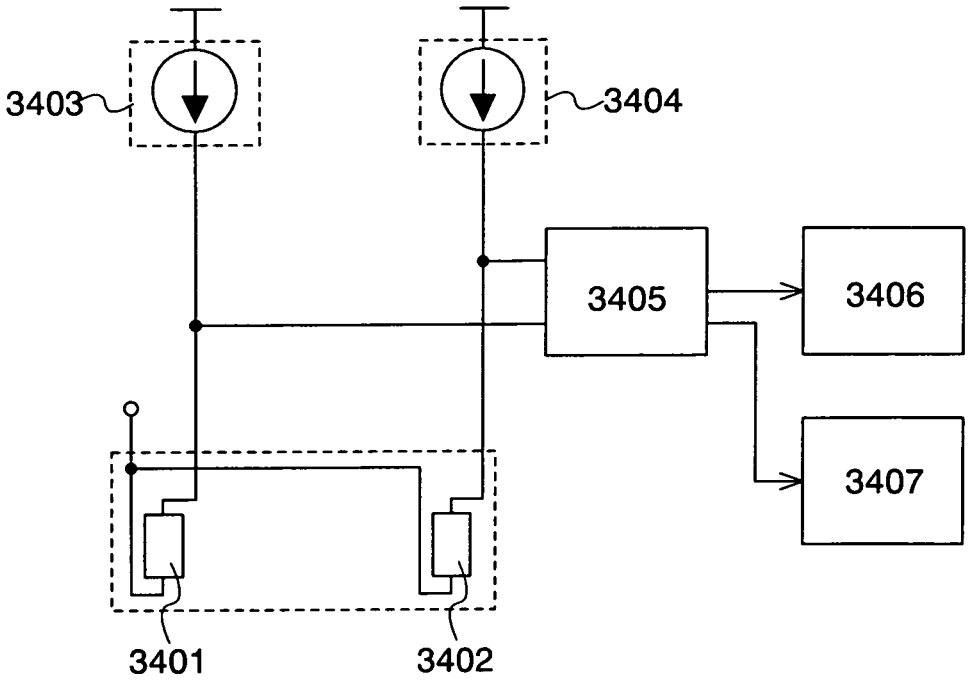
FIG. 34 is a diagram illustrating the display device of the invention.

The invention can also be applied to a display device using a constant current drive. In this embodiment, description is made with reference to FIG. 34 on the case where degradation with time of light emitting elements is corrected by detecting a degree of degradation with time of a plurality of monitoring elements, of which detection result is utilized for correction of a video signal or a power source potential.

In this embodiment, a plurality of (at least two) monitoring elements are used. Here, two monitoring elements 3401 and 3402 are used. One monitoring element 3401 is supplied with a constant current from a constant current source 3403 while the other monitoring element 3402 is supplied with a constant current from a constant current source 3404. By setting the current supplied from the constant current source 3403 and the constant current source 3404 to have different values, the total current supplied to each of the monitoring elements 3401 and 3402 have different values. Then, the monitoring elements 3401 and 3402 have a difference in degree of degradation with time.

The monitoring elements 3401 and 3402 are connected to an arithmetic circuit 3405, in which a difference (voltage value) between the output of the monitoring element 3401 and the output of the monitoring element 3402 is calculated.

The voltage value calculated in the arithmetic circuit 3405 is supplied to a video signal generation circuit 3406. The video signal generation circuit 3406 corrects a video signal supplied to each pixel based on the voltage value supplied from the arithmetic circuit 3405. According to such a configuration, degradation with time of the light emitting elements can be corrected.

In addition, in the case where a gate electrode of a transistor is connected to a power source line Vax at a fixed potential, and operating the transistor in the saturation region to control emission/non-emission of light emitting elements with a video signal, correction of the video signal is not necessary, but only a potential of the power source line Vax is required to be changed according to the voltage value supplied from the arithmetic circuit 3405. Note that the power source line Vax is connected to the power source circuit 3407. Thus, the power source circuit 3407 corrects the potential of the power source line Vax based on the voltage value supplied form the arithmetic circuit 3405.

The display device of this embodiment having the aforementioned configuration can perform correction in accordance with the degradation with time of light emitting elements.

Figure 35A:
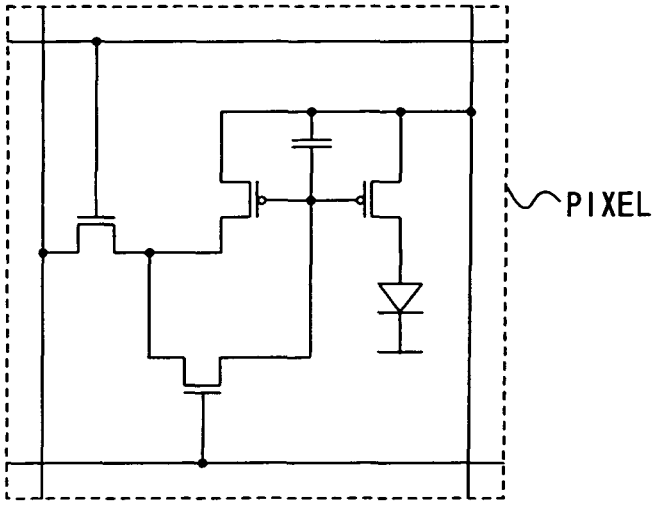
FIGS. 35A and 35B are diagrams each illustrating the display device of the invention.
Figure 35B:
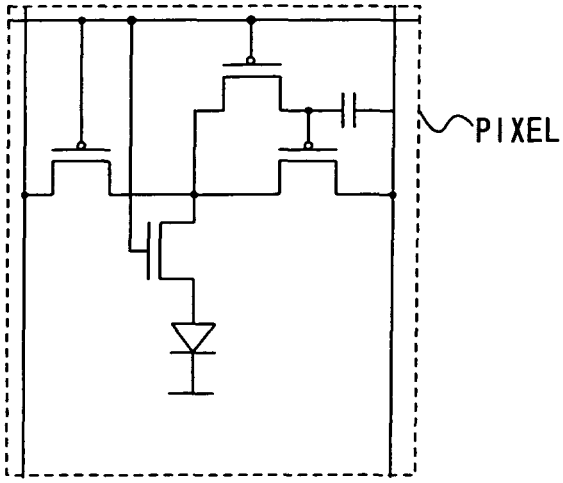

Note that a circuit for preventing fluctuation of potentials of a buffer amplifier and the like is preferably provided between the monitoring element 3401 and the arithmetic circuit 3405 and between the monitoring element 3402 and the arithmetic circuit 3405. Note also that a pixel having a configuration for a constant current drive includes, for example, a pixel using a current mirror circuit as shown in FIG. 35A, a pixel using other configurations as shown in FIG. 35B, and the like.

Embodiment 3

Figure 36:
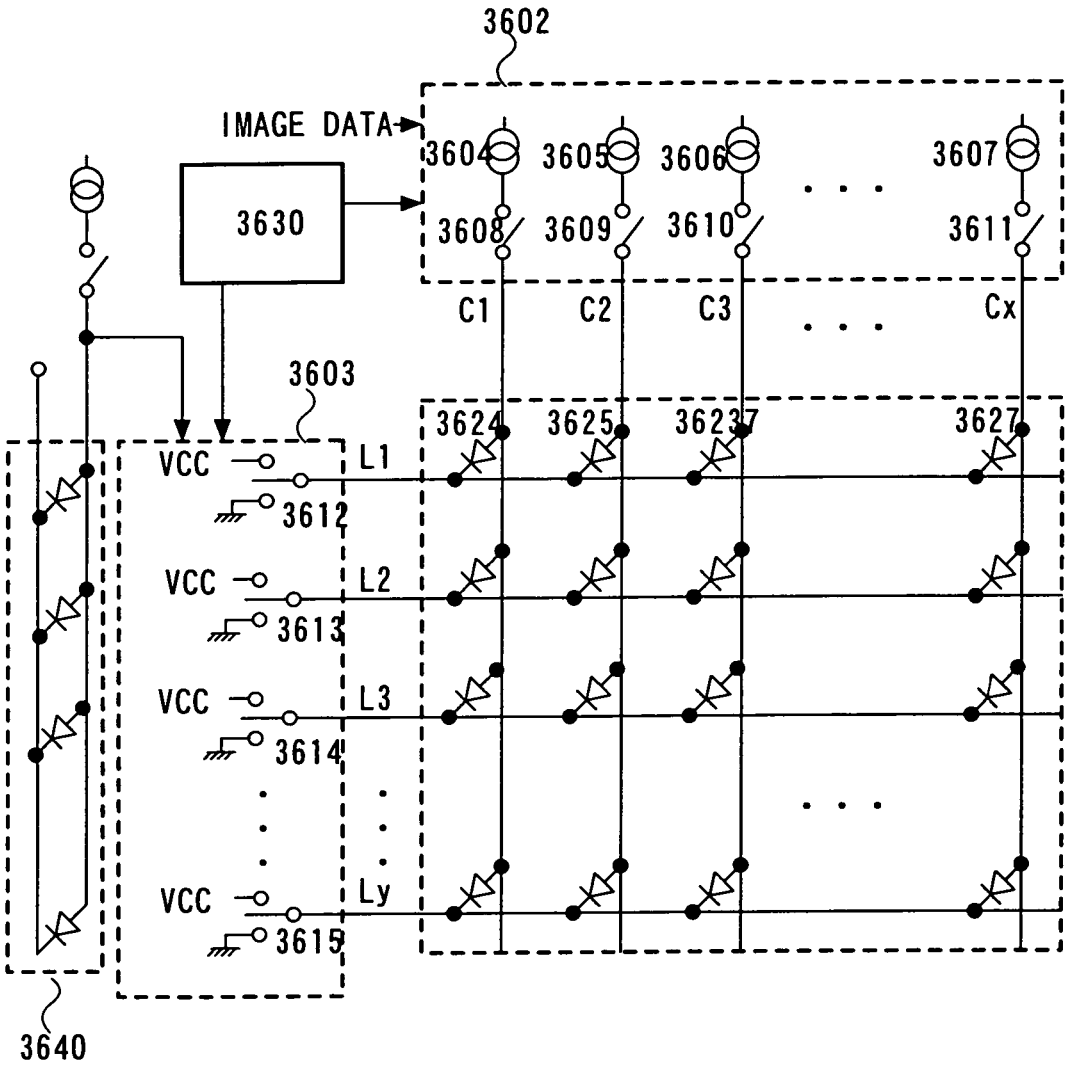
FIG. 36 is a diagram illustrating the display device of the invention.

Description is made now with reference to FIG. 36 on a passive matrix display device to which the invention can be applied. The passive matrix display device comprises a pixel portion formed over a substrate, a column signal line driver circuit 3602 (having current sources 3602 to 3607 and switches 3608 to 3611), a row signal line driver circuit 3603 (having switches 3612 to 3615), and a controller 3630 for controlling the driver circuits 3602 and 3603 each disposed on the periphery of the pixel portion. The pixel portion includes x column signal lines C1 to Cx arranged in columns, y row signal lines L1 to Ly disposed in rows, and a plurality of light emitting elements arranged in matrix (x and y are natural numbers). The column signal line driver circuit 3602 and the row signal line driver circuit 3603 are constructed of LSI chips, and connected to the pixel portion formed over a substrate via an FPC. In addition, a monitoring circuit 3640 is provided over the substrate where the pixel portion is formed.

Figure 37:
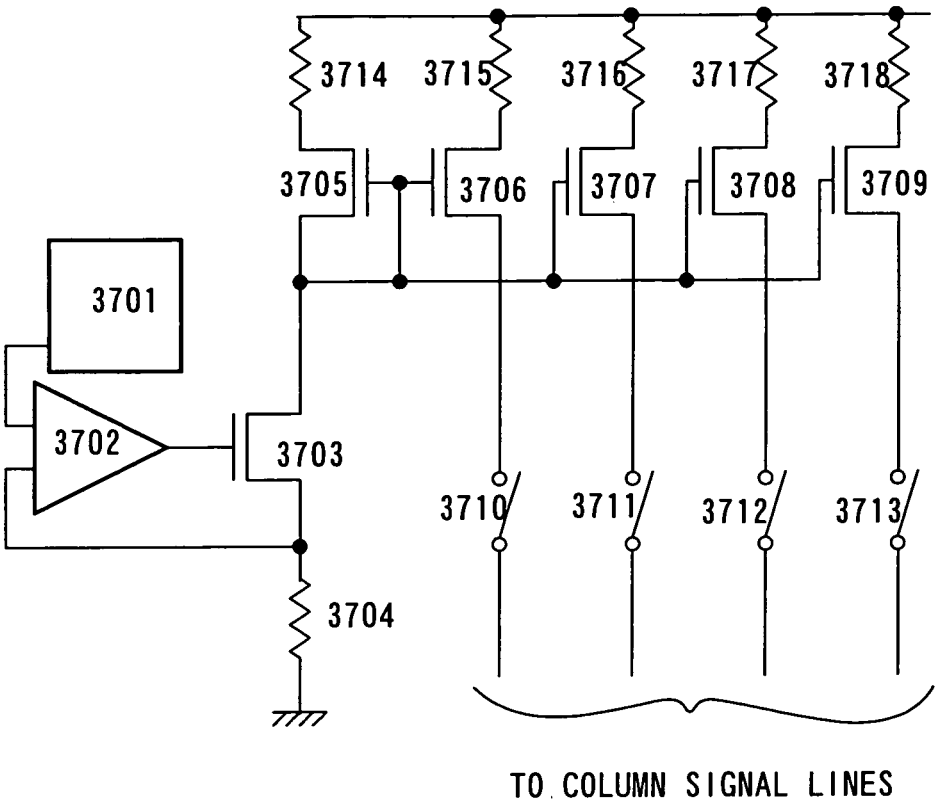
FIG. 37 is a diagram illustrating the display device of the invention.

FIG. 37 is a configuration example of the column signal line driver circuit 3602. A constant voltage source 3701 has a function to generate a constant voltage, and it may be a constant voltage source such as a known band gap regulator having a small temperature coefficient. A voltage generated in the constant voltage source 3701 is converted into a constant current having a small temperature coefficient using an operational amplifier 3702, a transistor 3703 and a resistor 3704. The converted current is inverted and branched using a current mirror circuit configured with transistors 3705 to 3709 and resistors 3714 to 3718, which are supplied to the column signal lines via switches 3710 to 3713.

The display device of this embodiment corrects image data inputted to the column signal line driver circuit 3602 or a voltage generated in the constant voltage source 3701 using the monitoring circuit 3640 in accordance with the change in temperature or the degradation with time of light emitting elements, thereby preventing an adverse effect resulting from both the change in temperature and the degradation with time of the light emitting elements.

Embodiment 4

Electronic appliances having a display device of which pixel region includes light emitting elements, include a television set (television or television receiver), a digital camera, a digital video camera, a cellular phone set (cellular phone), a portable information terminal such as a PDA, a portable game machine, a monitor, a personal computer, a sound reproducing device such as a car audio, an image reproducing device having a recording medium such as a home game machine, and the like. The display device of the invention can be applied to the display portions of these electronic appliances. Specific examples of such electronic appliances are described with reference to FIGS. 31A to 31F.

Figure 31A:
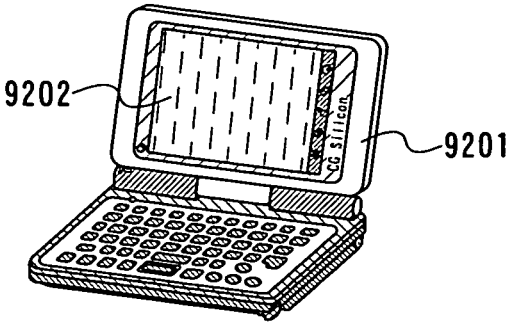
FIGS. 31A to 31F are views of electronic appliances each having the display device of the invention.
Figure 31B:
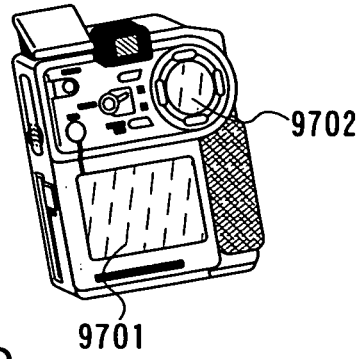
Figure 31C:
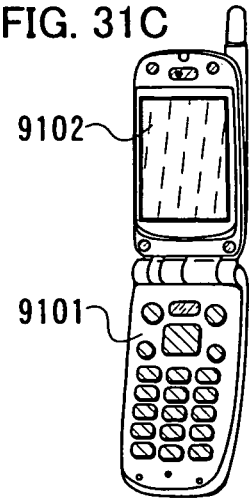
Figure 31D:
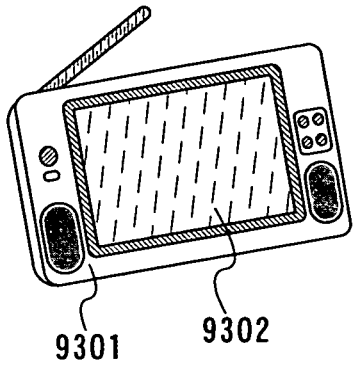
Figure 31E:
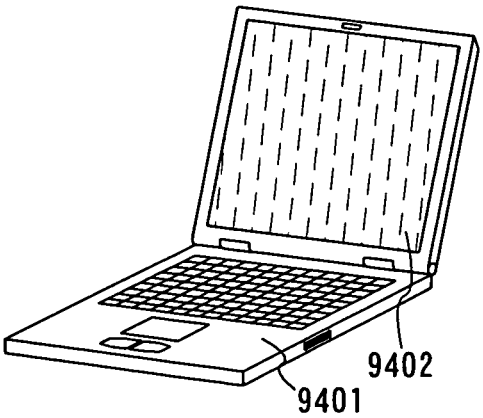
Figure 31F:
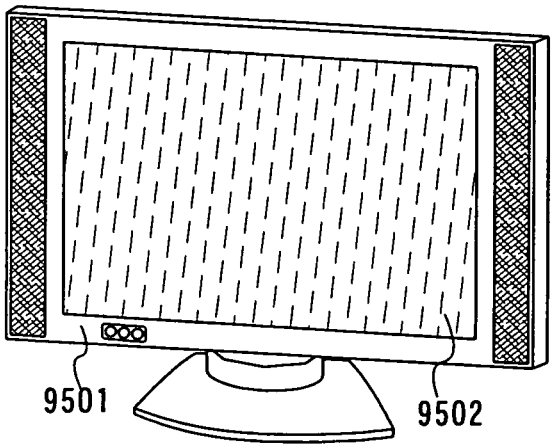

A portable information terminal shown in FIG. 31A to which the display device of the invention is applied includes a main body 9201, a display portion 9202 and the like, of which power consumption can be reduced by the invention. A digital video camera shown in FIG. 31B to which the display device of the invention is applied includes display portions 9701 and 9702 and the like, of which power consumption can be reduced by the invention. A cellular phone terminal shown in FIG. 31C to which the display device of the invention is applied includes a main body 9101, a display portion 9102 and the like, of which power consumption can be reduced by the invention. A portable television set shown in FIG. 31D to which the display device of the invention is applied includes a main body 9301, a display portion 9302, and the like, of which power consumption can be reduced by the invention. A portable computer shown in FIG. 31E to which the display device of the invention is applied includes, a main body 9401, a display portion 9402 and the like, of which power consumption can be reduced by the invention. A television set shown in FIG. 31F to which the display device of the invention includes a main body 9501, a display portion 9502 and the like, of which power consumption can be reduced by the invention. Among the aforementioned electronic appliances, those utilizing batteries can ensure a long operating time of the electronic appliance by the amount of power consumption reduced, thereby battery charging is not required.

Embodiment 5

Figure 32A:
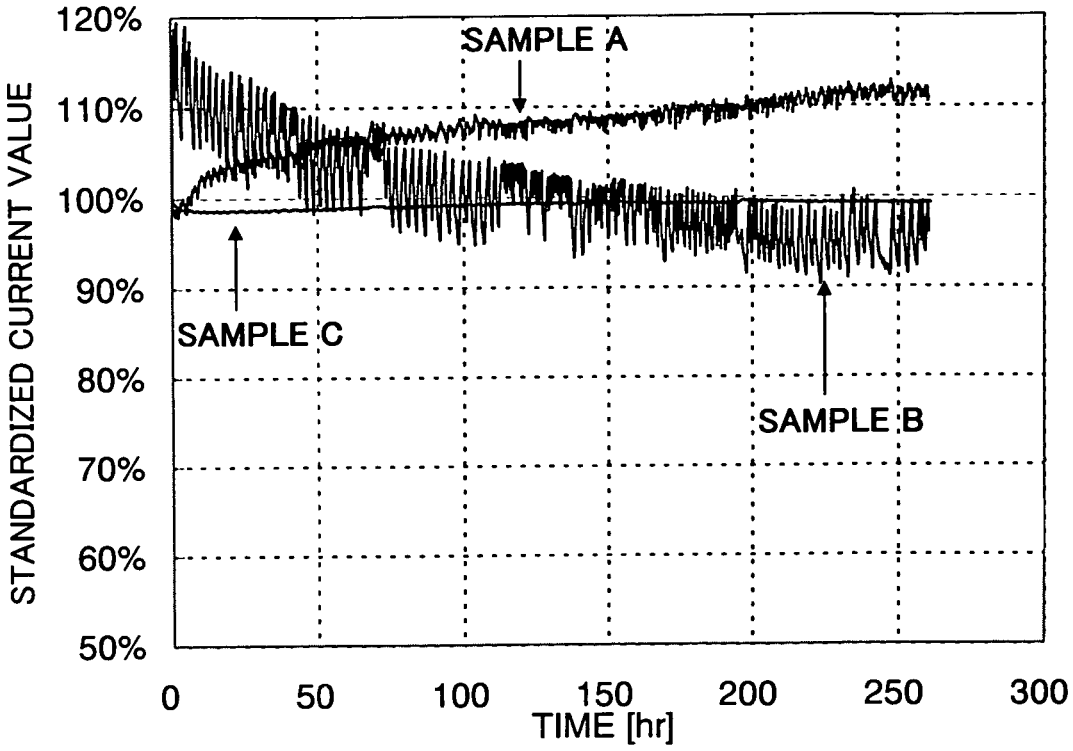
FIG. 32A is a graph illustrating characteristics of a light emitting element with respect to the fluctuation of current values with time.
Figure 32B:
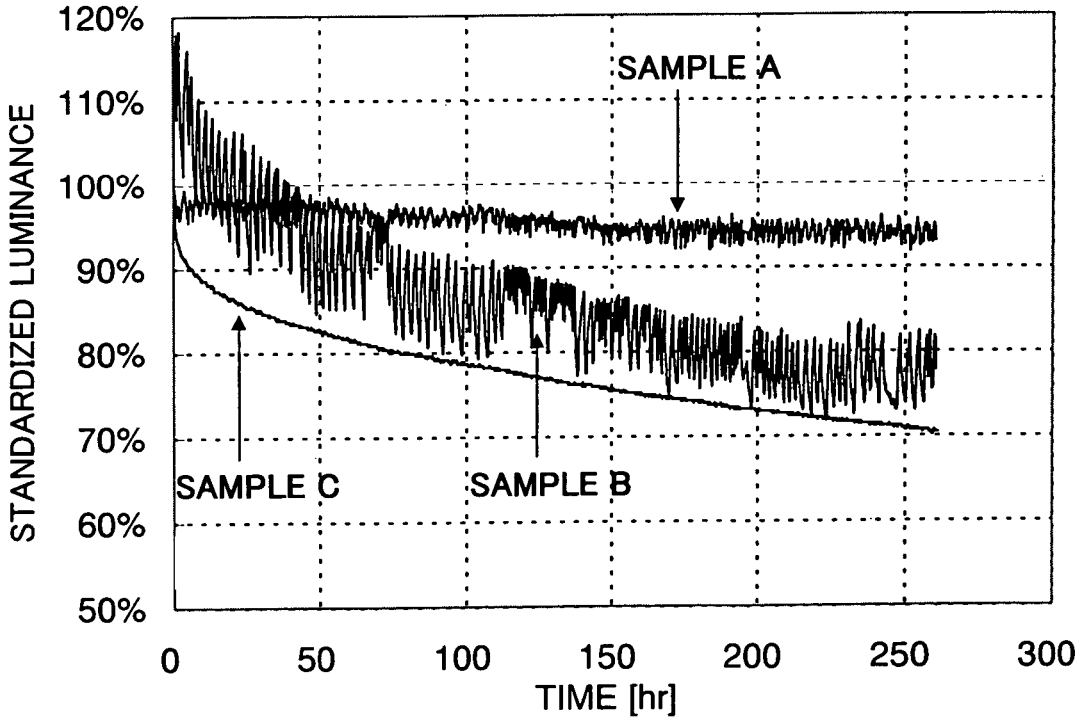
FIG. 32B is a graph illustrating characteristics of a light emitting element with respect to the fluctuation of luminance with time.
Figure 33A:
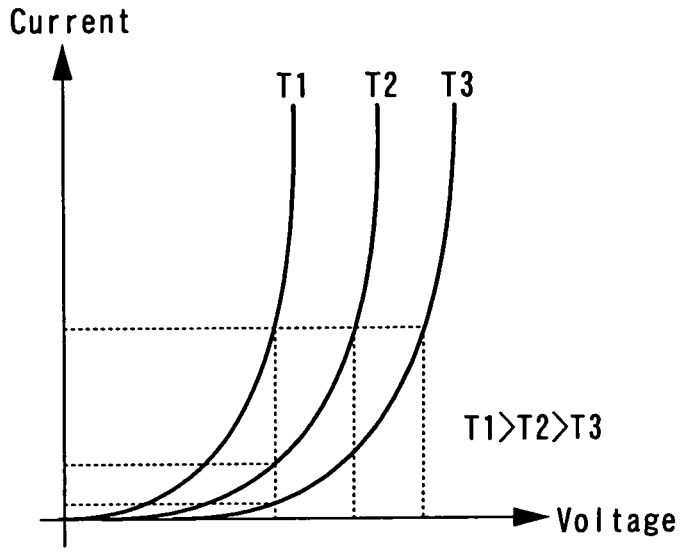
FIG. 33A is a graph illustrating a relationship between V-I characteristics of a light emitting element and temperatures.
Figure 33B:
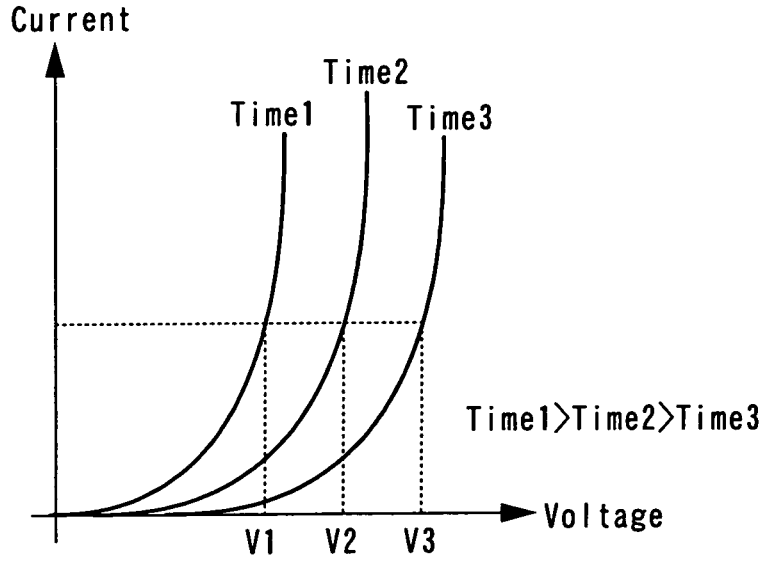
FIG. 33B is a graph illustrating a relationship between V-I characteristics of a light emitting element and time.

In this embodiment, description is made with reference to FIGS. 32A and 32B on the result of an experiment where the display device of the invention is operated at room temperature. FIG. 32A shows characteristics of a light emitting element with respect to the fluctuation of current values with time (260 hours). FIG. 32B shows characteristics of a light emitting element with respect to the fluctuation of luminance with time (260 hours). In both graphs of FIGS. 32A and 32B, a sample A is a panel including the correction function of the invention while samples B and C are panels including no correction function. The samples A and B adopt a constant voltage drive while the sample C adopts a constant current drive.

In both graphs of FIGS. 32A and 32B, abscissa denotes time (hour). Ordinate of FIG. 32A denotes a value (%) obtained by standardizing an actual current value while ordinate of FIG. 32B denotes a value (%) obtained by standardizing an actual luminance.

Note that in all the samples, duty ratio of monitoring elements is 100% while duty ratio of light emitting elements is approximately 64%. In addition, although the total current value of the monitoring elements is equal to that of the monitoring elements, an instantaneous current value of the monitoring elements is different from that of the light emitting elements.

It is apparent from FIG. 32A that: the current value of the sample A is gradually increased with time; the current value of the sample B fluctuates to a large degree, and the current value is gradually decreased with time; and the current value of the sample C does not fluctuate much, and the current value is substantially constant even after a certain period of time has passed. The current value of the sample A is gradually increased with time since the duty ratio of the monitoring elements is 100% while the duty ratio of the light emitting elements is 64%, which means that the monitoring elements degrades with time faster than the light emitting elements.

In addition, it is apparent from FIG. 32B that: the luminance of the sample A does not fluctuate much with time, and the luminance is maintained substantially constant; the luminance of the sample B fluctuates to a large degree, and the current value is gradually decreased with time; and the current value of the sample C does not fluctuate much, however, the luminance is gradually decreased with time similarly to the sample B.

According to the result of FIGS. 32A and 32B, the sample A to which the invention is applied has a current value being increased gradually, however, the luminance thereof is constant. This is because, although the current value is gradually increased, the degradation proceeds faster by the amount of a current value increased by +Δ. That is, the amount of a current value increased by +Δ by the correction function and the amount of a current value decreased due to degradation with time are cancelled out, thereby the sample A to which the invention is applied can have a substantially constant luminance.

According to the aforementioned operation, the display device having the correction function of the invention can maintain a constant luminance, therefore, it can be called a constant-luminance display device.

In addition, a driving method of a display device having a correction function as the invention can be called a constant-luminance driving method (constant brightness method, constant luminescence method, brightness control method, control brightness method, or brightness control method). According to such a driving method, light emitting elements are driven under the conditions that the amount of a current value increased by the correction function and the amount of a current value decreased by the degradation with time are calculated in advance as set forth above, and a voltage having an enough level to cancel out the difference is applied.

The present application is based on Japanese Priority application No. 2004-152626 filed on May 21, 2004 with the Japanese Patent Office, the entire contents of which are hereby incorporated by reference.

What is claimed is:

1. A display device comprising:

a first current source for supplying a constant current;

a first monitoring element including a first electrode and a second electrode, the second electrode of the first monitoring element being electrically connected to the first current source via a first switch;

a second monitoring element including a first electrode and a second electrode, the second electrode of the second monitoring element being electrically connected to the first current source via a second switch; and a light emitting element including a first electrode and a second electrode, the second electrode of the light emitting element being electrically connected to the first current source via a buffer amplifier and a driving transistor, wherein the first electrodes of the first and second monitoring elements and the first electrode of the light emitting element are electrically connected to an electrode fixed at a constant potential, wherein the first and second monitoring elements and the light emitting element comprise the same materials and are provided over a substrate, and wherein the buffer amplifier is configured to detect a potential of the second electrode of an emitting one of the first and second monitoring elements when the first and second switches are alternately turned ON.

2. An electronic appliance comprising as a display portion the display device according to claim 1.

3. An electronic appliance according to claim 2, wherein the electronic appliance is a camera.

4. An electronic appliance according to claim 2, wherein the electronic appliance is a personal computer.

5. An electronic appliance according to claim 2, wherein the electronic appliance is a cellular phone.

6. An electronic appliance according to claim 2, wherein the electronic appliance is a portable information terminal.

7. The display device according to claim 1, wherein the buffer amplifier is electrically connected to the second electrodes of the first and second monitoring elements via the first and second switches, respectively.

8. The display device according to claim 1, wherein the first and second switches are first and second transistors, respectively.

9. The display device according to claim 8, wherein the first and second transistors have different conductivity types.

10. The display device according to claim 8, wherein the first and second transistors have a same conductivity type.

11. The display device according to claim 8, wherein each of the first and second transistors is selected form the group consisting of a thin film transistor using a non-single crystalline semiconductor film, a MOS transistor, a junction transistor, a bipolar transistor, a transistor using an organic semiconductor, and a transistor using a carbon nanotube.

12. A display device comprising:

a first current source for supplying a constant current;

a plurality of monitoring elements each including a first electrode and a second electrode, the second electrodes of the plurality of monitoring elements being connected to the first current source via a plurality of switches, respectively; and a light emitting element including a first electrode, a second electrode and a second electrode, the second electrode of the light emitting element being connected to the first current source via a buffer amplifier and a driving transistor, wherein the first electrodes of the plurality of monitoring elements and the first electrode of the light emitting element are connected to an electrode fixed at a constant potential, wherein the plurality of monitoring elements and the light emitting element comprise the same materials and are provided over a substrate, and wherein the buffer amplifier is configured to detect a potential of the second electrode of an emitting one of the plurality of monitoring elements when the plurality of switches are alternately turned ON.

13. An electronic appliance comprising as a display portion the display device according to claim 12.

14. An electronic appliance according to claim 13, wherein the electronic appliance is a camera.

15. An electronic appliance according to claim 13, wherein the electronic appliance is a personal computer.

16. An electronic appliance according to claim 13, wherein the electronic appliance is a cellular phone.

17. An electronic appliance according to claim 13, wherein the electronic appliance is a portable information terminal.

18. The display device according to claim 12, wherein the buffer amplifier is electrically connected to the second electrodes of the plurality of monitoring elements via the plurality of switches, respectively.

19. The display device according to claim 12, wherein the plurality of switches are a plurality of transistors, respectively.

20. The display device according to claim 19, wherein the plurality of transistors have different conductivity types.

21. The display device according to claim 19, wherein the plurality of transistors have a same conductivity type.

22. The display device according to claim 19, wherein each of the plurality of transistors is selected form the group consisting of a thin film transistor using a non-single crystalline semiconductor film, a MOS transistor, a junction transistor, a bipolar transistor, a transistor using an organic semiconductor, and a transistor using a carbon nanotube.

23. A display device comprising:

a first current source for supplying a constant current and a second electrode, a first monitoring element including a first electrode and a second electrode and a second electrode, the second electrode of the first monitoring element being connected to the first current source via a switch;

a second monitoring element including a first electrode and a second electrode, the second electrode of the second monitoring element being connected to the first current source via the switch; and a light emitting element including a first electrode, a second electrode and a second electrode, the second electrode of the light emitting element being electrically connected to the first current source via a buffer amplifier and a driving transistor, wherein the first electrodes of the first and second monitoring elements and the first electrode of the light emitting element are electrically connected to an electrode fixed at a constant potential, wherein the first and second monitoring elements and the light emitting element comprise the same materials and are provided over a substrate, and wherein the buffer amplifier is configured to detect a potential of the second electrode of an emitting one of the first and second monitoring elements when the first and second monitoring elements are alternately turned ON.

24. An electronic appliance comprising as a display portion the display device according to claim 23.

25. An electronic appliance according to claim 24, wherein the electronic appliance is a camera.

26. An electronic appliance according to claim 24, wherein the electronic appliance is a personal computer.

27. An electronic appliance according to claim 24, wherein the electronic appliance is a cellular phone.

28. An electronic appliance according to claim 24, wherein the electronic appliance is a portable information terminal.

29. The display device according to claim 23, wherein the buffer amplifier is electrically connected to the second electrodes of the first and second monitoring elements via the switch.

30. The display device according to claim 23, wherein the switch comprises an analog switch.

31. A display device comprising:

a first current source for supplying a constant current;

a plurality of monitoring elements each including a first electrode and a second electrode, the second electrodes of the plurality of monitoring elements being connected to the first current source via a switch; and a light emitting element including a first electrode and a second electrode, the second electrode of the light emitting element being connected to the first current source via a buffer amplifier and a driving transistor, wherein the first electrodes of the plurality of monitoring elements and the first electrode of the light emitting element are connected to an electrode fixed at a constant potential, wherein the first and second monitoring elements and the light emitting element comprise the same materials and are provided over a substrate, and wherein the buffer amplifier is configured to detect a potential of the second electrode of an emitting one of the plurality of monitoring elements when the plurality of monitoring elements are alternately turned ON.

32. The display device according to claim 31, wherein the buffer amplifier is electrically connected to the second electrodes of the plurality of monitoring elements via the switch.

33. The display device according to claim 31, wherein the switch comprises an analog switch and an inverter.

34. An electronic appliance comprising as a display portion the display device according to claim 31.

35. An electronic appliance according to claim 34, wherein the electronic appliance is a camera.

36. An electronic appliance according to claim 34, wherein the electronic appliance is a personal computer.

37. An electronic appliance according to claim 34, wherein the electronic appliance is a cellular phone.

38. An electronic appliance according to claim 34, wherein the electronic appliance is a portable information terminal.

* * * * *

UNITED STATES PATENT AND TRADEMARK OFFICE

CERTIFICATE OF CORRECTION

PATENT NO. : 8,421,715 B2
APPLICATION NO. : 11/131462
DATED : April 16, 2013
INVENTOR(S) : Masahiko Hayakawa et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1441 days.

Signed and Sealed this
Seventh Day of October, 2014

Michelle K. Lee

Michelle K. Lee
*Deputy Director of the United States Patent and Trademark Office*